US011325728B2

(12) United States Patent
Takada et al.

(10) Patent No.: US 11,325,728 B2
(45) Date of Patent: May 10, 2022

(54) INDIVIDUAL PACKAGING DEVICE FOR TABLETS

(71) Applicant: YUYAMA MFG. CO., LTD., Osaka (JP)

(72) Inventors: Yasuyuki Takada, Osaka (JP); Takashi Iwatani, Osaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 0 days.

(21) Appl. No.: 17/009,363

(22) Filed: Sep. 1, 2020

(65) Prior Publication Data

US 2020/0391887 A1 Dec. 17, 2020

Related U.S. Application Data

(63) Continuation of application No. PCT/JP2019/008885, filed on Mar. 6, 2019.

(30) Foreign Application Priority Data

Mar. 9, 2018 (JP) ..... JP2018-042611

(51) Int. Cl.
*B65B 5/10* (2006.01)
*B65B 5/12* (2006.01)
*B65B 43/54* (2006.01)

(52) U.S. Cl.
CPC ..... *B65B 5/103* (2013.01); *B65B 5/12* (2013.01); *B65B 43/54* (2013.01)

(58) Field of Classification Search
CPC ..... B65B 5/103; B65B 43/54; B65B 43/55; B65B 43/56; B65B 43/57; B65B 43/58; B65B 43/59

(Continued)

(56) References Cited

U.S. PATENT DOCUMENTS 9,272,796 B1 * 3/2016 Chudy ..... G07G 1/0045
10,275,977 B2 * 4/2019 Kohama ..... G06Q 10/087

(Continued)

FOREIGN PATENT DOCUMENTS

JP 2015101366 A 6/2015
JP 5870931 B2 3/2016

(Continued)

OTHER PUBLICATIONS

Google Patents translation of KR 20180105804 A (Year: 2018).*

(Continued)

*Primary Examiner* — Anna K Kinsaul
*Assistant Examiner* — Himchan Song
(74) *Attorney, Agent, or Firm* — Robert P. Michal, Esq.; Carter, DeLuca & Farrell LLP

(57) ABSTRACT

A tablet packaging device capable of shortening operation time required for packaging tablets for one tray. The tablet packaging device includes a packaging portion configured to accommodate tablets dispensed from a dispensing port into a tray. The packaging portion includes: a tray loading unit to which the tray is mountable; a tray unloading unit to which the tray accommodating the tablets is mountable; a tray driving unit, which is configured to removably support the tray, move the supported tray among positions of the dispensing port, the tray loading unit, and the tray unloading unit, and move the desired accommodation recess portion to the dispensing port for tablets; a tray attaching unit configured to attach the tray from the tray loading unit to the tray driving unit; and a tray detaching unit configured to detach the tray from the tray driving unit and place the tray on the tray unloading unit.

19 Claims, 35 Drawing Sheets

(58) Field of Classification Search
USPC ..... 53/237
See application file for complete search history.

(56) References Cited

U.S. PATENT DOCUMENTS

| | | | | |
|---|---|---|---|---|
| 10,308,386 | B2 * | 6/2019 | Koike | G07F 17/0092 |
| 2007/0157548 | A1 * | 7/2007 | Knoth | B65B 43/54 53/244 |
| 2009/0044489 | A1 * | 2/2009 | Siegel | B65B 35/40 53/247 |
| 2009/0188937 | A1 | 7/2009 | Kim | |
| 2013/0212987 | A1 * | 8/2013 | Shigeyama | A61J 7/0076 53/493 |
| 2018/0265232 | A1 * | 9/2018 | Kim | B65B 39/007 |
| 2019/0337647 | A1 * | 11/2019 | Yokoyama | A61J 3/00 |

FOREIGN PATENT DOCUMENTS

| | | | | |
|---|---|---|---|---|
| JP | 2017506127 | A | 3/2017 | |
| KR | 20180105804 | A * | 10/2018 | B65B 11/52 |
| WO | 2012070643 | A1 | 5/2012 | |
| WO | 2017043430 | A1 | 3/2017 | |

OTHER PUBLICATIONS

International Preliminary Report on Patentability issued by the International Bureau of WIPO in relation to International Application No. PCT/JP2019/008885 dated Sep. 15, 2020 (4 pages) along with English language translation (5 pages).

Written Opinion of the International Searching Authority issued by the Japanese Patent Office acting as the International Searching Authority in relation to International Application No. PCT/JP2019/008885 dated Apr. 23, 2019 (3 pages) along with English language translation (3 page).

International Search Report issued by the Japanese Patent Office acting as the International Searching Authority in relation to International Application No. PCT/JP2019/008885 dated Apr. 23, 2019 (3 pages) along with English language translation (1 page).

* cited by examiner

INDIVIDUAL PACKAGING DEVICE FOR TABLETS

CROSS-REFERENCE TO RELATED APPLICATIONS

This application is a continuation of PCT International Patent Application No. PCT/JP22019/008885 filed Mar. 6, 2019, which claims the benefit of Japanese Patent Application No. 2018-042611, filed Mar. 9, 2018 the disclosure of each of these applications are expressly incorporated herein by reference in their entireties.

TECHNICAL FIELD

This invention relates to a tablet packaging device, which is configured to package prescribed tablets for every administration into a tray of a blister pack type (hereinafter referred to simply as "tray").

BACKGROUND ART

There has hitherto been known a tablet packaging device configured to automatically distribute and pack prescribed tablets into individual accommodation recess portions of a tray that is called "weekly calendar pack" including accommodation recess portions arranged in seven rows by four columns (Patent Literature 1). The tray is capable of accommodating tablets packaged for four times of administrations per day into accommodation recess portions corresponding to one row, and by seven columns in total, thereby being capable of accommodating tablets for administrations per week.

The tablet packaging device of Patent Literature 1 is a tablet packaging device configured to receive all of the tablets corresponding to one tray through use of one carrier, move the carrier to a position above a tray waiting at a discharging position, and open a shutter forming a bottom wall of the carrier, thereby simultaneously discharging the tablets into all of the accommodation recess portions of the tray. This device has an advantage in that high packaging efficiency is achieved with less erroneous packaging, and the structure can be simplified.

CITATION LIST

Patent Literature

[PTL 1] JP 5870931 B2

SUMMARY OF INVENTION

Technical Problem

The tablet packaging device described in Patent Literature 1 has the following configuration. The carrier having received tablets corresponding to one tray is moved to the position of the tray mounted to a drawer mounted in such a manner as to be freely placed in and out. Then, the shutter of the carrier is opened to discharge the tablets. Thus, the tray is in a state of being placed on the drawer until tablets are discharged to one tray, and the next tray for another prescription cannot be set until the operation of discharging the tablets to the one tray is terminated. Therefore, there is a problem in that the operation efficiency is not improved.

Moreover, at the time of discharging tablets from the carrier to the tray, there is also a risk of causing erroneous packaging in which the fallen tablets bounce in the recess portion of the tray and jump out to an outside of the recess portion.

In view of the above-mentioned problems, this invention has an object to provide a tablet packaging device, which is capable of shortening operation time required for packaging tablets for one tray and is capable of more reliably packaging tablets.

Solution to Problem

In order to solve the above-mentioned problems, according to one embodiment of the present invention, there is provided a tablet packaging device, including: a tablet accommodating portion configured to store a plurality of kinds of tablets and dispense a tablet based on prescription information; and a packaging portion configured to dispense the tablets, which are dispensed from the tablet accommodating portion, through a dispensing port and distribute and accommodate the tablets to a tray having a plurality of accommodation recess portions, wherein the packaging portion includes: a tray loading unit to which the tray is mountable; a tray unloading unit, which is arranged adjacent to the tray loading unit, and to which the tray accommodating the tablets is mountable; a tray driving unit, which is configured to move the supported tray between positions of the tray loading unit and the tray unloading unit, and move the desired accommodation recess portion of the tray to the dispensing port for tablets; a tray attaching unit configured to attach the tray from the tray loading unit to the tray driving unit; and a tray detaching unit configured to detach the tray accommodating the tablets from the tray driving unit and place the tray on the tray unloading unit (claim 1).

The tray driving unit is configured to support the tray at positions above the tray loading unit and the tray unloading unit, wherein the tray driving unit is configured to move the tray in a horizontal plane, wherein the tray attaching unit is configured to lift up the tray from the tray loading unit and attach the tray to the tray driving unit, wherein the tray detaching unit is configured to detach the tray accommodating the tablets from the tray driving unit, lower the tray, and place the tray on the tray unloading unit (claim 2).

The tray driving unit includes an XY robot configured to move the supported tray in a width direction and a front-and-rear direction of the device in a horizontal plane (claim 3).

The tray driving unit includes: a conveyance stage, which is capable of being positioned above the tray loading unit and the tray unloading unit, and includes division chambers, which are arranged at positions matching the accommodation recess portions of the tray and are opened in the up-and-down direction; and a tray fixing member configured to attach the tray to a lower side of the conveyance stage under a state in which positions of the division chambers and positions of the accommodation recess portions of the tray match each other (claim 4).

The tray is mounted to the tray loading unit under a state in which the tray is placed on an adapter, which is opened on an upper side and is capable of accommodating the tray from the upper side, wherein the adapter includes stage engagement ratchets which are attachable to and detachable from tray fixing members of the conveyance stage, wherein the tray fixing members extend downward from side edges of the conveyance stage and have engagement holes which are engageable with the stage engagement ratchets, wherein the tray is attached to the tray driving unit in a state of being sandwiched between a lower surface of the conveyance stage and an upper surface of the adapter, and the conveyance stage is driven so that one of the division chambers is located at a position corresponding to the dispensing port to receive the tablets dispensed from the dispensing port, and wherein the tray having the tablets discharged thereto and accommodated therein is mounted to the tray unloading unit in a state of being placed on the adapter (claim 5).

The tray loading unit is formed of a drawer provided so as to be freely placed in and out with respect to the packaging portion and includes a first placement table configured to place the tray inside the drawer, wherein the first placement table is set so as to be located at a tray handling position outside the packaging portion when the drawer is drawn out, and the first placement table is set so as to be located at a waiting position inside the packaging portion when the drawer is pushed in, and wherein the tray attaching unit includes a first raising/lowering device, which is provided below the waiting position of the tray loading unit and is configured to attach the tray to a lower surface of the conveyance stage located above the waiting position by lifting up the tray located at the waiting position from the lower side (claim 6).

The first placement table of the tray loading unit includes a set of first support members configured to support both ends of the adapter in a width direction, and a region between the first support members is a first raising/lowering device passage region for allowing the first raising/lowering device to pass therethrough (claim 7).

The tray unloading unit is formed of a drawer provided so as to be freely placed in and out and includes a second placement table configured to place the tray inside the drawer, wherein the second placement table is set so as to be located at a tray handling position outside the packaging portion when the drawer is drawn out, and the second placement table is set so as to be located at a waiting position inside the packaging portion when the drawer is pushed in, and wherein the tray detaching unit includes a second raising/lowering device, which is provided below the waiting position of the tray unloading unit with respect to the packaging portion and is configured to support, from below, the tray detached from the lower surface of the conveyance stage located above the waiting position and mount the tray to the second placement table of the tray unloading unit (claim 8).

The second placement table of the tray unloading unit includes a set of second support members configured to support both ends of the adapter in a width direction, and a region between the second support members is a second raising/lowering device passage region for allowing the second raising/lowering device to pass therethrough (claim 9).

The second raising/lowering device includes a releasing member configured to disengage the tray fixing members at the time of supporting, from below, the tray attached to the lower surface of the conveyance stage (claim 10).

The tablet packaging device further includes a manual-distribution unit configured to add tablets to the accommodation recess portions of the tray, wherein the manual-distribution unit includes: a manual-distribution container including: a manual-distribution member having division chambers, which are opened on upper and lower sides and are arranged at positions matching with the accommodation recess portions of the tray; and a shutter, which is slidably provided to a bottom surface of the manual-distribution member and is configured to open and close the division chambers; and a drawer portion, which is provided so as to allow the manual-distribution container to be pushed in and drawn out, and is set so as to allow the manual-distribution container to be located at a tablet distribution position outside the packaging portion when the drawer portion is drawn out and allow the manual-distribution container to be located at a discharging position at which the accommodation recess portions of the tray having the tablets discharged thereto and accommodated therein and the division chambers correspond to each other (claim 11).

The drawer portion of the manual-distribution unit is provided at a position above the tray unloading unit, and the discharging position of the drawer portion of the manual-distribution unit matches the waiting position of the tray unloading unit as seen from above (claim 12).

The manual-distribution container is located above the conveyance stage, the shutter includes engagement pieces extending downward to an end portion of the conveyance stage on a downstream side in the moving direction of the conveyance stage, and is attached while being urged under a state in which the division chambers of the manual-distribution container are closed, and the engagement pieces engage with the conveyance stage along with movement of the conveyance stage to slide the shutter toward the downstream side in the moving direction of the conveyance stage, thereby opening the division chambers (claim 13).

The tablet accommodating portion includes: a tablet cassette shelf configured to hold a plurality of tablet cassettes; and a tablet conveying device configured to convey tablets, which are supplied from a corresponding tablet cassette shelf in accordance with a prescription, to a predetermined position, wherein the tablet conveying device includes: a primary conveyance portion configured to convey tablets in a direction intersecting a direction from the tablet cassette shelf side toward the packaging portion side; and a secondary conveyance portion configured to convey the tablets in the direction from the tablet cassette shelf side toward the packaging portion, and wherein the tablet conveying device is configured to perform: a first operation of conveying the tablets with the primary conveyance portion and thereafter conveying the tablets with the secondary conveyance portion; and a second operation of receiving the tablets from the tablet cassette shelf without passage through the primary conveyance portion and conveying the tablets with the secondary conveyance portion (claim 14).

The primary conveyance portion includes: a catching portion configured to catch supplied tablets; and a tablet push-out piece portion, which is movable in a conveyance direction of tablets in the primary conveyance portion, and is configured to push and move the tablets located at the catching portion (claim 15).

The tablet conveying device further includes a leading portion configured to temporarily accommodate tablets supplied and led from the tablet cassette (claim 16).

The leading portion includes: an accommodation space including a discharging port portion configured to primarily accommodate the tablets having been led thereinto and discharge the tablets to the primary conveyance portion side or the secondary conveyance portion; and a movable catching member which is switchable between a tablet discharging posture of closing the discharging port portion and a tablet catching posture of allowing the discharging port portion to communicate with an outside (claim 17).

In the tablet catching posture, the movable catching member is inclined with respect to a horizontal direction to catch tablets having been led and accommodate the tablets in the leading portion (claim 18).

Advantageous Effects of Invention

In the tablet packaging device according to this invention, the tray mounted to the tray loading unit is attached to the tray driving unit, and the tray is then driven, thereby being capable of directly packaging tablets into the tray. Thus, the tray is not placed on the tray loading unit during the packaging operation. Moreover, the tray having tablets discharged thereto and accommodated therein is mounted to the tray unloading unit. Thus, after the tray is delivered from the tray loading unit to the tray driving unit, a state in which the tray is not mounted to the tray loading unit is brought about. Accordingly, during the operation with the tray, a tray for the next prescription can be mounted to the tray loading unit. Therefore, the operation efficiency of the packaging operation for the tray can be improved.

Moreover, in the packaging operation for the tray, tablets are directly packaged into the tray. Thus, the number of times of moving tablets during the packaging operation for the tray is reduced as compared to a case in which tablets are moved to the tray after packaging the tablets into the carrier. Therefore, the risk of causing erroneous packaging can be reduced.

DESCRIPTION OF EMBODIMENTS

Figure 1:
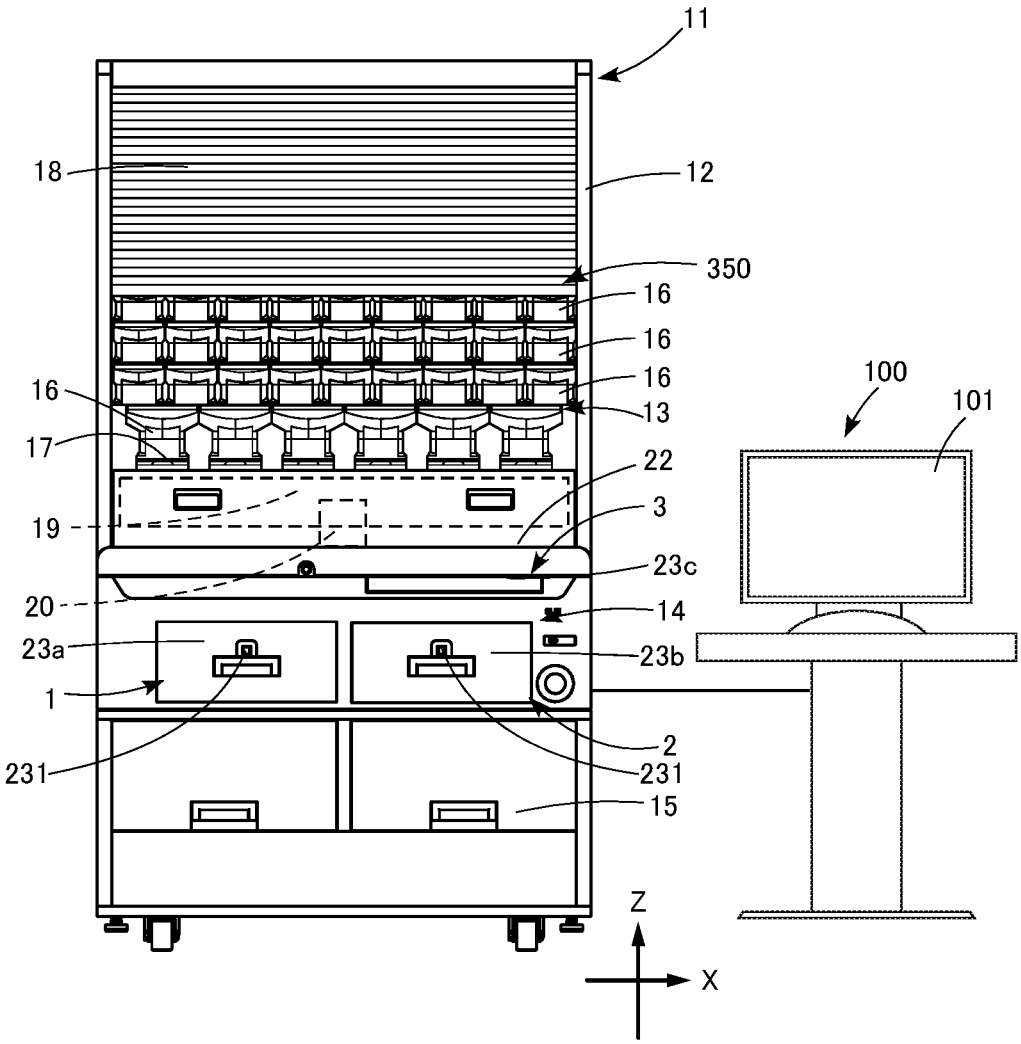
FIG. 1 is a front view of a tablet packaging device according to an embodiment of the present invention.

Now, with reference to the accompanying drawings, a tablet packaging device according to an embodiment of this invention is described.

FIG. 1 to FIG. 4 are illustrations of an exterior configuration of a tablet packaging device 11 according to this embodiment. The tablet packaging device 11 illustrated in FIG. 1 includes, for example, a tablet accommodating portion 13, a packaging portion 14, and an accommodating portion 15. The tablet accommodating portion 13 is provided at an upper half part of a frame 12. The packaging portion 14 (see FIG. 2) projecting forward from the upper half part is provided at a lower half part of a frame 12. The accommodating portion 15 for empty trays or the like is provided on a lower side of the packaging portion 14. A large number of tablet cassettes 16 are accommodated in multiple stages in the tablet accommodating portion 13, and tablet feeders 17 are installed on a lower side of the tablet cassettes 16.

An input device 100 is connected to the tablet packaging device 11. The input device 100 includes a code reader (not shown) configured to read a barcode or a QR code (trademark) given to a prescription. The input device 100 is configured to give prescription information, which is based on data read through use of the code reader, to the tablet packaging device 11. The input device 100 includes operation input devices such as a keyboard (not shown) in addition to the code reader, and information such as prescription information can be given to the tablet packaging device 11 through use of the operation input devices.

The tablet packaging device 11 produces a prescription ID corresponding to the received prescription information. The prescription ID and the prescription information are associated with each other. The prescription information includes, for example, information required for packaging such as a kind of a drug, the number of tablets, and administration timings, and patient information. The prescription ID is used at the time of reading prescription information associated therewith.

The input device 100 is formed of, for example, a personal computer. The personal computer includes, for example, a CPU, a ROM, and a RAM. The CPU is configured to perform arithmetic processing based on various programs stored in the ROM.

The input device 100 formed of a personal computer sends the prescription information to the tablet packaging device 11. Moreover, based on processing state information that is given by the tablet packaging device 11, for example, progress information of the tablet packaging device 11 is displayed on a monitor 101.

When the input device 100 is connected to a system of a pharmacy, a hospital, or the like through a communication network such as a LAN or the Internet, the input device 100 is capable of obtaining prescription data from the system of a pharmacy, a hospital, or the like via the communication network. Then, the input device 100 gives the prescription data obtained from the system of a pharmacy, a hospital, or the like to the tablet packaging device 11.

Figure 2:
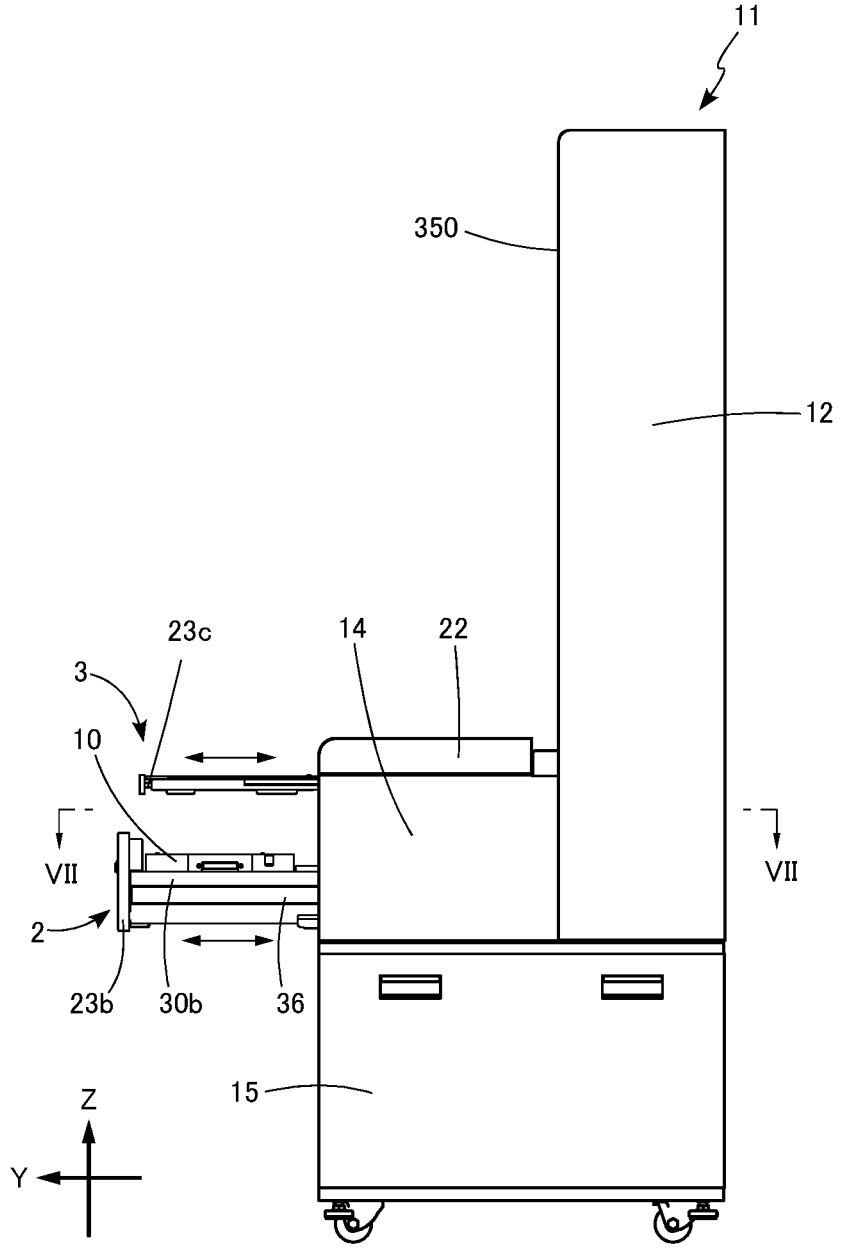
FIG. 2 is a side view of the tablet packaging device of FIG. 1.

Regarding the tablet packaging device according to this embodiment, directions are defined as indicated in FIG. 1 and FIG. 2. That is, a width direction of the device corresponds to an X axis. A front-and-rear direction of the device corresponds to a Y axis. A height direction of the device corresponds to a Z axis. In the following, the directions of the device are described based on the definitions described above.

<Tablet Accommodating Portion>

The tablet accommodating portion 13 includes the large number of tablet cassettes 16 and the tablet feeders 17 provided to the tablet cassettes 16. The large number of tablet cassettes 16 are configured to store a plurality of kinds of tablets as drugs. In accordance with prescription information corresponding to a prescription ID, tablets are dispensed from the tablet cassette 16 by the tablet feeder 17, and the tablets fall into a tablet supplying device 19. The number of the tablets is counted when the tablets pass through a passage of the tablet feeder 17, and a predetermined number of tablets fall into the tablet supplying device 19.

On a back side of the tablet accommodating portion 13, back lids of an opening/closing type (not shown) are installed. The back lids include an upper lid configured to open upward and a lower lid configured to open downward. When the lower lid is opened, falling passages for tablets into the tablet supplying device 19 described later are opened. Accordingly, only the falling passages for tablets can be cleaned.

The tablet supplying device 19 is provided below the tablet feeders 17. The tablet supplying device 19 is configured to receive tablets which fall from the tablet feeder 17. The tablets to be received by the tablet supplying device 19 are tablets selected from tablets stored in the tablet cassettes 16, and the number and a kind of the tablets are determined based on prescription information. The tablet supplying device 19 collects the received tablets to a center and delivers the collected tablets to a tablet push-out passage 20 (see FIG. 7) extending in the front-and-rear direction. The tablets are delivered toward a near side in the tablet push-out passage 20 and dispensed through a dispensing port 21, which is located at an upper part of the packaging portion 14 and directed downward. Prescribed tablets for every administration, for example, tablets of the amount corresponding to four times of administrations per day by one week or three times of administrations per day by five days are intermittently dispensed through the dispensing port 21 in each cycle of a conveying process described later.

The tablet cassettes 16 and the tablet feeders 17 are accommodated in a tablet cassette shelf 350 as illustrated in FIGS. 1 to 4 and FIG. 29. The tablet cassette shelf 350 is opened and closed in an up-and-down direction by a louver shutter 18.

Figure 29:
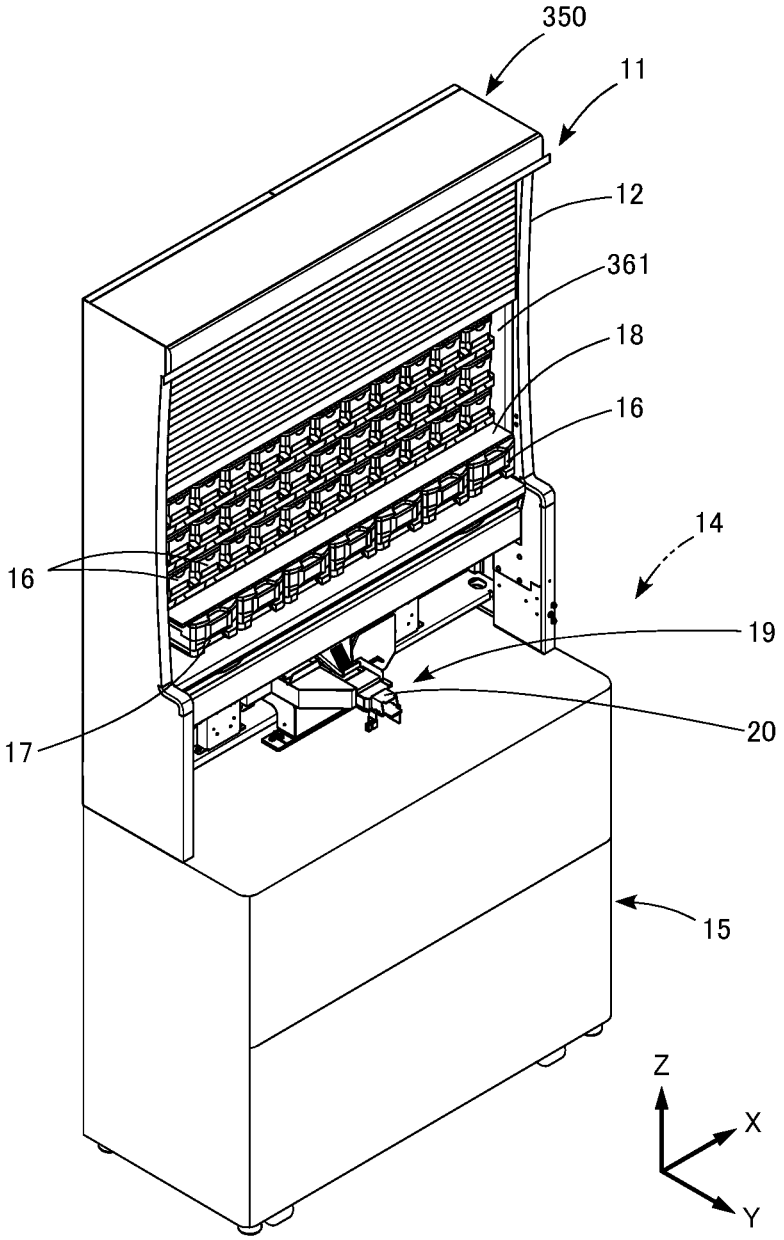
FIG. 29 is a perspective view for illustrating an arrangement configuration of a tablet accommodating portion of the tablet packaging device of FIG. 1.

As illustrated in FIG. 29, the tablet cassette shelf 350 has the structure including a container attaching portion 361 and the tablet supplying device 19. The container attaching portion 361 is configured to hold the plurality of tablet cassettes 16 and tablet feeders 17. The tablet supplying device 19 is located below the container attaching portion 361. Tablets having fallen from the tablet feeder 17 are collected into the tablet supplying device 19. Moreover, the tablet cassette shelf 350 of this embodiment is capable of holding different types (two types) of tablet cassettes 16.

A part of the tablet supplying device 19 communicates with the tablet push-out passage 20 which is formed in such a manner as to extend up to the packaging portion 14. Further, a front end side of the tablet push-out passage 20 of the tablet supplying device 19 is coupled to the dispensing port 21, thereby forming a series of flow passages.

Tablets stored in the tablet cassette 16 received in the tablet cassette shelf 350 are dispensed to the tablet feeder 17. The tablets dispensed from the tablet feeder 17 fall downward to be led into the tablet supplying device 19 located below the tablet feeder 17. Then, after being carried to the tablet push-out passage 20 inside the tablet supplying device 19, the tablets are pushed out from the tablet push-out passage 20 to the dispensing port 21 and then are packaged and accommodated in a tray 24 at the packaging portion 14. Now, the tablet supplying device 19 is described in detail.

<Tablet Supplying Device>

Figure 30:
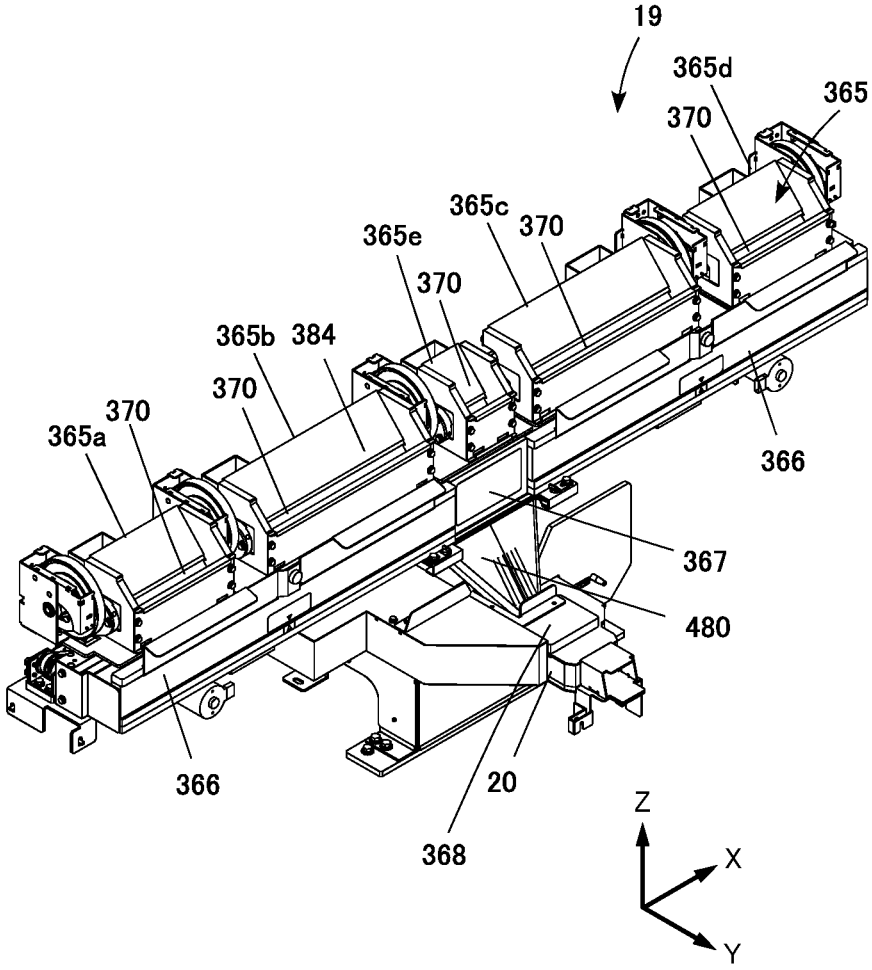
FIG. 30 is a perspective view for illustrating a configuration of a tablet supplying device included in the tablet accommodating portion of FIG. 29.

As illustrated in FIG. 30, the tablet supplying device 19 mainly includes tablet catching portions 365 (365*a*, 365*b*, 365*c*, 365*d*, and 365*e*) (leading portion), two right and left lateral conveyance portions 366 (primary conveyance portion), and a falling passage forming portion 367 (passage forming portion). The tablet catching portions 365 are located on an upper side. The lateral conveyance portions 366 and the falling passage forming portion 367 are located below the tablet catching portions 365. A tablet push-out portion 368 (secondary conveyance portion) is formed below the falling passage forming portion 367. Thus, the tablet supplying device 19 has a three-stage stacking structure in which the tablet catching portions 365 (leading portion) having a laterally extending shape, the lateral conveyance portions 366 (primary conveyance portion) having a laterally extending shape similar to that of the tablet catching portions 365, and the tablet push-out portion 368 (secondary conveyance portion) having a vertically extending shape are vertically stacked.

The tablet catching portions 365 (365*a*, 365*b*, 365*c*, 365*d*, and 365*e*) located in an uppermost stage are portions configured to catch tablets which fall from above, and function as a leading portion for tablets in the tablet supplying device 19 as a whole. The tablet catching portions 365 has the structure including end-side tablet catching portions 365*a* and 365*d*, intermediate tablet catching portions 365*b* and 365*c*, and a center tablet catching portion 365*e*. The end-side tablet catching portions 365*a* and 365*d* are located on both end sides in an X direction (width direction of the tablet cassette shelf 350). The intermediate tablet catching portions 365*b* and 365*c* are adjacent to the end-side tablet catching portions 365*a* and 365*d*, respectively, and are located on an intermediate side in the X direction. The center tablet catching portion 365*e* is provided between the intermediate tablet catching portions 365*b* and 365*c*. The end-side tablet catching portions 365*a* and 365*d*, the intermediate tablet catching portions 365*b* and 365*c*, and the center tablet catching portion 365*e* are arranged in such a manner as to be continuous with each other in the X direction.

As illustrated in FIG. 30, the end-side tablet catching portions 365*a* and 365*d*, the intermediate tablet catching portions 365*b* and 365*c*, and the center tablet catching portion 365*e* each have a substantially rectangular parallelepiped shape extending in a right-and-left direction and have a tablet leading space 370 formed therein. The tablet leading space 370 functions as an accommodation space for tablets. As illustrated in FIG. 30, the intermediate tablet catching portions 365*b* and 365*c* each have the tablet leading space 370 that is the largest in size in the right-and-left direction. The size of the tablet leading space 370 of each of the end-side tablet catching portions 365*a* and 365*d* in the right-and-left direction is slightly smaller than that of the tablet leading space 370 of each of the intermediate tablet catching portions 365*b* and 365*c*, and the size of the leading space 370 of the center tablet catching portion 365*e* is the smallest.

The tablet leading space 370 of each of the tablet catching portions 365 (365*a*, 365*b*, 365*c*, 365*d*, and 365*e*) is a space which is communicable with an outside in the up-and-down direction, and has an opening surface serving as a leading port for tablets on an upper side thereof.

The end-side tablet catching portions 365*a* and 365*d* stand by in a tablet catching posture to catch tablets which fall from the tablet cassette 16 (see, for example, FIG. 29) via the tablet feeder 17. Then, the end-side tablet catching portions 365*a* and 365*d* shift to a tablet discharging posture under a state in which the tablets are arranged inside the respective tablet leading space 370, thereby supplying the tablets to a lower side (lateral conveyance portion 366 and falling passage forming portion 367, see FIG. 30). In other words, after temporarily storing the tablets inside the respective tablet leading spaces 370, the end-side tablet catching portions 365*a* and 365*d* supply the tablets to the lower side.

The intermediate tablet catching portions 365*b* and 365*c* and the center tablet catching portion 365*e* each have the same basic structure as the end-side tablet catching portions 365*a* and 365*d*, and hence detailed description thereof is omitted.

Tablets led into the tablet leading space 370 of each of the end-side tablet catching portions 365*a* and 365*d* and the intermediate tablet catching portions 365*b* and 365*c* among the tablet catching portions 365 are supplied to one of the lateral conveyance portions 366 located in an intermediate stage. Then, the tablets are pushed to move in a lateral direction and supplied to the falling passage forming portion 367. Finally, the tablets are led into the tablet push-out portion 368 (secondary conveyance portion) located in a lowermost stage.

Tablets led into the tablet leading space 370 of the center tablet catching portion 365*e* directly fall into the falling passage forming portion 367 without passing through the lateral conveyance portions 366 located in the intermediate stage and are led into the tablet push-out portion 368 (secondary conveyance portion) located in the lowermost stage.

Now, the lateral conveyance portion 366 located in the intermediate stage is described. As illustrated in FIG. 30, two lateral conveyance portions 366, which are symmetrical to each other in the X direction and have the same structure, are arranged in the intermediate stage in such a manner as to be lined up in the X direction.

Figure 31:
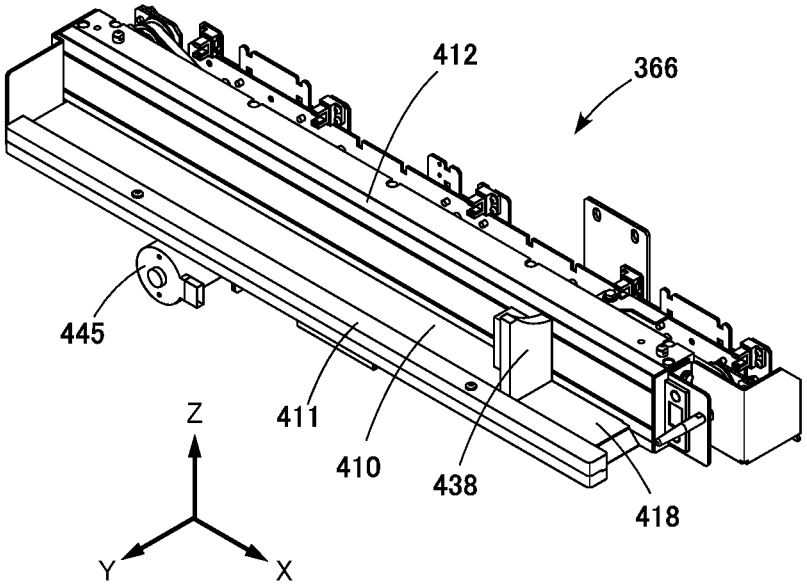
FIG. 31 is a perspective view for illustrating a configuration of a lateral conveyance portion included in the tablet accommodating portion of FIG. 29.

As illustrated in FIG. 31, the lateral conveyance portion 366 includes a tablet catching groove portion 410 (catching portion), a wheel traveling portion 411, and a guide arranging portion 412. Specifically, the wheel traveling portion 411, the tablet catching groove portion 410, and the guide arranging portion 412 are arranged in the stated order from the near side in the Y direction in FIG. 31 and are formed integrally with one another. Further, a motor 445 is arranged below these components.

The tablet catching groove portion 410 is a portion into which the tablets which fall from the end-side tablet catching portions 365*a* and 365*d* and the intermediate tablet catching portions 365*b* and 365*c* among the tablet catching portions 365 described above are led. The tablet catching groove portion 410 is a groove-like portion recessing downward and has a substantially rectangular sectional shape defining a space extending in the right-and-left direction.

At an end portion of the tablet catching groove portion 410 located on one end side in a longitudinal direction (end portion in the X direction of FIG. 31), there is formed a tablet discharging port portion 418, which is an opening portion allowing an inside and an outside to communicate with each other. The end portion at which the tablet discharging port portion 418 is formed is an end portion located on the center side of the tablet supplying device 19 in the X direction (see, for example, FIG. 30). This end portion is continuous with the falling passage forming portion 367.

The two lateral conveyance portions 366 are symmetrical to each other in the X direction, and the tablet discharge port portions 418 of the two lateral conveyance portions 366 are arranged adjacent to each other. The two tablet discharging port portions 418 are arranged across the falling passage forming portion 367.

In the tablet catching groove portion 410, as illustrated in FIG. 31, a tablet push-out piece portion 438 is arranged. The tablet push-out piece portion 438 is arranged inside the tablet catching groove portion 410 and is configured to move in the X direction along the tablet catching groove portion 410. In FIG. 31, illustration is given of a state in which the tablet push-out piece portion 438 has moved to the vicinity of the tablet discharging port portion 418. At the time of catching the falling tablets, the tablet push-out piece portion 438 is located at a waiting position that is most apart from the center side in the X direction. Then, the tablet push-out piece portion 438 pushes out the tablets having been led into the tablet catching groove portion 410 toward the falling passage forming portion 367.

With such a configuration, tablets can be pushed out in the X direction by moving the tablet push-out piece portion 438 inside the tablet catching groove portion 410.

That is, the tablet push-out piece portion 438 is allowed to wait on one end side of the tablet catching groove portion 410 in the longitudinal direction, which is also the end portion side located at the position apart from the tablet discharging port portion 418. Then, tablets are caused to fall from the tablet catching portions 365 described above so that the tablets are supplied to the inner space of the tablet catching groove portion 410. After that, the tablet push-out piece portion 438 moves in the X direction along the tablet catching groove portion 410 to the vicinity of the tablet discharging port portion 418, thereby pushing out the tablets to the outside from the tablet discharging port portion 418.

Figure 32:
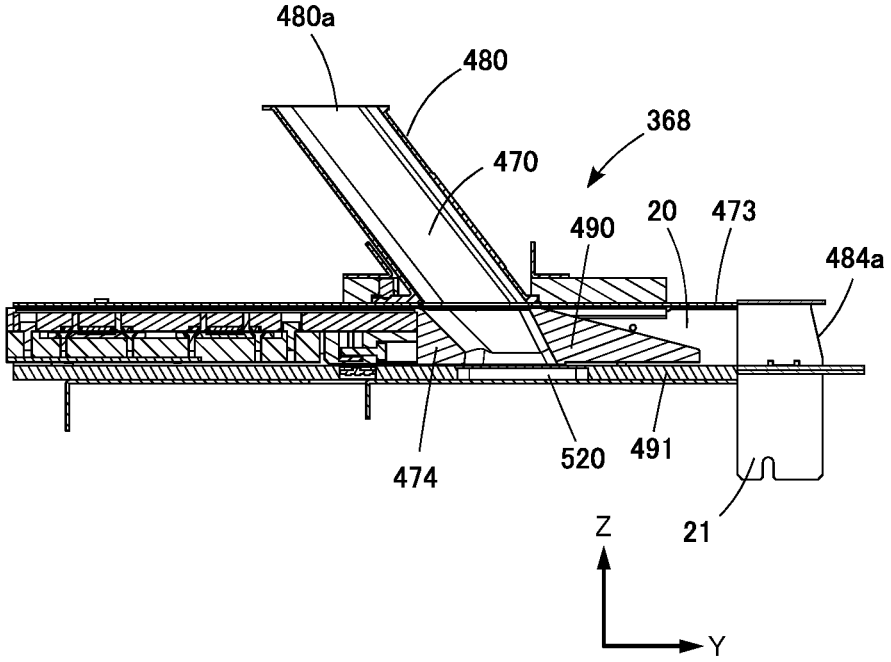
FIG. 32 is a sectional view for illustrating a configuration of a tablet push-out portion of the tablet supplying device of FIG. 30.

As illustrated in FIG. 32, the tablet push-out portion 368 located in the lowermost stage includes a shooter 480 and a push-out passage forming portion 473. In the push-out passage forming portion 473, there is provided a tablet conveying device 474 configured to convey supplied tablets in the Y direction.

As illustrated in FIG. 30 and FIG. 32, the shooter 480 is attached on an upper side of the push-out passage forming portion 473 and has a first tablet-supplying hole 470 passing through the inside of the shooter 480 in the up-and-down direction. An opening portion located on an upper side of the first tablet-supplying hole 470 serves as a leading port (tablet leading port 480*a*) for leading tablets at the time of supplying the tablets to the tablet push-out portion 368.

The push-out passage forming portion 473 has the tablet conveying device 474 incorporated therein. As illustrated in FIG. 32, the tablet conveying device 474 has the structure including an upper pad portion 490 and a conveyor portion 491 and is caused to linearly move in the tablet push-out passage 20 by a driving device (not shown).

As illustrated in FIG. 32, the tablet conveying device 474 has, at a part thereof, an accommodation hole 520 passing from a top surface to a bottom surface and is configured to convey tablets.

<Tray>

In the tablet packaging device 11, tablets having been dispensed through the dispensing port 21 via the tablet supplying device 19 are finally accommodated in the tray 24 illustrated in FIG. 5 and FIG. 6. Next, the tray 24 is described.

Figure 5A:
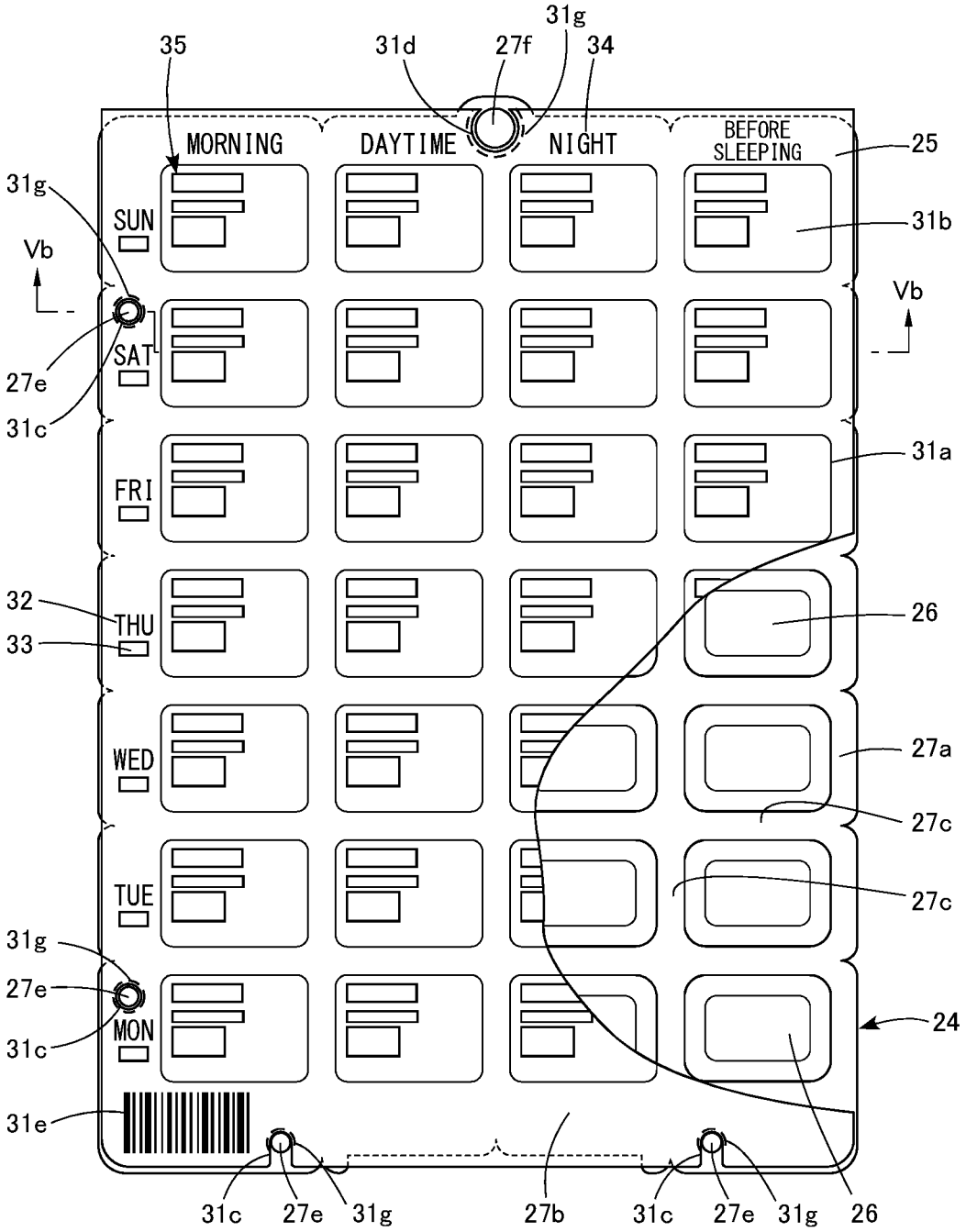
FIG. 5A is a partially cutaway plan view for illustrating a state in which a lid is affixed to a tray.
Figure 5B:
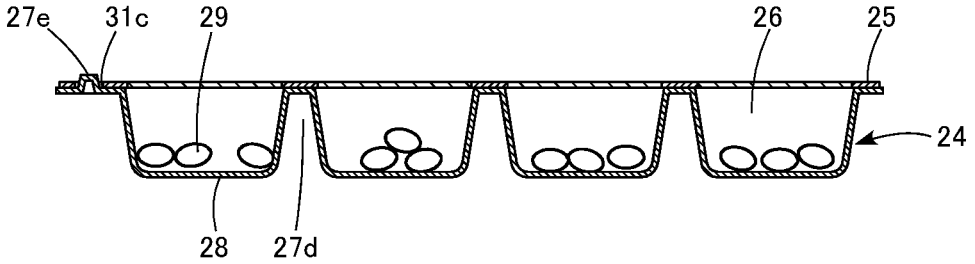
FIG. 5B is a sectional view taken along the line Vb-Vb of FIG. 5A.
Figure 6A:
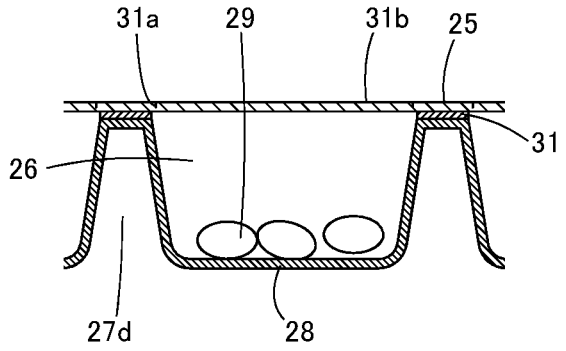
FIG. 6A is a partial enlarged sectional view of FIG. 5B.

In FIG. 5A and FIG. 5B, illustration is given of a state in which a lid sheet 25 is affixed to an open surface of the tray 24. The tray 24 includes accommodation recess portions 26, which are divided in a grid pattern of seven rows by four columns. Opposing side walls 27*a* located on long sides of the tray 24, opposing side walls 27*b* located on short sides of the tray 24, and division walls 27*c* dividing an area defined by the side walls 27*a* and 27*b* into seven rows by four columns are formed with the same height and cross one another in a lattice pattern, thereby forming uniform rectangular accommodation recess portions 26.

The accommodation recess portions 26 of the tray 24 are arranged in the grid pattern of seven rows by four columns as illustrated in FIG. 5. Besides, for example, the accommodation recess portions 26 may be arranged in a pattern of seven rows by five columns. Details regarding how to handle the tray 24 having a different size in the tablet packaging device 11 are described later.

Thickness portions of the side walls 27*a* and 27*b* and the division walls 27*c* on the bottom surface side have grooves 27*d* so as to have the thickness that maintains a certain strength. The bottom surface of the accommodation recess portion 26 has a thickness thinner than that of the thickness portions and is formed so as to have a large number of irregularly-shaped wrinkles 28. The bottom surface is thin and has a large number of wrinkles 28, thereby being capable of exerting a buffering function for tablets 29 accommodated therein. Moreover, when the bottom surface is pushed upward, the bottom surface is deformed into a mountain shape (see the two-dot chain line of FIG. 6C), thereby allowing the tablets 29 provided therein to be easily taken out.

The lid sheet 25 described above is a sheet made of paper or the like having a size matching with that of an entire surface of the tray 24 on the open side, and is affixed at the portions of the side walls 27*a* on the long sides, the side walls 27*b* on the short sides, and the division walls 27*c* described above with use of an adhesive 31 (see FIG. 6A). The lid sheet 25 has break/removal portions 31*b* each surrounded by a break line 31*a*. The break line 31*a* is a half-cut line or a perforated line forming a rectangle that has a size matching with that of the accommodation recess portion 26 (see FIG. 6A). The accommodation recess portion 26 may have a pinch part for convenience in opening the break/removal portion 31*b*.

Moreover, the lid sheet 25 has projecting-portion insertion holes 31*c*, which are formed at positions corresponding to projecting portions 27*e* formed on the side walls 27*a* and 27*b* of the tray 24. The projecting-portion insertion hole 31*c* may be formed into a through hole or may be formed into a cutout connecting to a peripheral edge of the lid sheet 25. The projecting portion 27*e* and the projecting-portion insertion hole 31*c* are fitted to each other, thereby being capable of preventing misalignment of the lid sheet and erroneous combination with types of the tray 24. When the adhesive 31 is provided to a part around the projecting-portion insertion hole 31*c*, it is difficult to set the projecting portion 27*e* and the lid sheet 25. Therefore, portions indicated by broken lines 31*g* are subjected to adhesive elimination of not providing the adhesive 31.

Further, at the side walls 27*b* of the tray 24 and at an upper edge of the lid sheet 25, there are formed hook insertion holes 27*f* and 31*d* passing therethrough at corresponding positions, thereby allowing a tray having tablets packaged therein to be hooked. When the adhesive 31 is applied to a part around the hook insertion hole 31*d*, it is difficult to set the projecting portion 27*e* of tray 24 and the lid sheet 25. Therefore, a portion indicated by the broken line 31*g* is subjected to adhesive elimination of not providing the adhesive 31.

Figure 25:
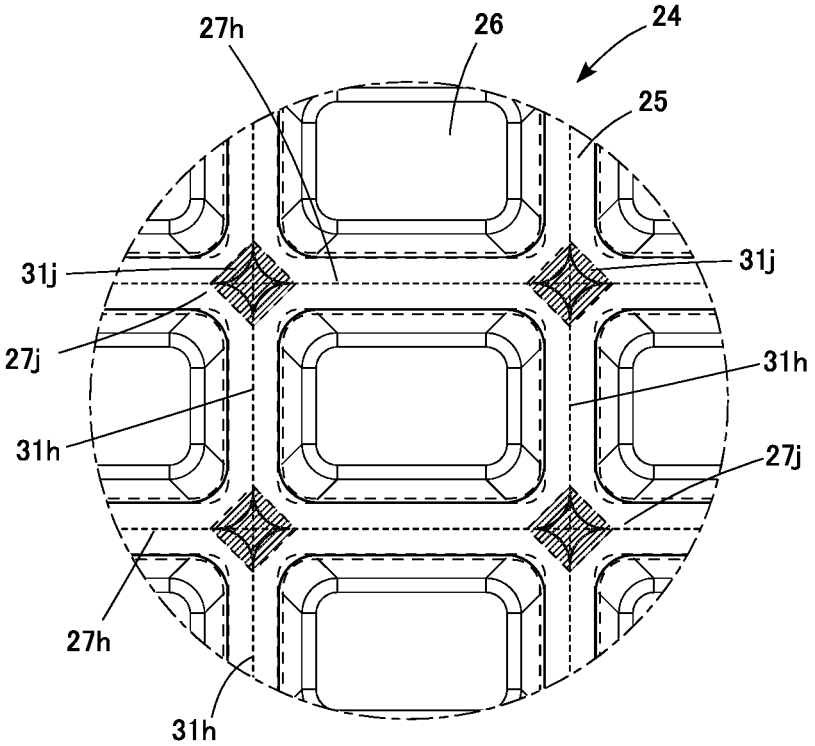
FIG. 25 is a partial enlarged plan view for illustrating a state in which a lid cover is affixed to the tray of FIG. 24.

As a modification example, the tray 24 and the lid sheet 25 may have division lines 27*h* and 31*h* formed in advance (see FIG. 25), which are perforation lines or the like surrounding the accommodation recess portions 26, so that the tray 24 and the lid sheet 25 can each be cut in such a manner as to correspond to the accommodation recess portions 26. In this configuration, as illustrated in FIG. 25, processed regions 31*j* located at peripheral edge portions 27*j* of the division lines 27*h* of the tray 24 are not subjected to application of the adhesive 31 for affixing the tray 24 and the lid sheet 25 to each other or are subjected to adhesive elimination, thereby allowing the lid sheet 25 to be easily peeled off from the divided tray.

In margin portions of the break/removal portions 31*b* corresponding to the seven rows in the up-and-down direction, there are provided seven-days indications 32 and date indications 33 corresponding to the seven-days indications 32. Moreover, in margin portions corresponding to the four columns in the right-and-left direction, there are provided administration timing indications 34 such as "MORNING" to "BEFORE SLEEPING" and other indications. Moreover, on each of the break/removal portions 31*b*, there are provided prescription indications 35 such as a name of a prescribee, an administration timing, a name of tablets, the amount of the tablets, and the like. In the case of the illustration of FIG. 5A, there are provided indications of receiving tablets of an amount corresponding to four times a day for one week. However, in some cases, depending on a prescription, a different amount of tablets are accommodated, such as tablets of an amount corresponding to three times a day for five days.

Moreover, barcodes 31*e* are provided to the tray 24 and the lid sheet 25. These barcodes contain information relating to serial numbers and the like of the tray 24 and the lid sheet 25 and are used when the tablet packaging device 11 checks a tray size, positions and the number of the accommodation recess portions 26, and the like. Moreover, the barcodes 31*e* may contain a prescription ID. The prescription ID is associated with the prescription information (including patient information) held by the tablet packaging device 11 and is used for preventing an error at the time of affixing the lid sheet 25 to the tray 24 based on the prescription information.

Figure 6B:
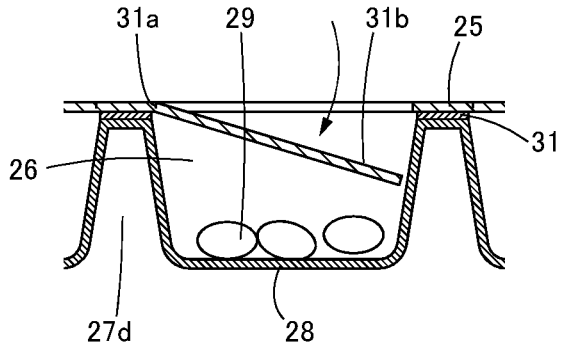
FIG. 6B is a partial enlarged sectional view for illustrating a state during use of FIG. 5B.
Figure 6C:
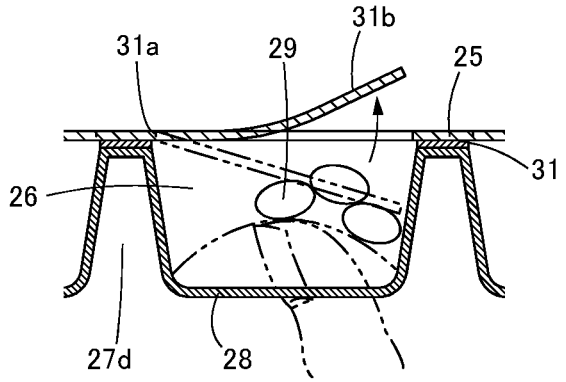
FIG. 6C is a partial enlarged sectional view for illustrating a state during use of FIG. 5B.

A prescribee presses a corresponding break/removal portion 31*b* with a fingertip to break the break/removal portion 31*b* along the break line 31*a* at each of four administration timings in a corresponding day (see FIG. 6B). The break/removal portion 31*b* is pressed into the accommodation recess portion 26. Thus, the break/removal portion 31*b* is taken out by pinching with fingertips, or is taken out together with the tablets 29 by pushing up a bottom surface of the accommodation recess portion 26 with a fingertip (see FIG. 6C).

Along with the action of taking out the tablets 29, the break/removal portion 31*b* is broken and removed, and the accommodation recess portion 26 is opened. Therefore, it can be easily checked whether or not administration has been forgotten by only distinguishing whether or not the accommodation recess portion 26 is opened.

<Packaging Portion>

Figure 3:
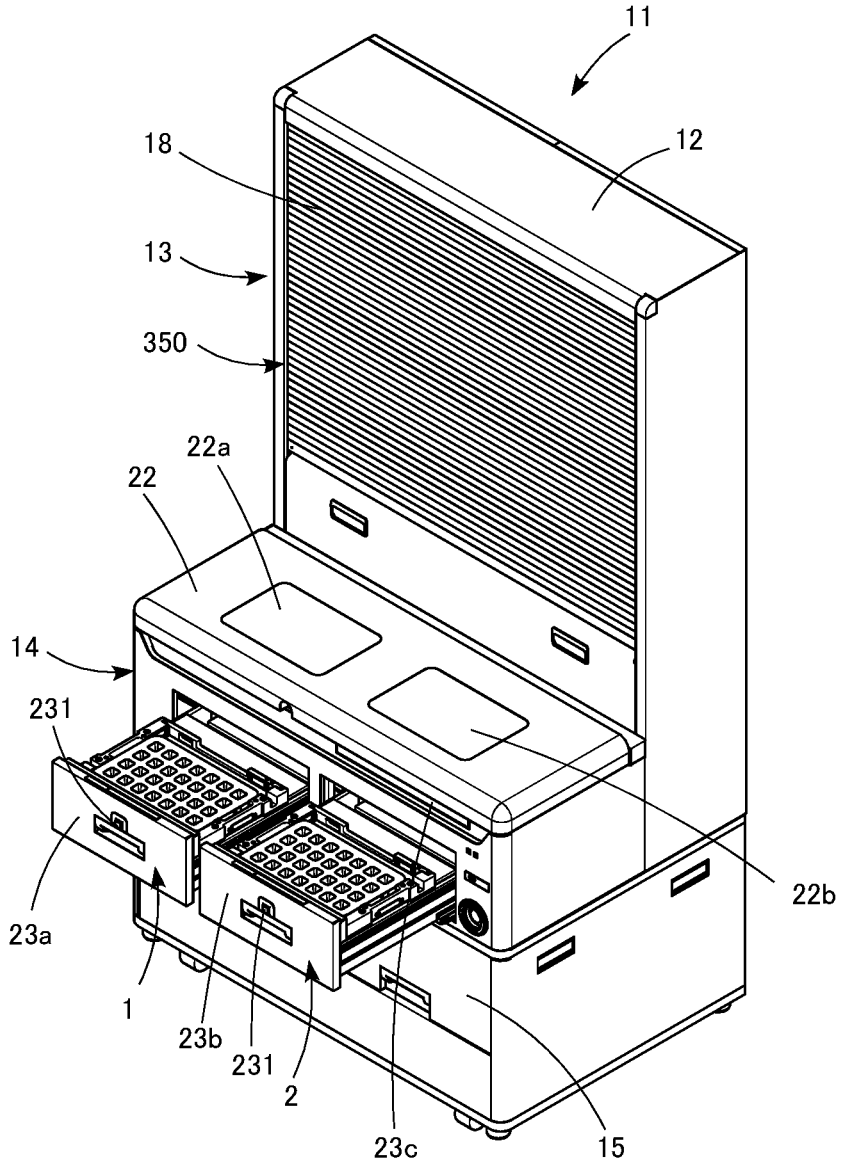
FIG. 3 is a perspective view for illustrating a state in which drawers of the tablet packaging device of FIG. 1 are opened.
Figure 4:
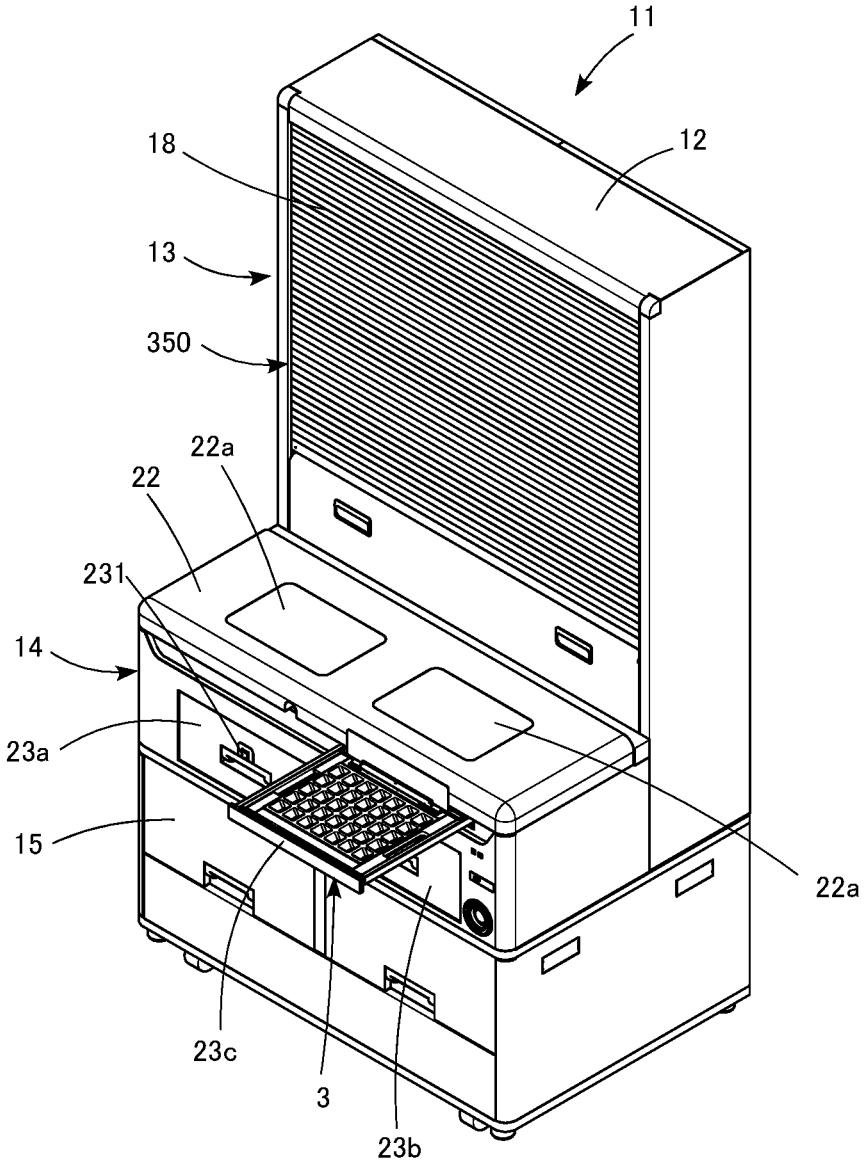
FIG. 4 is a perspective view for illustrating a state in which a drawer of a manual-distribution unit of the tablet packaging device of FIG. 1 is opened.
Figure 7:
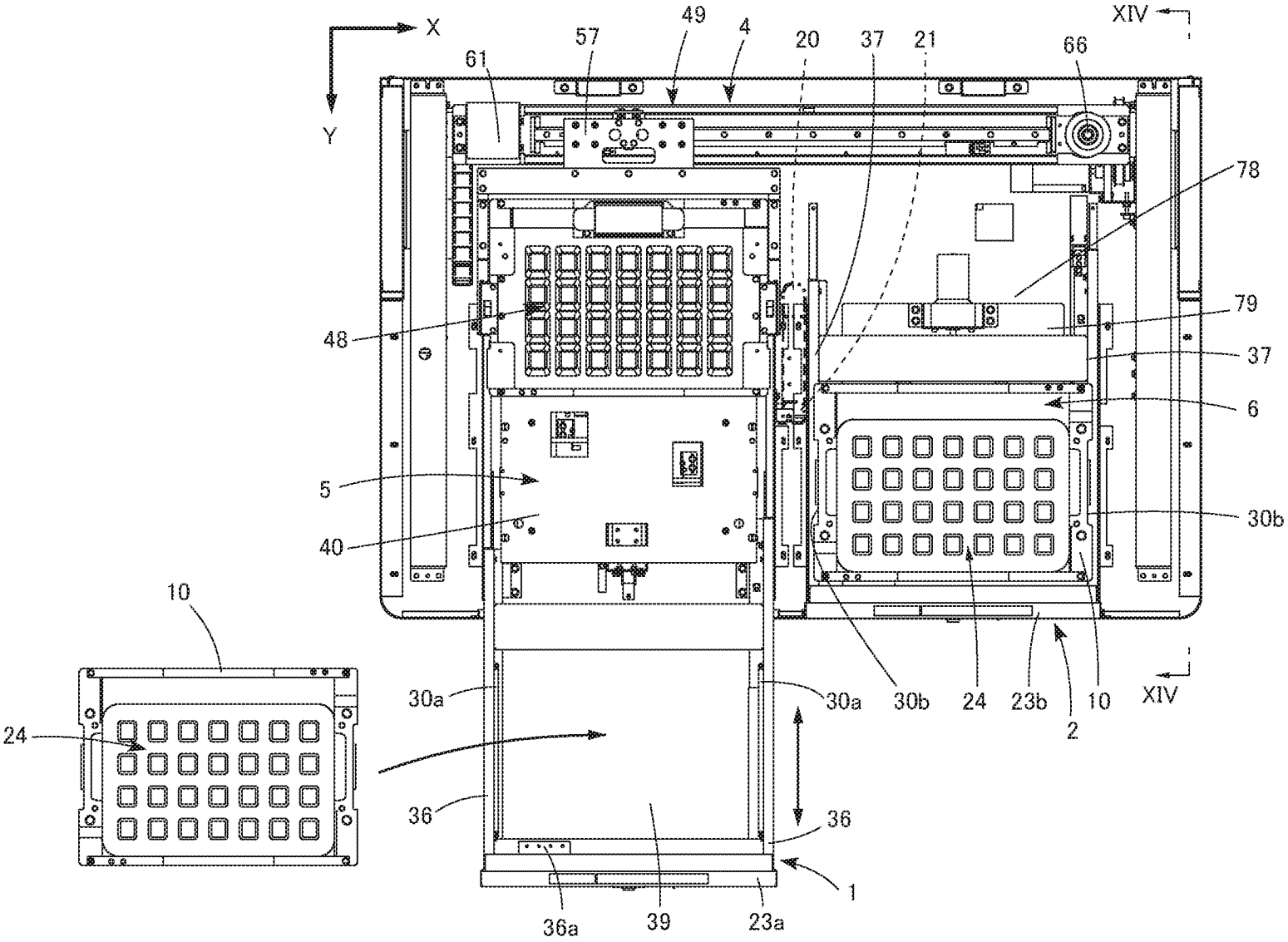
FIG. 7 is a sectional view taken along the line VII-VII in a state in which a cover lid of FIG. 2 is removed.

Next, the packaging portion 14 is described in detail. As illustrated in FIG. 3 and FIG. 4, the packaging portion 14 is covered with a cover lid 22 in a normal state, and an inside of the packaging portion 14 can be observed through inspection windows 22*a* and 22*b* provided at two positions. For example, a tray loading unit 1 received inside can be observed through the inspection window 22*a*, and a tray unloading unit 2 received inside can be observed through the inspection window 22*b*. When the cover lid 22 is removed, the packaging portion 14 is exposed to the outside. FIG. 7 is a transverse sectional view for illustrating a state in which the cover lid 22 is removed and an upper half part of the frame 12 is cut and removed.

As illustrated in FIG. 1, FIG. 3, and FIG. 4, in the packaging portion 14, there are provided the tray loading unit 1, the tray unloading unit 2, and a manual-distribution unit 3 as units which can be visually checked from the outside of the device.

As illustrated in FIG. 3, on the front side of the packaging portion 14, as component members of the tray loading unit 1 and the tray unloading unit 2, there are provided a loading drawer 23*a* and an unloading drawer 23*b*, which are each capable of being drawn forward to the outside of the packaging portion 14 and pushed into the packaging portion 14. In the case of the illustration of FIG. 3, the loading drawer 23*a* and the unloading drawer 23*b* are manually drawn out and pushed in (see double-head arrows of FIG. 2 and FIG. 7). However, the loading drawer 23*a* and the unloading drawer 23*b* may be automatically driven.

Moreover, as illustrated in FIG. 4, the manual-distribution unit 3 similarly includes a manual distribution drawer 23*c*, which is capable of being drawn forward to the outside of the packaging portion 14 and pushed into the packaging portion 14. A specific configuration of the manual-distribution unit 3 is described later.

Besides the tray loading unit 1, the tray unloading unit 2, and the manual-distribution unit 3, which are visually checked from the outside of the device, the packaging portion 14 includes, as illustrated in FIG. 7, a tray driving unit 4, a tray attaching unit 5, and a tray detaching unit 6 inside the device.

The tray loading unit 1 is a unit configured to load the tray 24 before prescription into the device. The tray loading unit 1 includes the loading drawer 23*a* as described above and a first placement table 30*a* configured to place the tray 24 inside the loading drawer 23*a*.

Figure 11A:
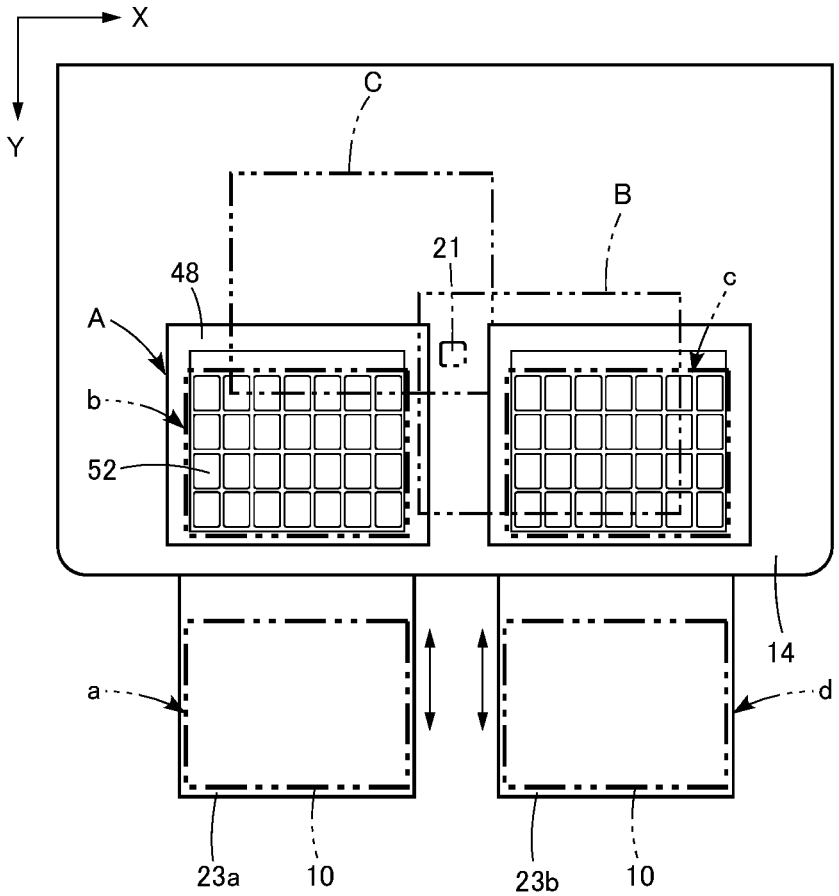
FIG. 11A is a schematic view for illustrating movement positions of the conveyance stage.

The loading drawer 23*a* of the tray loading unit 1 is set in such a manner that the first placement table 30*a* is located at a tray handling position outside the packaging portion 14 when the loading drawer 23*a* is drawn out and that the first placement table 30*a* is located at a waiting position inside the packaging portion 14 when the loading drawer 23*a* is pushed in (see FIG. 11A).

The first placement table 30*a* is provided on two first support members 36. The two first support members 36 are arranged parallel to each other in the X direction and are configured to arrange the tray 24 to be loaded to the device. The first placement table 30*a* supports both ends of the tray 24 in the X direction.

As illustrated in FIG. 7, the tray 24 is mounted to the first placement table 30*a* on the first support members 36 under a state in which the tray 24 is received by the adapter 10. The adapter 10 has a frame shape being opened on an upper side and allowing the tray 24 to be accommodated from the upper side. A configuration of the adapter 10 is described later.

The tray 24 is accommodated in the adapter 10 by placing the tray 24 from an upper side of a frame main body 10*a* into the frame main body 10*a*.

Figure 10:
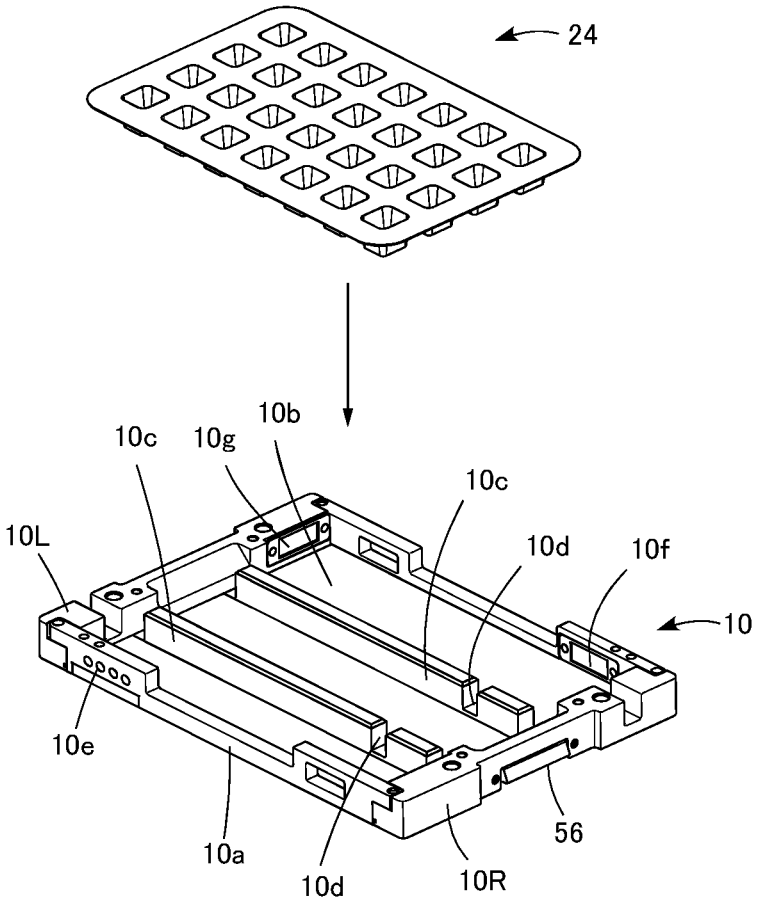
FIG. 10 is a perspective view for illustrating configurations of the adapter and the tray.

As illustrated in FIG. 10, the adapter 10 includes the frame main body 10*a*, a bottom plate 10*b*, and two tray support ribs 10*c*. The frame main body 10*a* has a rectangular frame shape. The bottom plate 10*b* forms a bottom surface of the frame main body. The tray support ribs 10*c* are arranged along an upper surface of the bottom plate 10*b*.

Moreover, an identification member 10*e* is provided on a front surface of the frame main body 10*a* of the adapter 10. The identification member 10*e* is used for checking the matching between prescription and the tray 24 in cooperation with a sensor, which stores information regarding, for example, types of adapters and is provided to the loading drawer 23*a*.

Moreover, the frame main body 10*a* of the adapter 10 includes two tray detection sensors 10*f* and 10*g*. The tray detection sensor 10*f* is configured to detect whether or not a tray is placed on the adapter 10 by emitting a detection light in a front-and-rear direction of the adapter 10. At an intermediate position of each of the tray support ribs 10*c*, there is formed a light passage groove 10*d* which is capable of allowing the detection light of the tray detection sensor 10*f* to pass therethrough. Moreover, at a position opposed to the tray detection sensor 10*f* of the adapter 10, there is provided a reflection member (not shown). When the tray 24 is not placed on the adapter 10, the detection light passes through the light passage grooves 10*d*, is reflected on the reflection member, and then enters the tray detection sensor 10*f*. When the tray is placed, the detection light is blocked by the tray 24 and thus does not return to the tray detection sensor 10*f*. The light passage grooves have a function to prevent positional displacement of the tray 24 by being engaged with a protruding portion (not shown) of a bottom surface of the tray 24.

The adapter 10 described above includes a right side frame 10R and a left side frame 10L formed into the same shape. The number of components can be reduced by forming the right side frame 10R and the left side frame 10L into the same shape.

However, because the right side frame 10R and the left side frame 10L have the same shape, when the right side frame 10R and the left side frame 10L are set on the first placement table 30*a* under a state in which the right and left are reversed, it is difficult to determine the state in which the right side frame 10R and the left side frame 10L are reversely set. Therefore, a cutout or a recess portion is formed in one of the side frames so that the difference of the right and left can be distinguished. A sensor configured to detect the cutout or the recess portion is provided to the first placement table 30*a*, thereby being capable of determining whether or not the adapter 10 is correctly set based on an output from the sensor.

The tray detection sensor 10*g* emits light in the X direction. The tray detection sensor 10*g* is a sensor configured to detect a type of a tray placed on the adapter 10. Specifically, the adapter 10 is capable of placing a plurality of types of trays having different sizes in the Y direction. More specifically, the adapter 10 is capable of placing a tray having an arrangement of seven rows by four columns or a tray having an arrangement of seven rows by five columns. When a tray which is small in the Y direction is placed on the adapter 10, the detection light emitted from the tray detection sensor 10*g* is not blocked by the tray 24 and is reflected on a reflection member (not shown) to return to the tray detection sensor 10*g*. Meanwhile, when a tray which is large in the Y direction is placed on the adapter 10, the detection light emitted from the tray detection sensor 10*g* is blocked by the tray 24 and thus does not return to the tray detection sensor 10*g*.

As a result, based on combinations of detection results of the two tray detection sensors 10*f* and 10*g*, the presence or absence of a tray and the size of a tray placed on the adapter 10 can be detected. That is, the following determinations can be made. When both of the tray detection sensors 10*f* and 10*g* do not detect the detection light, a state in which a tray is not placed on the adapter 10 is determined. When both of the tray detection sensors 10*f* and 10*g* detect the detection light, a state in which a tray having a large size is placed on the adapter 10 is determined. When the tray detection sensor 10*f* detects the detection light, and the tray detection sensor 10*g* does not detect the detection light, a state in which a tray having a small size is placed on the adapter 10 is determined.

Moreover, ratchet members 56 are provided on outer side surfaces of the frame main body. The ratchet member 56 is a block-like member provided so as to be capable of advancing and retreating in the X direction relative to the side surface of the adapter 10, and includes a stage engagement ratchet 56*a* having an inclined surface on an outer side surface thereof in the X direction (see FIG. 21). The ratchet members 56 are urged in such a manner that the stage engagement ratchets 56*a* protrude toward outer sides of the adapter. The ratchet members 56 are used for engaging a conveyance stage 48, which is described later, and the adapter 10 with each other, and details are described later.

Figure 24A:
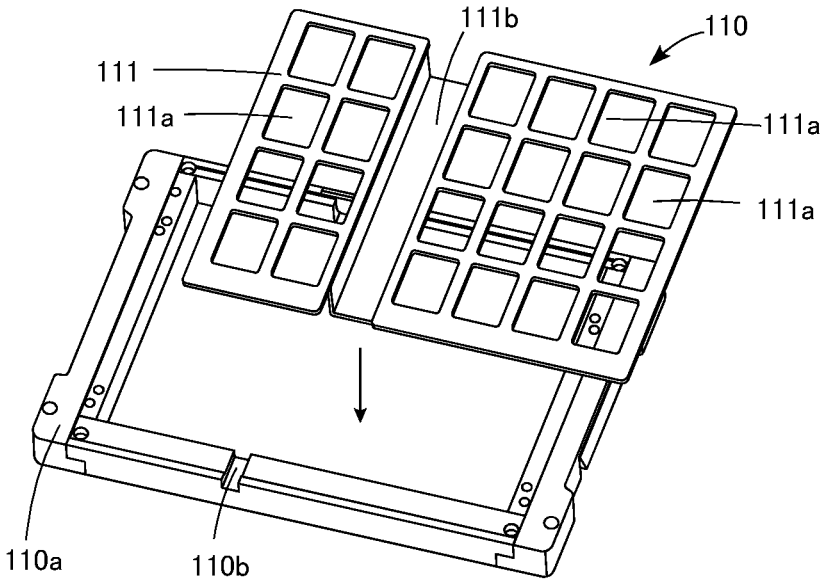
FIG. 24A is an exploded perspective view for illustrating a modification example of the adapter.

The adapter may have, for example, a configuration illustrated in FIG. 24 as a modification example thereof. As illustrated in FIG. 24, an adapter 110 of the modification example includes a pack setting plate 111 for the tray 24 to accommodate the tray 24 having flexibility without flexure. The adapter 110 illustrated in FIG. 24 includes a frame main body 110*a* and the pack setting plate 111. The frame main body 110*a* has a rectangular frame shape. The pack setting plate 111 is removably fitted to the frame main body 110*a*. The pack setting plate 111 is formed of a thin metal sheet, and has rectangular holes 111*a* corresponding to the accommodation recess portions 26 formed in the tray 24. Surroundings of the rectangular holes 111*a* have the same dimension as a width of grooves 27*d* (see FIG. 5B) of the tray 24, and division walls 27*c* are supported from below so that the tray 24 can be accommodated without flexure.

The frame main body 110*a* and the pack setting plate 111 are removably fitted to each other, and a plurality of types of pack setting plates 111 may be prepared in advance. That is, through use of a pack setting plate that is different in the number and positions of rectangular holes of the pack setting plate 111 in accordance with the number (other than 4×7) of the accommodation recess portions 26 of the tray 24, the same adapter can be used in accordance with a type of the tray 24.

Figure 24B:
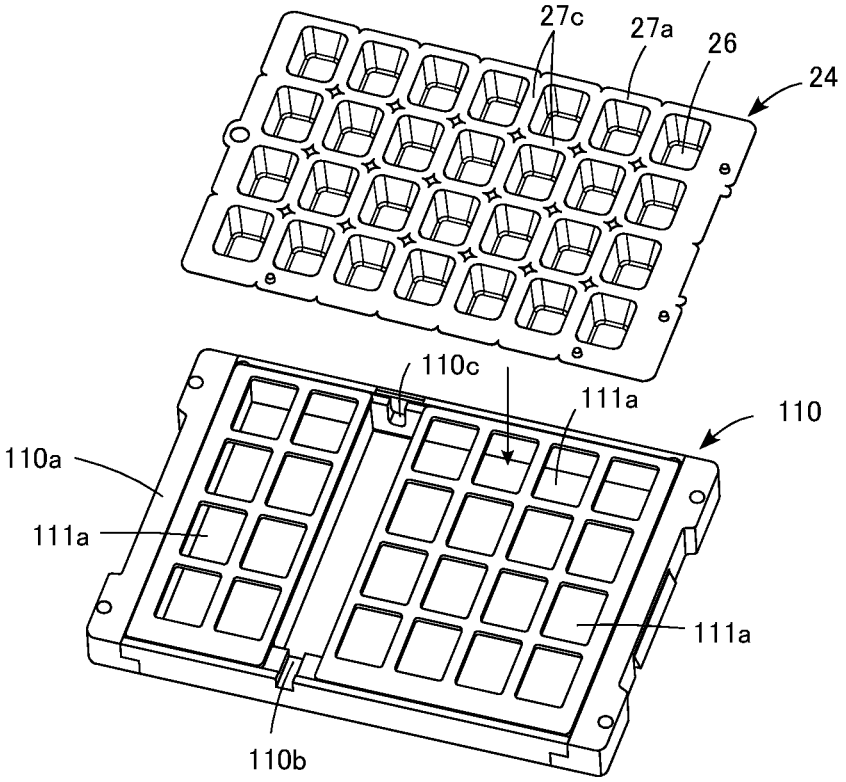
FIG. 24B is an illustration of a modification example of the tray, and is an exploded perspective view for illustrating a state in which the tray is received in the adapter.

Moreover, the pack setting plate 111 has a groove portion 111*b* at a portion corresponding to one column of the accommodation recess portions 26 of the tray 24. The groove portion 111*b* is used in sensing for detecting whether or not the tray 24 is accommodated in the adapter 110. As illustrated in FIG. 24B, the frame main body 110*a* on which the pack setting plate 111 is set has a cutout 110*b* at a position corresponding to the groove portion 111*b*, and a reflection mirror 110*c* is provided at a position opposed to the cutout 110*b*. The cutout 110*b* is formed at a position corresponding to a light emitter of a light sensor (not shown) when the adapter 110 is mounted to the tray loading unit 1. In a state in which the tray 24 is mounted to the adapter 110, an inspection light emitted from the light sensor is blocked by the tray 24. Thus, the inspection light does not return to the light sensor. Meanwhile, in a state in which the tray 24 is not mounted to the adapter 10, the inspection light emitted from the light sensor is reflected on the reflection mirror 110*c* and returns to the light sensor. Thus, the light sensor is capable of detecting the presence or absence of the tray 24 through detection of the reflected light.

The tray unloading unit 2 is a unit configured to mount the tray 24 having the tablets 29 packaged therein and remove the tray 24 from the tablet packaging device 11. The tray unloading unit 2 is provided to the packaging portion 14 in such an arrangement as to be adjacent to the tray loading unit 1 in the X direction. The tray unloading unit 2 includes the unloading drawer 23*b* as described above and a second placement table 30*b* configured to place the tray 24 inside the unloading drawer 23*b*.

The unloading drawer 23*b* of the tray unloading unit 2 is set in such a manner that the second placement table 30*b* is located at a tray handling position outside the packaging portion 14 when the unloading drawer 23*b* is drawn out and that the second placement table 30*b* is located at a waiting position inside the packaging portion 14 when the unloading drawer 23*b* is pushed in.

The second placement table 30*b* is provided on two second support members 37. The two second support members 37 are arranged parallel to each other in the X direction and are configured to arrange the tray 24 having tablets packaged therein. The second placement table 30*b* supports both ends of the adapter 10, which has the tray 24 received therein, in the X direction.

The manual-distribution unit 3 is a unit configured to allow manual packaging of tablets, which are not accommodated in the tablet accommodating portion 13, to the tray 24 having the tablets 29 packaged therein. The manual-distribution unit 3 includes the manual distribution drawer 23*c* as described above and a manual-distribution container 38.

The manual distribution drawer 23*c* of the manual-distribution unit 3 is set as follows. When the manual distribution drawer 23*c* is drawn out, the manual-distribution container 38 is set to be located at a manual-distribution operation position outside the packaging portion 14. When the manual distribution drawer 23*c* is pushed in, the manual-distribution container 38 is set to be located above a waiting position of the tray unloading unit 2. The draw-out and push-in operations of the manual distribution drawer 23*c* may be manually performed by an operator or may be automatically performed by a motor or the like.

The tray driving unit 4 includes a conveyance stage 48 configured to be horizontally movable in the X direction and the Y direction. The conveyance stage 48 supports the tray 24, which is loaded to the tray loading unit 1, together with the adapter 10 and drives the tray in such a manner that the dispensing port 21 configured to dispense the tablets 29 corresponds to each of the accommodation recess portions 26 of the tray 24. After packaging, the conveyance stage 48 conveys the tray 24 to a position above the tray unloading unit 2.

The tray attaching unit 5 is a unit configured to attach the adapter 10, which has received the tray 24 mounted to the tray loading unit 1, to the tray driving unit 4.

The tray detaching unit 6 is a unit configured to remove the adapter 10, which has received the tray 24 supported by the tray driving unit 4, from the tray driving unit 4 and mount the adapter 10 to the tray unloading unit 2.

Now, a configuration of each of the units described above is described in detail.

As described above, the first placement table 30*a* provided in the loading drawer 23*a* of the tray loading unit 1 is provided on the two first support members 36 and supports the both ends of the adapter 10 in the X direction, thereby mounting the adapter 10 to the tray loading unit 1. That is, other members of the tray loading unit 1 are not arranged in a space defined between the two first support members 36, and the space serves as a region for allowing the tray attaching unit 5, which is arranged on a lower side of the tray loading unit 1, to receive the adapter 10 (first raising/lowering device passage region 39).

Moreover, as illustrated in FIG. 7, a sensor 36*a* is provided to the loading drawer 23*a*. The sensor 36*a* is configured to distinguish identification information recorded in the identification member 10*e* provided to the adapter 10. The sensor 36*a* reads the information recorded in the identification member 10*e* provided to the adapter 10, associates the tray 24 set at the time of setting the tray 24 with a type and a prescription ID of the adapter 10, and send the associated information to a control device 200 (see FIG. 33) for the tablet packaging device 11. A configuration of the control device 200 is described later.

The prescription ID is the same as the prescription ID written in the barcodes 31*e* provided to the tray 24 and the lid sheet 25. Those barcodes are read through use of a barcode reader which is provided to the device main body or operates in conjunction with the device so that the prescription ID is used for comparison with the identification information of the tray.

When a comparison result exhibits matching between the prescription ID and the identification information of the tray, the comparison result may be notified to a user through use of notification means, which is described later, of the unloading drawer 23*b*. Alternatively, the barcodes may be read at the time of drawing out the unloading drawer 23*b* and affixing the lid sheet 25 to the tray 24, and a warning sound may be made when the combination is incorrect.

A first raising/lowering device 40 of the tray attaching unit 5 is provided below the waiting position of the loading drawer 23*a* of the tray loading unit 1.

Figure 8A:
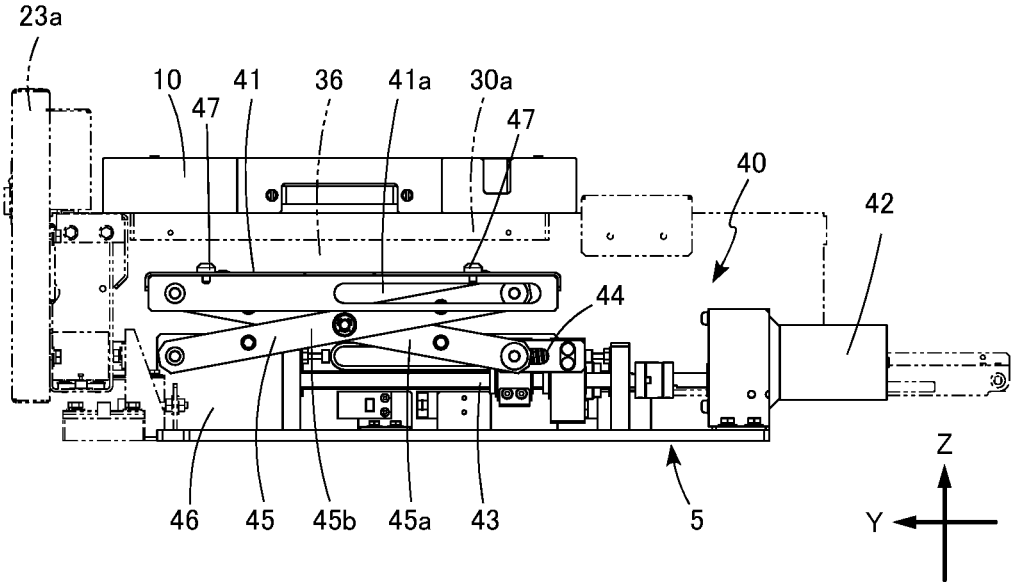
FIG. 8A is an explanatory view for illustrating a positional relationship between a first placement table in a waiting position and a first raising/lowering device, as seen from a side of a loading drawer.
Figure 8B:
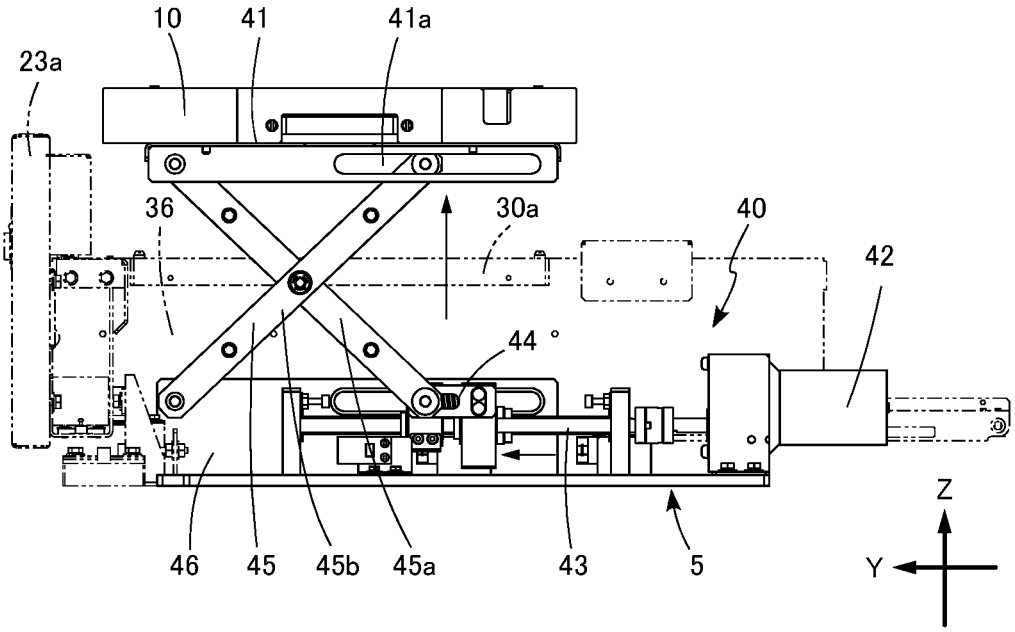
FIG. 8B is a side view for illustrating a state in which the first raising/lowering device is raised.

As illustrated in FIG. 8, the first raising/lowering device 40 includes an adapter placement table 41, an up-and-down movement motor 42, a slider 44 arranged on a rotation shaft 43 of the up-and-down movement motor 42, and a link member 45 configured to raise and lower the first raising/lowering device 40.

The slider 44 is a worm gear threadedly engaged with the threaded rotation shaft 43 and is configured to move in the Y-axis direction along the rotation shaft 43 with rotation of the up-and-down movement motor 42. The link member 45 is formed of two members intersecting each other. One member 45*a* of the link member 45 is turnably attached to a fixing bracket plate 46 and the adapter placement table 41 of the first raising/lowering device 40, and another member 45*b* of the link member 45 is attached at its lower end to the slider 44 and is slidably attached to a long hole 41*a* formed in the adapter placement table 41.

As illustrated in FIG. 8A, in a state in which the adapter placement table 41 of the first raising/lowering device 40 is lowered, a gap is defined between the adapter placement table 41 and the adapter 10 mounted to the first placement table 30*a*. With the presence of the gap, the adapter 10 having received the tray 24 can freely move along with the draw-out and push-in operations of the loading drawer 23*a* without being brought into contact with the first raising/lowering device 40. Accordingly, the adapter 10 can be drawn out and pushed in with respect to the packaging portion 14.

When the up-and-down movement motor 42 is driven to move the slider 44, the link member 45 stands up, thereby raising the adapter placement table 41. As described above, the space defined between the two first support members 36 of the loading drawer 23*a* serves as the first raising/lowering device passage region 39, thereby allowing the adapter placement table 41 to pass therethrough. As the adapter placement table 41 is raised, the adapter placement table 41 supports the adapter 10, which is mounted to the first placement table 30*a*, from below and lifts up the adapter 10 above the first placement table 30*a*.

On an upper surface of the adapter placement table 41, there are provided guide pines 47, which are fixed while being directed upward. The adapter 10 is fitted over the guide pins 47, thereby preventing displacement of the adapter 10 on the adapter placement table 41.

On an upper side of the adapter placement table 41, the conveyance stage 48 included in the tray driving unit 4 can be located. As illustrated in FIG. 7, the conveyance stage 48 is attached in a state of projecting forward in the Y direction from an XY robot 49 described later, and is capable of horizontally moving in the X direction and the Y direction in the packaging portion 14. The XY robot 49 is capable of moving the conveyance stage 48 to positions corresponding to the tray attaching unit 5, the tray detaching unit 6, and the dispensing port 21 (see FIG. 11A).

Figure 9:
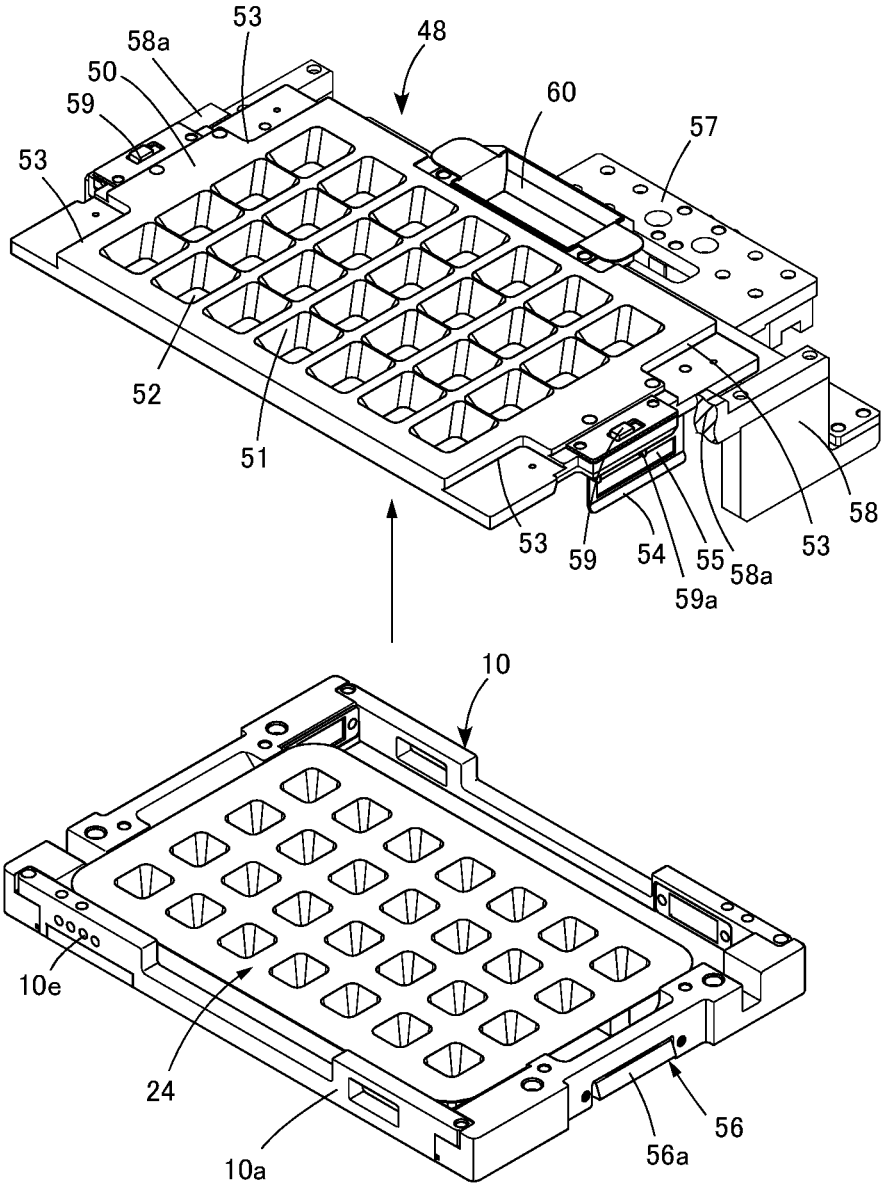
FIG. 9 is a perspective view for illustrating a configuration of a conveyance stage and the coupling structure with an adapter.

As illustrated in FIG. 9, the conveyance stage 48 includes division walls 51 provided in a grid pattern on an inner side of a frame 50 having a rectangular shape, thereby forming division chambers 52 having seven divisions in the X direction (right-and-left direction) and four divisions in the Y direction (front-and-rear direction). A type of the conveyance stage 48 can be changed in accordance with a shape of a tray to be used.

The division chambers 52 each have a pot-like shape, which is opened on upper and lower sides and has an upper portion reduced in size as extending downward. The size of a lower opening portion of the division chamber 52 substantially matches with the size of the accommodation recess portion 26 of the tray 24.

Corner portions of the frame 50 having the rectangular shape are operation step portions 53 for opening shutters (first shutter 73 and second shutter 74), which are described later, of the manual-distribution unit 3. A connection operation for the manual-distribution unit 3 and the conveyance stage 48 is described later in detail.

The conveyance stage 48 is capable of attaching the adapter 10 to a lower surface of the conveyance stage 48. Specifically, the conveyance stage 48 includes tray fixing members 54. The tray fixing members 54 extend downward from side surfaces of the conveyance stage 48 on both sides in the X direction and have lower ends extending outward. The tray fixing members 54 each have an engagement hole 55. The engagement holes 55 are engaged with the ratchet members 56 provided to the adapter 10 in such a manner as to be capable of advancing and retreating.

As illustrated in FIG. 9, the adapter 10 lifted up by the first raising/lowering device 40 is brought into contact with the tray fixing members 54 extending downward from the conveyance stage 48 so that the ratchet members 56 are pushed inward. Further, when the adapter 10 is raised, and the stage engagement ratchets 56*a* reach the engagement holes 55, the ratchet members 56 return outward so that the tray fixing members 54 and the ratchet members 56 are engaged, thereby fixing the adapter 10 on the lower side of the conveyance stage 48. Although illustration is not given, the conveyance stage 48 includes a coupling position sensor configured to detect that the conveyance stage 48 and the adapter 10 are fixed to each other. The control device 200 detects a coupling state of the conveyance stage 48 and the adapter 10 based on an output from the coupling position sensor.

At this time, the upper surface of the adapter 10 and the lower surface of the conveyance stage 48 come close to each other to such an extent of being brought into contact with each other. As a result, the tray 24 is attached to the tray driving unit 4 in a state of being sandwiched between the lower surface of the conveyance stage 48 and the upper surface of the adapter 10. In view of this, a length of the tray fixing members 54 is set to such a dimension as to conform to a height dimension of the adapter 10. The dimension of the adapter 10 is suitably set depending on a type of the tray 24 to be received. That is, for example, when a depth of the accommodation recess portions 26 of the tray 24 are deep, the height dimension of the adapter 10 is large, and hence the conveyance stage 48 conforming to the adapter 10 is used.

With such a configuration of attaching the adapter 10 to the lower surface of the conveyance stage 48, a position of the upper surface of the conveyance stage 48 can be set to a constant height regardless of a type of the tray 24. Therefore, it is not required to perform height adjustment with respect to the manual-distribution container, which is described later, during the packaging operation.

The conveyance stage 48 is fixed in such a manner as to be supported from below by an attaching arm 58*a* of a stage attaching member 58 coupled to an X-direction slider 57 provided to the XY robot 49 (see FIG. 12, FIG. 13, and FIG. 14). Regarding the coupling of the conveyance stage 48 and the attaching arm 58*a*, engagement claws 59*a* are moved by attaching/detaching levers 59 provided to the conveyance stage 48 so that the conveyance stage 48 and the attaching arm 58*a* can be engaged and disengaged. As a result, the conveyance stage 48 is released from the X-direction slider 57 and can be taken out to the outside of the packaging portion 14. Thus, cleaning and the like can be performed on the conveyance stage 48.

The conveyance stage 48 includes the division chambers 52 corresponding to the accommodation recess portions 26 of the tray 24. The conveyance stage 48 of a type corresponding to a type (size) of the tray 24 is prepared. That is, in this embodiment, there are provided two types of division chambers 52 of the conveyance stage 48, including a type of seven rows by four columns and a type of seven rows by five columns. A sensor (not shown) configured to determine a type of the conveyance stage 48 having a different number of division chambers may be provided to the attaching arm 58*a*. Specifically, the conveyance stage 48 has a different dimension in the Y direction in accordance with the number of columns, and hence the conveyance stage 48 is arranged at a different position. As the sensor, for example, an optical sensor attached to the arrangement position of the conveyance stage can be used. Accordingly, the conveyance stage 48 having a different size can be detected.

As a specific example of the sensor, for example, similarly to the tray detection sensor 10*g*, a sensor configured to emit light in the X direction can be used. In this case, as one example, after a conveyance stage 48 which is small in the Y direction is attached to the attaching arm 58*a*, movement by a certain distance in the Y direction is performed for adjustment of an original position. During the movement, when the sensor emitting the light in the X direction does not detect the conveyance stage 48, it can be determined that, for example, the small conveyance stage 48 having the arrangement of seven rows by four columns is present.

The conveyance stage 48 can be replaced by a user in accordance with a type (size) of the tray 24. However, when the XY robot 49 operates under a state in which the conveyance stage 48 is not reliably set on the attaching arm 58*a*, the operation may cause trouble. Therefore, a sensor configured to detect, for example, inclination given at the time of replacing or setting the conveyance stage 48 may be separately provided.

A collection tray 60 which is long in the right-and-left direction is removably attached to a rear-end center portion of the stage attaching member 58 (see FIG. 9). With this collection tray 60, tablets and dust such as broken pieces of tablets which erroneously remain in the tablet push-out passage 20 and the dispensing port 21 facing the lower end of the shooter 480 are collected. The operation of collecting the dust can be performed at appropriate timings. As described later, it is preferred that the operation of collecting the dust be performed before starting the packaging process. The dust may erroneously fall into the shooter 480 and the like, for example, at the time of starting the device. Accordingly, distribution of tablets based on an incorrect prescription can be prevented by performing the collection operation at the time of starting the device.

Moreover, a magnet may be attached to the collection tray 60 so that the collection tray 60 is fixed to the rear end center of the stage attaching member 58 by a magnetic force of the magnet. Through use of the magnet, the collection tray 60 can easily be attached and detached.

FIG. 11A is a view for schematically illustrating a mode of movement of the loading drawer 23*a*, the unloading drawer 23*b*, and the conveyance stage 48 inside the packaging portion 14.

A position given at the time of drawing out the loading drawer 23*a* of the tray loading unit 1 is referred to as a tray handling position "a". A position of the adapter 10 on the first placement table 30*a* given at the time of pushing the loading drawer 23*a* of the tray loading unit 1 into the packaging portion 14 is referred to as a waiting position "b". Moreover, a position of the adapter 10 on the unloading drawer 23*b* of the tray unloading unit 2 is referred to as a waiting position "c". Moreover, a position given at the time of drawing out the unloading drawer 23*b* of the tray unloading unit 2 is referred to as a tray handling position "d".

A movement amount of the loading drawer 23*a* of the tray loading unit 1 in the front-and-rear direction (Y direction) is set so that the adapter 10 is located at the tray handling position "a" outside the packaging portion 14 when the loading drawer 23*a* is drawn out and that the adapter 10 is located at the waiting position "b" inside the packaging portion 14 when the loading drawer 23*a* is pushed in.

Further, a movement amount of the unloading drawer 23*b* of the tray unloading unit 2 in the front-and-rear direction (Y direction) is set so that the adapter 10 is located at the tray handling position "d" outside the packaging portion 14 when the unloading drawer 23*b* is drawn out and that the adapter 10 is located at the waiting position "c" inside the packaging portion 14 when the unloading drawer 23*b* is pushed in.

The tray loading unit 1 and the tray unloading unit 2, that is, the loading drawer 23*a* and the unloading drawer 23*b* perform a process of manually or automatically moving the first placement table 30*a* and the second placement table 30*b* between the tray handling positions "a" and "d" and the waiting positions "b" and "c", respectively, in accordance with timings of movement of the conveyance stage 48.

The XY robot 49 sets a position at which the conveyance stage 48 is present above the waiting position "b" of the loading drawer 23*a* of the tray loading unit 1 as illustrated in FIG. 11A as an original position, and supports the adapter 10 at this original position. This position is referred to as a discharging position A. The XY robot 49 moves the conveyance stage 48 in order, as illustrated in FIG. 11A, from the discharging position A at the original position to a receiving start position B of starting receiving the tablets 29 below the dispensing port 21 of the tablets 29 and a receiving end position C of completing receiving the tablets 29. Through the driving of the XY robot 49, the conveyance stage 48 moves below the dispensing port 21 of the tablet 29 as indicated by the arrows of FIG. 11B.

Figure 11B:
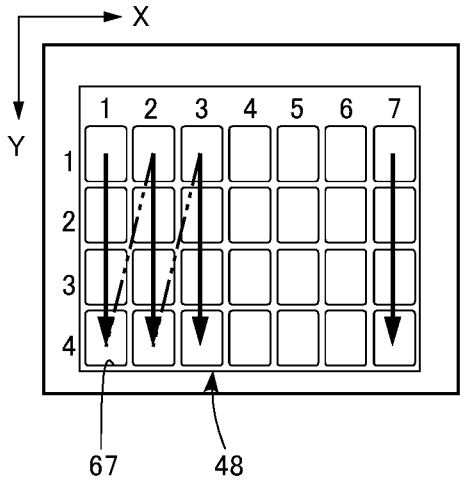
FIG. 11B is a plan view for schematically illustrating a configuration of the conveyance stage.

The movement order of the tray 24 may be the order reverse to that of FIG. 11B, thereby setting the receiving start position to the position indicated by C in FIG. 11A and setting the waiting position to the position indicated by B in FIG. 11A. As a result, a movement distance of the conveyance stage 48 is shortened, thereby being capable of shortening time required for distribution to one tray 24. The movement direction of the conveyance stage 48 may be selected from the two modes described above.

Moreover, after tablets are received at each of the division chambers, the XY robot 49 moves the conveyance stage 48 to a position above the waiting position "c" of the unloading drawer 23*b* of the tray unloading unit 2. The XY robot 49 performs the series of operations described above as a conveying process.

Next, a configuration of the XY robot 49 is described with reference to FIG. 12 to FIG. 14. The XY robot 49 (see FIG. 7) of the tray driving unit 4 includes an X-direction drive motor 61, a Y-direction drive motor 62, a Y-direction drive belts 63, and an X-direction drive belt 65. The Y-direction drive belt 63 is interlocked by interlocking shafts 64, which are installed at two positions on the right and left of the packaging portion 14 and extend in the X direction. The X-direction drive belt 65 is interlocked by an interlocking shaft 66 extending in the Z direction.

Figure 12:
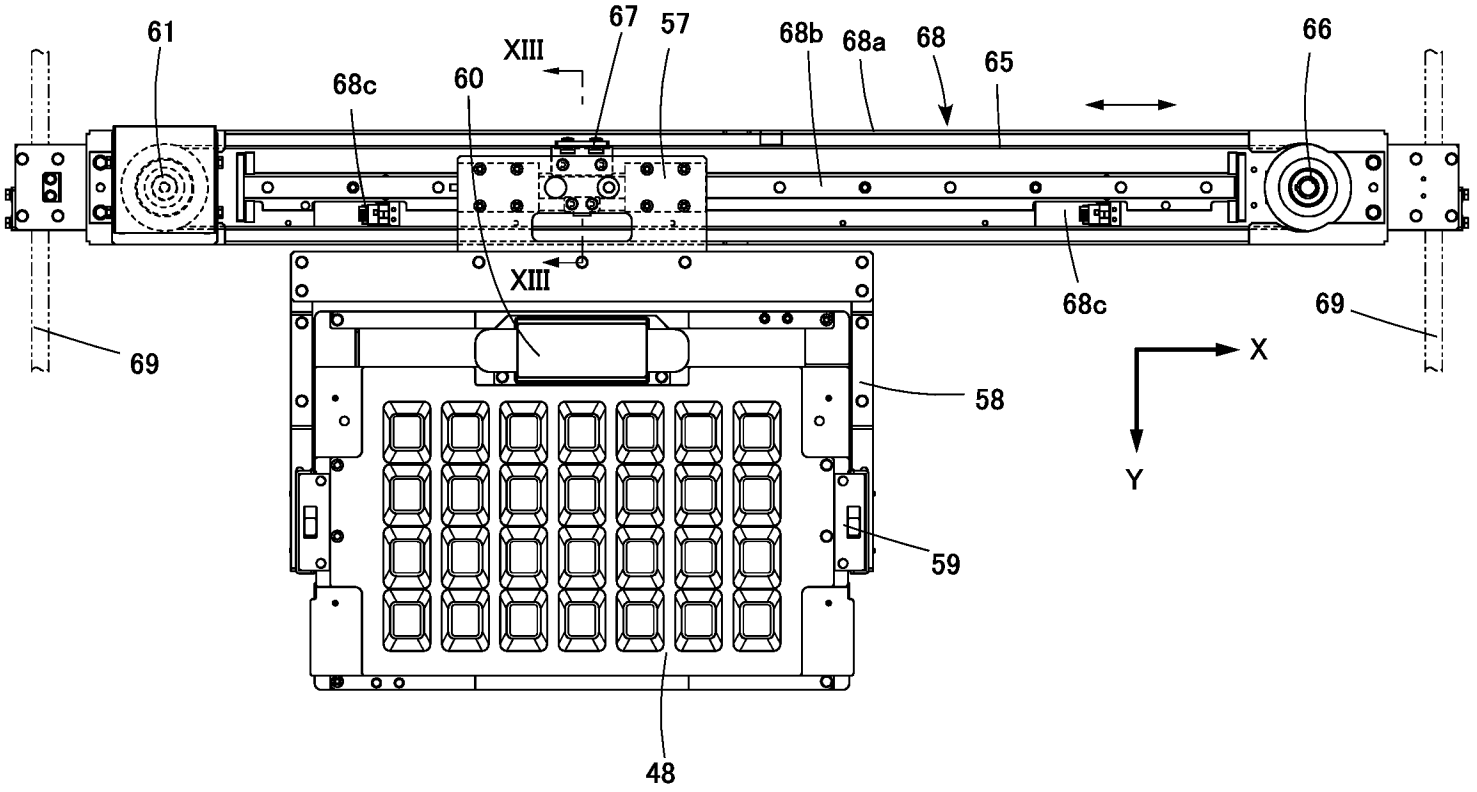
FIG. 12 is a sectional view taken along the line XII-XII of FIG. 10.
Figure 13:
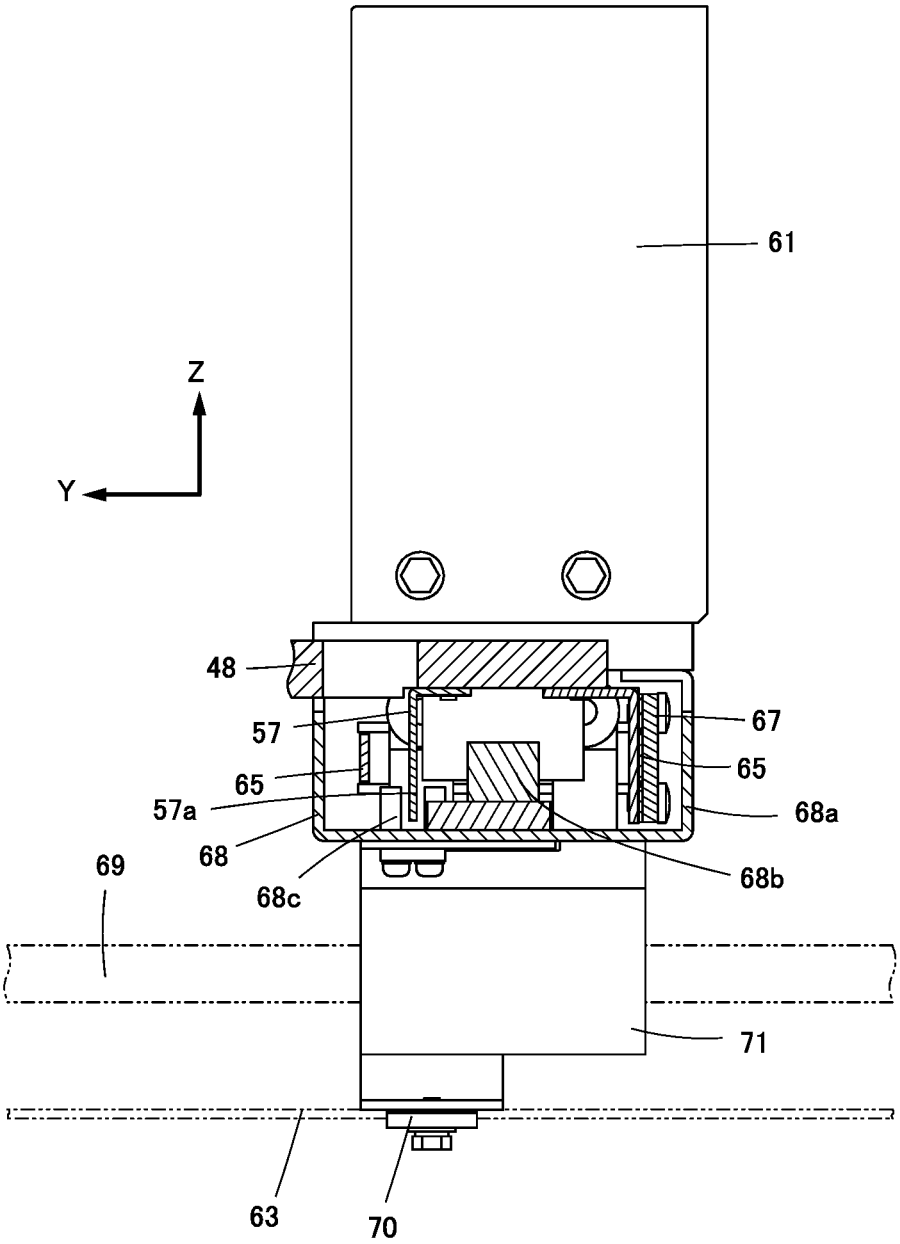
FIG. 13 is a sectional view taken along the line XIII-XIII of FIG. 12.

As illustrated in FIG. 12 and FIG. 13, a belt sandwiching member 67 is attached to the X-direction drive belt 65, and the X-direction slider 57 is provided to the belt sandwiching member 67. The X-direction slider 57 is slidably fitted to an X-direction guide 68. The X-direction guide 68 is connected to a Y-direction slider 71 having both ends connected to the Y-direction drive belt 63 as described later and can be driven as a whole in the Y direction.

As illustrated in FIG. 13, the X-direction slider 57 is slidable in the X direction along a guide rail 68*b* provided in a casing 68*a* of the X-direction guide 68. An upper part of the casing 68*a* of the X-direction guide 68 is opened. The X-direction slider 57 is engaged with an upper part of the guide rail 68*b* so that the X-direction slider 57 is slidable relative to the guide rail 68*b*.

X-direction position sensors 68*c* are provided near both ends of the casing 68*a* of the X-direction guide 68. As the X-direction position sensors 68*c*, for example, optical sensors may be used, which are configured to detect whether or not a sensor light is blocked with use of a detection piece 57*a* provided to the X-direction slider 57. The X-direction position sensors 68*c* detect a position of the X-direction slider 57 at the original position at which the conveyance stage 48 is present above the waiting position "b" of the loading drawer 23*a* of the tray loading unit 1 and at an X-direction position above the waiting position "c" of the unloading drawer 23*b* of the tray unloading unit 2.

Figure 14:
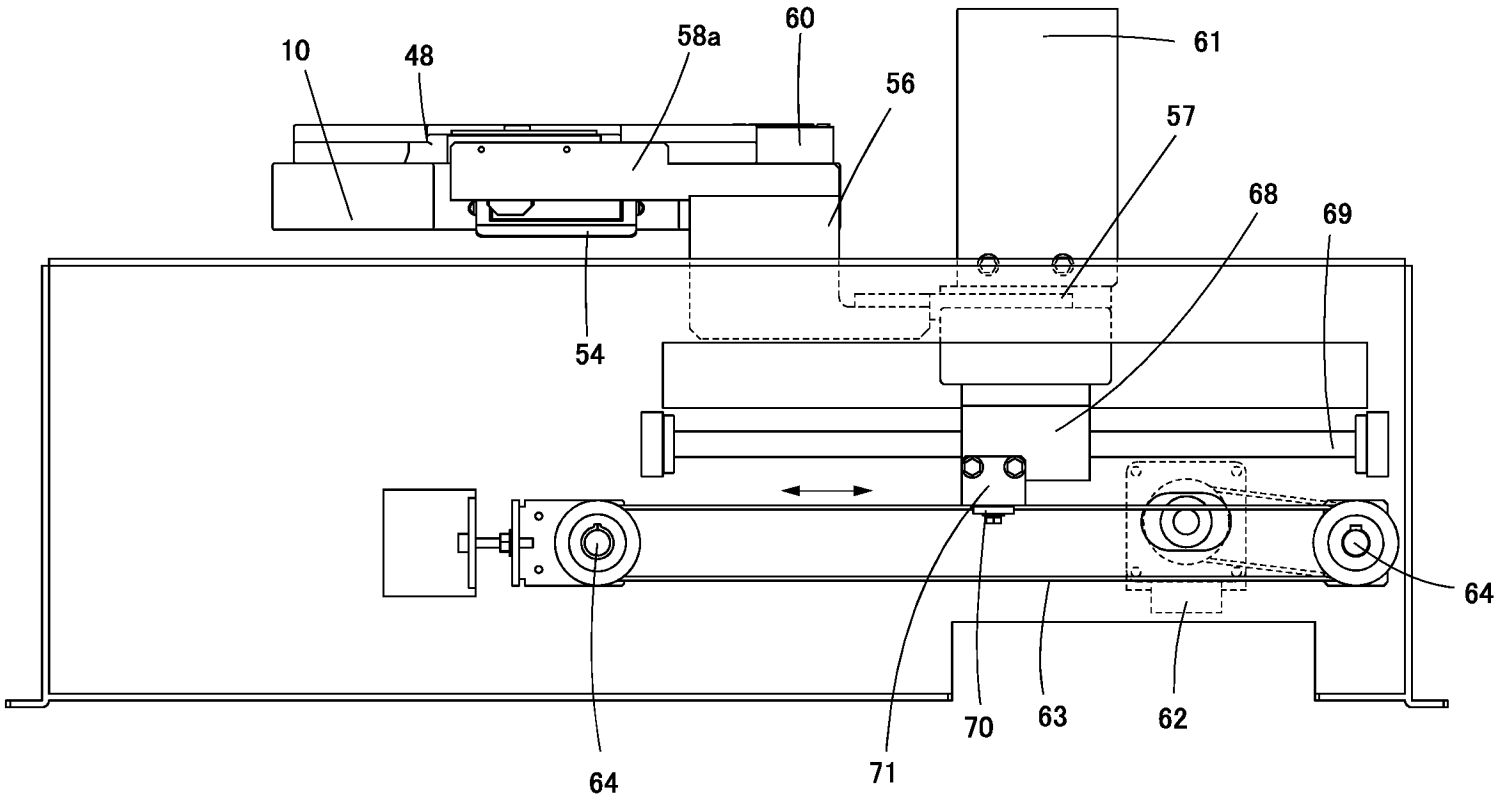
FIG. 14 is a partially omitted enlarged sectional view taken along the line XIV-XIV of FIG. 7.

As illustrated in FIG. 13 and FIG. 14, the Y-direction slider 71 provided at both ends of the X-direction guide 68 is slidably fitted to Y-direction guide bars 69 arranged along the Y-direction drive belt 63. The Y-direction slider 71 is connected to the Y-direction drive belt 63 by a belt sandwiching member 70 and is driven in the Y-direction integrally with the X-direction guide 68 along with driving of the Y-direction drive belt 63.

Figure 33:
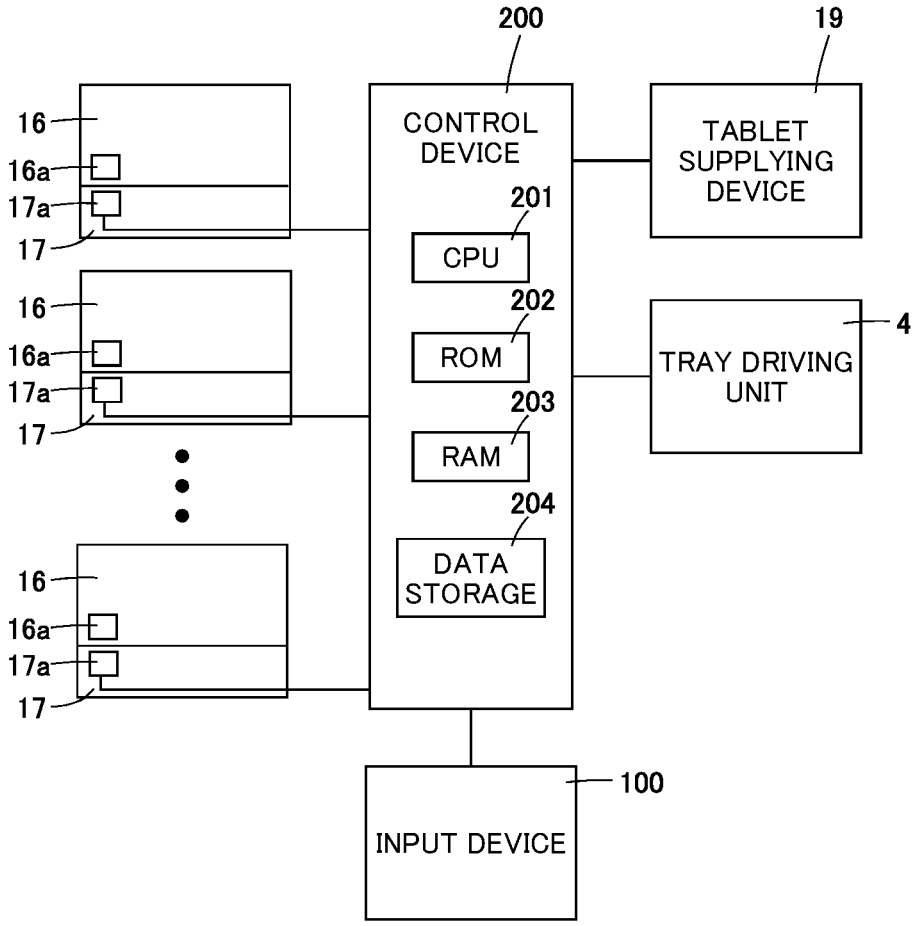
FIG. 33 is a block diagram for illustrating a control configuration for the tablet packaging device according to the embodiment of the present invention.

The Y-direction drive motor 62 and the X-direction drive motor 61 are each formed of a stepping motor and are configured to be driven based on drive signals in the Y direction and the X direction given by the control device 200 (see FIG. 33). When the Y-direction drive belt 63 is driven by the driving of the Y-direction drive motor 62, the conveyance stage 48 is moved in the Y direction by a predetermined distance. Moreover, when the X-direction drive belt 65 is driven by the driving of the X-direction drive motor 61, the conveyance stage 48 coupled to the X-direction drive belt 65 is driven in the X direction. In such a manner, the XY robot 49 performs the above-mentioned movement of the conveyance stage 48 in the X and Y directions.

The XY robot 49 is controlled so as to perform the conveying process for the adapter 10 coupled to the conveyance stage 48, which corresponds to one cycle described above for each tray 24, in a horizontal plane of the packaging portion 14. When the conveyance stage 48 is to be moved to a position above the waiting position "c" of the unloading drawer 23*b* of the tray unloading unit 2, in this embodiment, the XY robot 49 is controlled to perform positioning in the Y direction and thereafter perform positioning in the X direction. This is for the opening operation for shutters (first shutter 73 and second shutter 74) of the manual-distribution container 38 of the manual-distribution unit 3.

In the conveying process described above, when the conveyance stage 48 is moved and positioned in the X direction so that the conveyance stage 48 is positioned above the waiting position "c" of the unloading drawer 23*b* of the tray unloading unit 2, the shutters of the manual-distribution container 38 of the manual-distribution unit 3 are opened, and hence tablets contained in the manual-distribution container 38 are discharged to the accommodation recess portions 26 of the tray 24.

Figure 15:
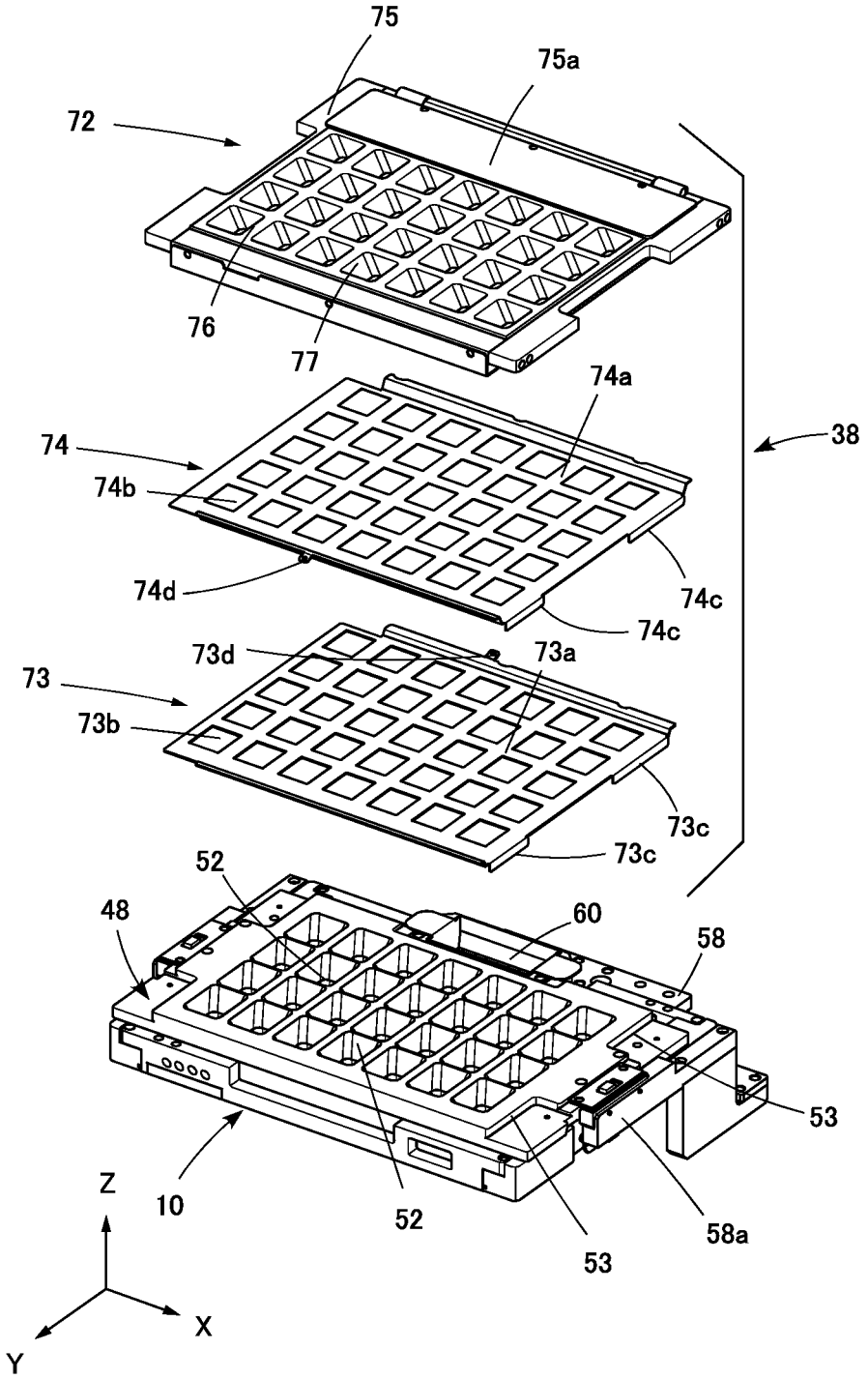
FIG. 15 is an exploded perspective view for illustrating a configuration of a manual-distribution container and a positional relationship with the conveyance stage.

As illustrated in FIG. 15, the manual-distribution container 38 of the manual-distribution unit 3 includes a container main body 72, the first shutter 73, and the second shutter 74.

As illustrated in FIG. 15, the container main body 72 includes division walls 76 provided in a grid pattern on an inner side of a frame 75 having a rectangular shape, thereby forming division chambers 77 having seven divisions in the X direction (right-and-left direction) and five divisions in the Y direction (front-and-rear direction). A type of the container main body 72 can be changed in accordance with a shape of the conveyance stage 48 to be used. Moreover, a lid plate 75*a* is provided to the frame 75. The lid plate 75*a* is configured to cover some division chambers 77 corresponding to the number of accommodation recess portions 26 of the tray 24 at divisions arranged in the Y direction on the far side of the X direction. The lid plate 75*a* is configured to be openable and closable. When the lid plate 75*a* is closed, the division chambers 77 divided into seven divisions in the X direction (right-and-left direction) by four divisions in the Y direction (front-and-rear direction) are exposed.

The container main body 72 may have a configuration without the lid plate 75*a*. In this case, the container main body, the second shutter 74, and the first shutter 73 are each divided into seven divisions in the X direction (right-and-left direction) by four divisions in the Y direction (front-and-rear direction).

The division chambers 77 is opened on upper and lower sides and has an upper portion reduced in size as extending downward. The size of a lower opening portion of the division chamber 77 substantially matches with the size of the division chamber 52 of the conveyance stage 48.

A shutter guide member 72*a* having a thin plate shape is fixed to a bottom surface of the container main body 72 with a certain gap in the up-and-down direction (see FIG. 16), and the second shutter 74 and the first shutter 73 are provided in the gap in the stated order from the upper side.

In the shutter guide member 72*a*, guide rollers 72*b*, which are arranged at constant intervals in the X direction on both front and rear sides in the Y direction and are supported on vertical shafts extending in the Z direction, are arranged at a plurality of positions along a moving direction of the first shutter 73 (second shutter 74). Moreover, the shutter guide member 72*a* is connected to a spring attaching piece 73*d* of the first shutter 73 and a spring attaching piece 74*d* of the second shutter 74 through intermediation of a spring 72*c*, thereby maintaining the shutters in a closed state.

The first shutter 73 is formed of one stainless-steel plate 73*a* having a length substantially equal to a length of the container main body 72 in the front-and-rear direction along the Y direction. The first shutter 73 has rectangular holes 73*b*, which are arranged in a lattice pattern and are formed in such a manner as to correspond to the division chambers 77 of the container main body 72.

As illustrated in FIG. 15, the spring attaching piece 73*d* is formed on a rear peripheral edge, and engagement pieces 73*c* which are bent downward are formed on a peripheral edge in the X direction.

The second shutter 74 has a configuration similar to the configuration of the first shutter 73, and is formed of one stainless-steel plate 74*a* having a length substantially equal to the length of the container main body 72 in the front-and-rear direction. The second shutter 74 has rectangular holes 74*b*, which are arranged in a lattice pattern and are formed in such a manner as to correspond to the division chambers 77 of the container main body 72.

As illustrated in FIG. 15, the spring attaching piece 74*d* is formed on a front peripheral edge, and engagement pieces 74*c* which are bent downward are formed on a peripheral edge in the X direction.

The first shutter 73 and the second shutter 74 are inserted in the gap between the container main body 72 and the shutter guide member 72*a* in such a manner as to be slidable in the X direction. The shutter guide member 72*a* is configured to guide the bottom surface and both front and rear side edges of each of the first shutter 73 and the second shutter 74.

Figure 17A:
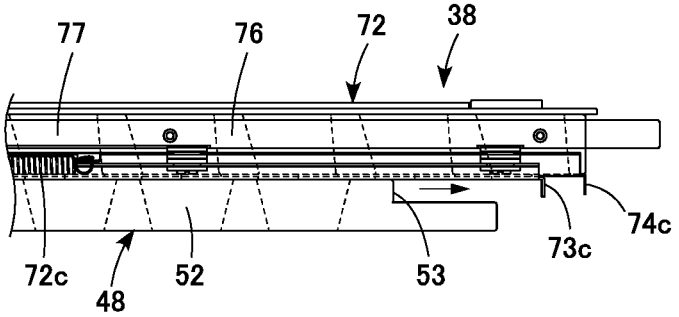
FIG. 17A is an explanatory process view for illustrating an operation procedure of the conveyance stage for opening the shutter of the manual-distribution container, and is an illustration of a fully closed state in which bottom surfaces of division chambers are closed.
Figure 18:
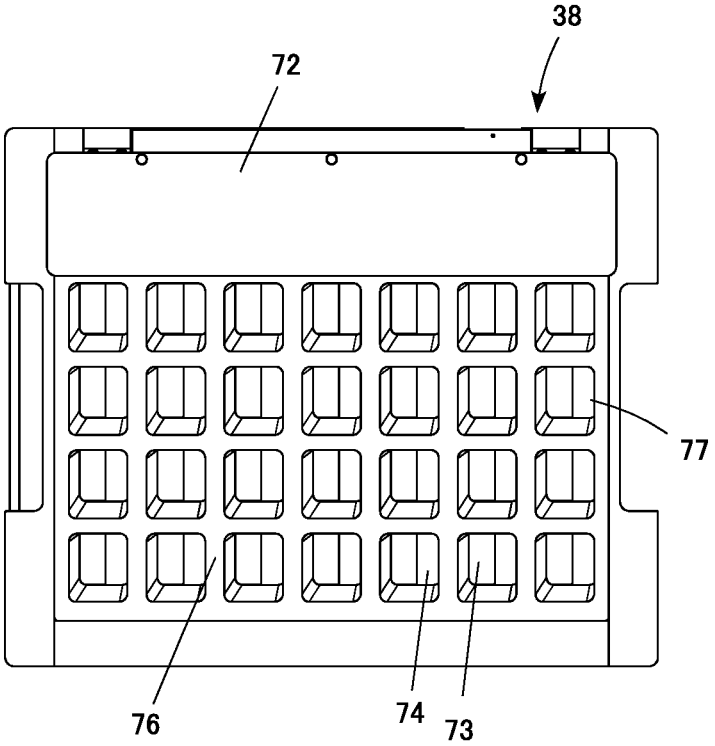
FIG. 18 is a plan view of the manual-distribution container in the state of FIG. 17A.

When the first shutter 73 and the second shutter 74 are inserted most deeply, the first shutter 73 and the second shutter 74 overlap the entirety of the bottom surface of the container main body 72, thereby bringing about a fully closed state of closing all of the bottom surfaces of the division chambers 77 (see FIG. 17A and FIG. 18). At this time, the first shutter 73 and the second shutter 74 are arranged in such a manner that positions of the engagement pieces 73*c* and 74*c* are apart from each other in the X direction. Moreover, the rectangular holes 74*b* of the second shutter 74 are formed in such a manner that positions of the rectangular holes 74*b* are apart from the rectangular holes of the first shutter in the X direction. Thus, when the first shutter 73 and the second shutter 74 overlap each other, the bottom surfaces of the division chambers 77 of the container main body 72 are closed.

When the first shutter 73 and the second shutter 74 slide (see FIG. 17B), the division chambers 77 of the container main body 72 are sequentially opened, and tablets in the division chambers 77 of the manual-distribution container 38 are discharged to the tray 24.

When the first shutter 73 and the second shutter 74 are in a fully opened state, the rectangular holes 73*b* and 74*b* formed in the shutters 73 and 74 match the division walls 76 of the container main body 72.

Next, an opening mechanism for the first shutter 73 and the second shutter 74 is described. As described above, the shutters (first shutter 73 and second shutter 74) of the manual-distribution container 38 are opened along with the movement of the conveyance stage 48 to the waiting position "c" of the unloading drawer 23*b* of the tray unloading unit 2 by the XY robot 49.

As described above, the manual distribution drawer 23*c* of the manual-distribution unit 3 is set as follows. When the manual distribution drawer 23*c* is drawn out, the manual-distribution container 38 is located at the manual-distribution operation position outside the packaging portion 14. When the manual distribution drawer 23*c* is pushed in, the manual-distribution container 38 is located above the waiting position of the tray unloading unit 2. The manual-distribution unit 3 is located at such a height position that, when the manual distribution drawer 23*c* is pushed in, the manual-distribution container 38 is located directly above the conveyance stage 48.

In this state, when the XY robot 49 performs positioning of the conveyance stage 48 in the X direction to the position above the waiting position "c" of the unloading drawer 23*b* of the tray unloading unit 2, as illustrated in FIG. 17A, the conveyance stage 48 moves in the X direction along the bottom surface of the manual-distribution container 38. The operation step portions 53 are formed at the end portion of the conveyance stage 48 in the X direction as described above and are brought into engagement with the engagement pieces 73*c* of the first shutter 73 and the engagement pieces 74*c* of the second shutter 74.

Figure 17B:
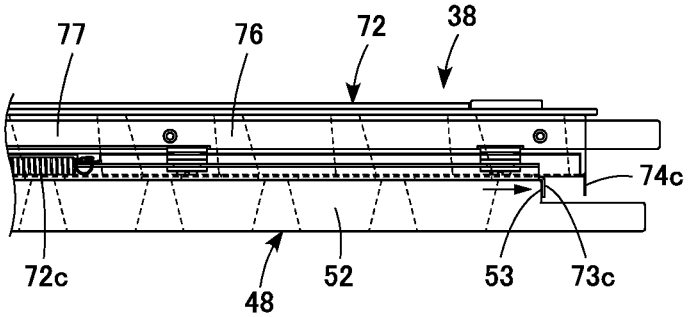
FIG. 17B is an explanatory process view for illustrating the operation procedure of the conveyance stage for opening the shutter of the manual-distribution container, and is an illustration of a state in which the division chambers are opened.
Figure 17C:
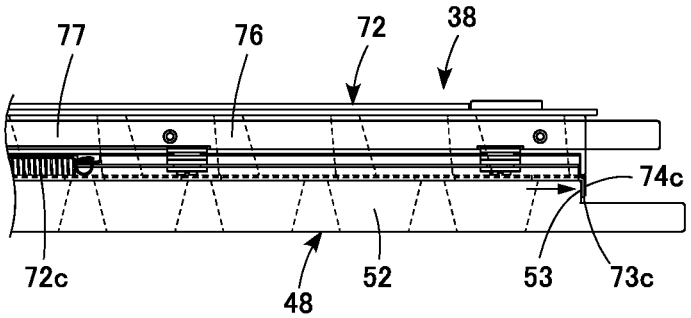
FIG. 17C is an explanatory process view for illustrating the operation procedure of the conveyance stage for opening the shutter of the manual-distribution container, and is an illustration of a state in which the division chambers are each half-opened.
Figure 19:
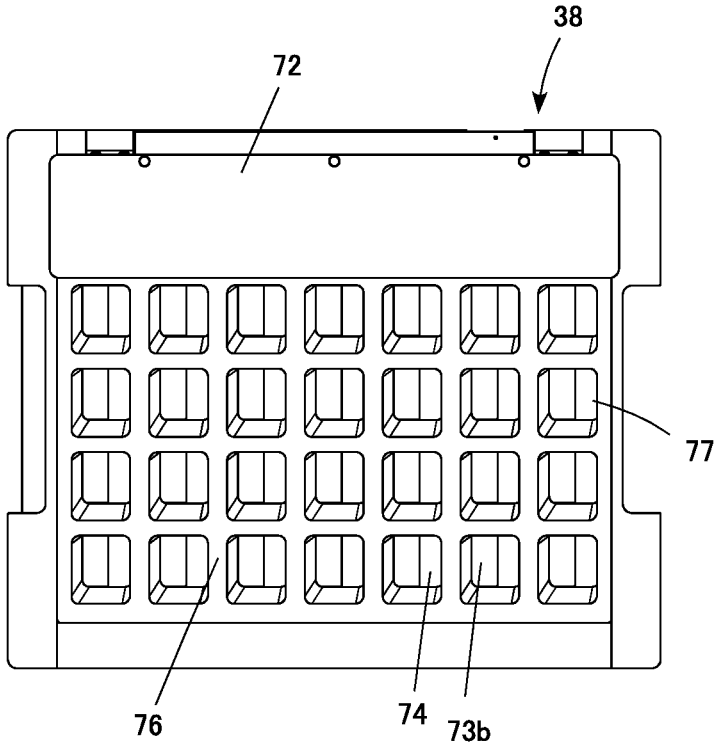
FIG. 19 is a plan view of the manual-distribution container in the state of FIG. 17C.

When the conveyance stage 48 is moved in the X direction, as illustrated in FIG. 17B, the engagement pieces 73*c* of the first shutter 73 located on the near side in the moving direction come into contact with the operation step portions 53. In this state, when the conveyance stage 48 further moves in the X direction, as illustrated in FIG. 17C, the first shutter 73 is pushed by the conveyance stage 48 to slide, thereby opening each of the division chambers 77 of the container main body 72 only by half. This state is illustrated in FIG. 19.

Figure 17D:
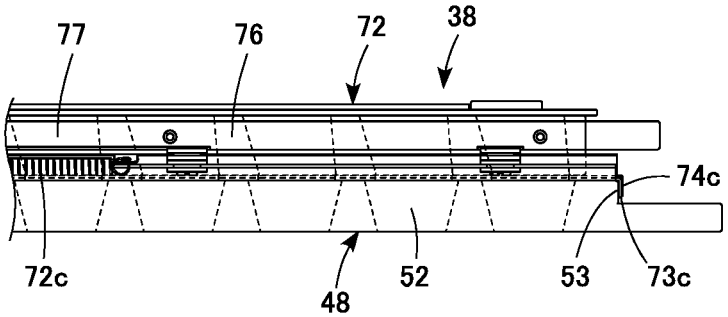
FIG. 17D is an explanatory process view for illustrating the operation procedure of the conveyance stage for opening the shutter of the manual-distribution container, and is an illustration of a fully opened state of the division chambers.
Figure 20:
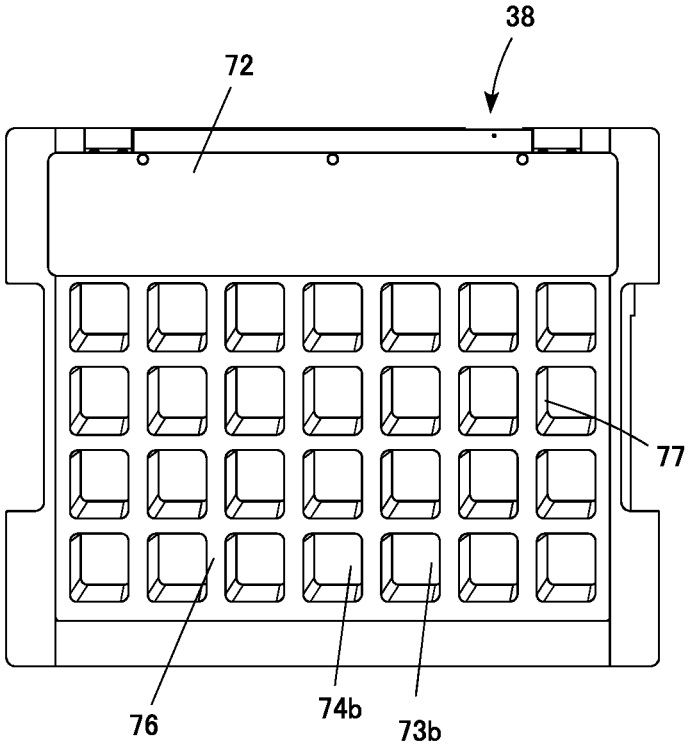
FIG. 20 is a plan view of the manual-distribution container in the state of FIG. 17D.

When the conveyance stage 48 further moves in the X direction, as illustrated in FIG. 17D, the engagement pieces 73*c* of the first shutter 73 are brought into engagement with the engagement pieces 74*c* of the second shutter 74, and the second shutter 74 is pushed by the conveyance stage 48 to slide. In this state, the division chambers 77 of the container main body 72 are brought into the fully opened state. This state is illustrated in FIG. 20.

Figure 16:
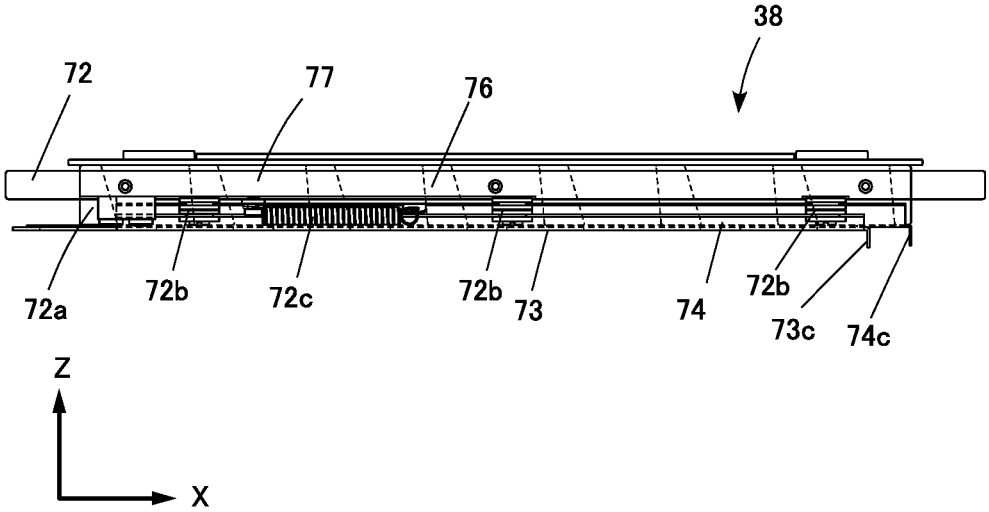
FIG. 16 is a side view for illustrating a configuration of the manual-distribution container of FIG. 15.

As a closing mechanism for the first shutter 73 and the second shutter 74, the manual-distribution container 38 uses a spring force of the spring 72*c* connected to the respective spring attaching pieces 73*d* and 74*d* of the first shutter 73 and the second shutter 74 as illustrated in FIG. 16. Free end portions of the spring are coupled to the spring attaching pieces 73*d* and 74*d* so that the first shutter 73 and the second shutter 74 are each urged and brought into the closing state. Thus, after tablets are discharged to the tray 24 from the state illustrated in FIG. 17D, when the conveyance stage 48 is moved by the XY robot for the next prescription, the first shutter 73 and the second shutter 74 are returned to the closing position by the spring force of the spring 72*c*.

When the operation of discharging tablets to the tray by the manual-distribution unit 3 is terminated as described above, in order to unload the tray 24 to the outside of the device, the adapter 10 is conveyed to the tray unloading unit 2. This operation is performed by the tray detaching unit 6.

As described above, the tray detaching unit 6 detaches the adapter 10, which has received the tray 24 supported by the tray driving unit 4, from the tray driving unit 4 and causes the tray 24 to be mounted to the tray unloading unit 2.

As described above, the second placement table 30*b* provided in the drawer 23*b* of the tray unloading unit 2 is provided on the two second support members 37 and supports the both ends of the adapter 10 in the X direction, thereby mounting the adapter 10 to the tray unloading unit 2. That is, other members of the tray unloading unit 2 are not arranged in a space defined between the two second support members 37, and the space serves as a region for allowing the tray detaching unit 6, which is arranged on a lower side of the tray unloading unit 2, to receive the adapter 10 (second raising/lowering device passage region 78).

A second raising/lowering device 79 of the tray detaching unit 6 is provided below the waiting position of the unloading drawer 23*b* of the tray unloading unit 2.

The second raising/lowering device 79 has a main configuration common to that of the first raising/lowering device 40 of the tray attaching unit 5, and hence a detailed description is omitted. The second raising/lowering device 79 and the first raising/lowering device 40 are different from each other in that a releasing member 80 configured to detach the adapter 10 from the conveyance stage 48 is provided on an upper surface of an adapter placement table 79*a* of the second raising/lowering device 79.

Figure 21:
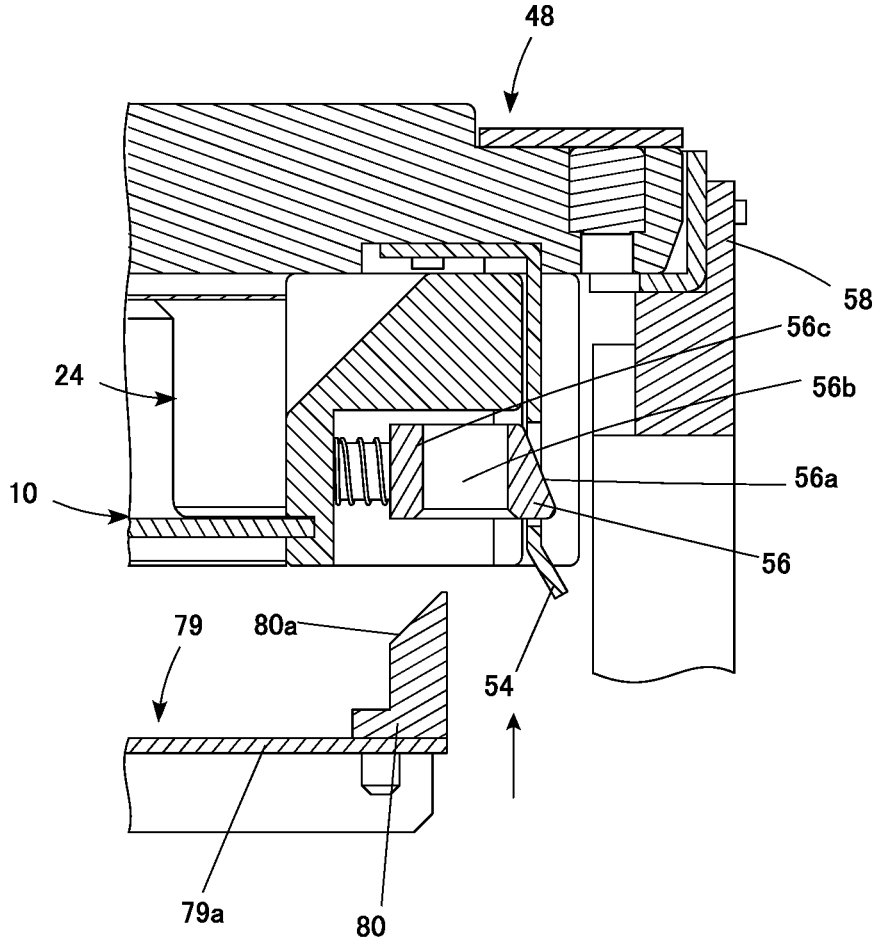
FIG. 21 is an explanatory view for illustrating a process of removing the adapter from the conveyance stage.

As illustrated in FIG. 21, the releasing member 80 is a member extending upward from the upper surface of the adapter placement table 79*a* of the second raising/lowering device 79 and includes an inclined surface portion 80*a*, which is formed at a distal end of the releasing member 80 and is inclined inward in the X direction. A position at which the releasing member is provided is a position corresponding to a releasing hole 56*b* of the ratchet member 56 of the adapter 10.

Figure 22:
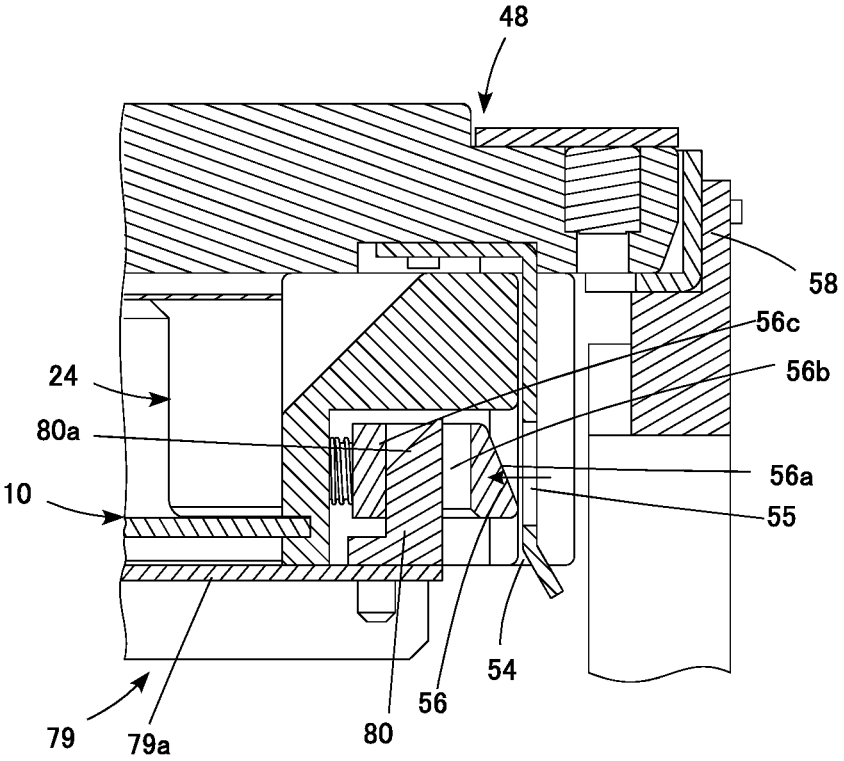
FIG. 22 is an explanatory view for illustrating the process of removing the adapter from the conveyance stage, and is an illustration subsequent to the FIG. 21.

When the adapter placement table 79*a* of the second raising/lowering device 79 is raised to approach the conveyance stage 48 to which the adapter 10 is attached, the releasing member 80 enters the releasing hole 56*b*. At this time, the inclined surface portion 80*a* pushes an inner surface 56*c* of the releasing hole 56*b* inward in the X direction, thereby causing the ratchet member 56 to retreat toward the inner side of the adapter 10. As a result, as illustrated in FIG. 22, the stage engagement ratchet 56*a* is disengaged from the engagement hole 55 of the tray fixing member 54, enabling the adapter 10 and the conveyance stage 48 to be released from each other.

Figure 23:
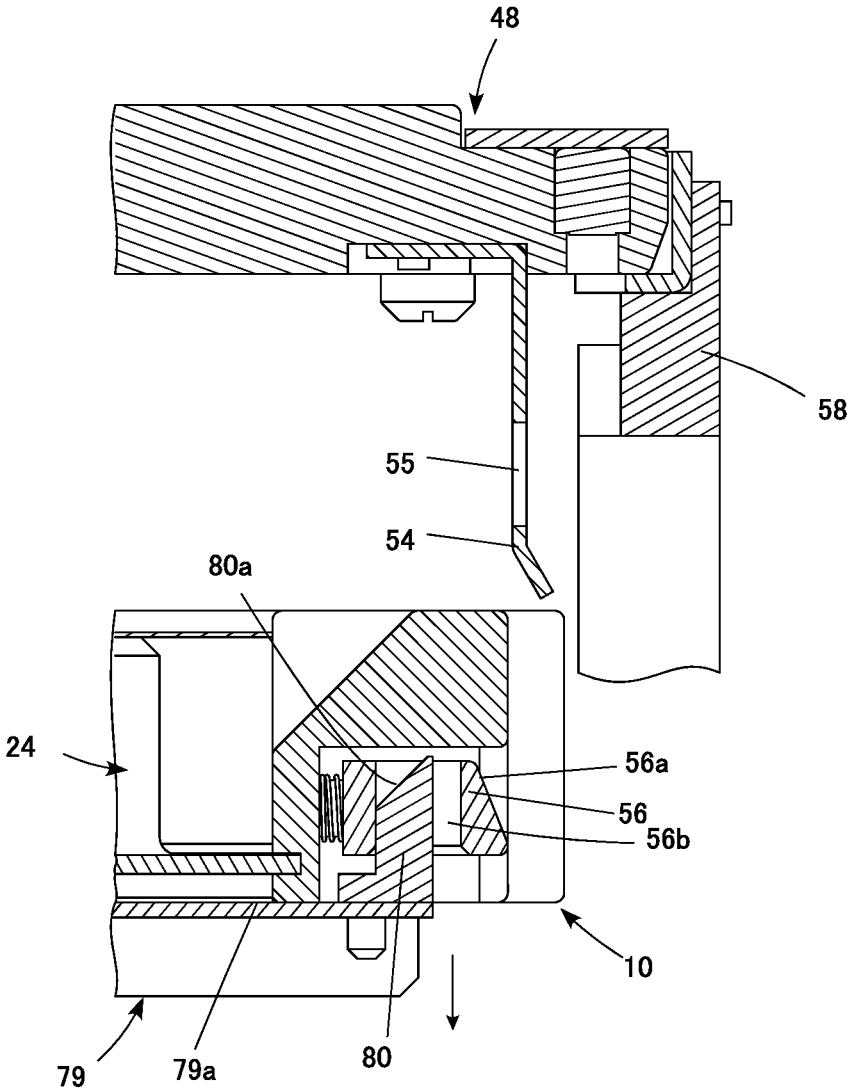
FIG. 23 is an explanatory view for illustrating the process of removing the adapter from the conveyance stage, and is an illustration subsequent to FIG. 22.

In this state, when the adapter placement table 79*a* of the second raising/lowering device 79 is lowered, the adapter 10 is lowered in a state of being placed on the adapter placement table 79*a* (see FIG. 23). Further, when the second raising/lowering device 79 is lowered, the adapter 10 is placed on the second placement table 30*b* of the tray unloading unit 2 so that the adapter 10 is mounted to the tray unloading unit 2.

Next, a control configuration for the tablet packaging device 11 according to this embodiment is described with reference to FIG. 33. FIG. 33 is a block diagram for illustrating a control configuration for the tablet packaging device according to the embodiment of the present invention.

The input device 100 is connected to the control device 200 for the tablet packaging device 11. Prescription information read by the code reader of the input device 100 is given to the control device 200. When the tablet packaging device 11 is connected to a communication network such as a LAN or the Internet, prescription information is given to the control device 200 via the communication network.

The control device 200 includes, for example, a CPU 201, a ROM 202, a RAM 203, and a data storage 204.

The CPU 201 is a processor configured to execute various kinds of arithmetic processing in accordance with various kinds of control programs. The ROM 203 is a non-volatile memory configured to store various kinds of programs to be executed by the CPU 201. The RAM 203 is a volatile memory or a non-volatile memory to be used for deployment of the various kinds of control programs by the CPU 201 and for temporarily storing data.

The data storage 204 is configured to store various kinds of data. The control device 200 gives prescription information, which has been input from the input device 100, to the data storage 204 so that the prescription information is stored in the data storage 204.

The control device 200 produces a prescription ID corresponding to the received prescription information, and the produced prescription ID is associated with the prescription information and stored into the data storage 204.

The prescription information includes, for example, information required for packaging such as a kind of a drug, the number of tablets, and administration timings, and patient information. The prescription ID is used at the time of reading prescription information associated therewith.

An RFID 16*a* is attached to each of the tablet cassettes 16, and the RFID 16*a* is read by a reading portion of the tablet feeder 17*a*, and tablet data having been read is given to the control device 200.

The control device 200 controls the data storage 204 to store the given tablet data. The control device 200 recognizes a kind of tablets, which are received in each of the tablet cassettes 16 and stored in the tablet accommodating portion 13, based on tablet data stored in the data storage 204.

The control device 200 selects the tablet cassette 16, which has received tablets required for packaging of tablets in accordance with given prescription information, based on tablet data stored in the data storage 204.

The control device 200 controls the tablet feeder 17, to which the tablet cassette 16 is set, based on the input prescription information to control the dispensing of tablets from the tablet feeder 17.

The tablets dispensed from the tablet feeder 17 fall into the tablet supplying device 19. The control device 100 controls the tablet supplying device 19 so that tablets are charged into the accommodation recess portions 26 of the tray 24 from the tablet supplying device 19.

When the control device 200 recognizes that the loading drawer 23*a* of the tray loading unit 1 has been pushed in and brought into the state of the waiting position "b", the control device 200 starts the operations of the conveying process and the packaging process.

The control device 200 controls the operation of the conveyance stage 48 of the tray driving unit 4 so as to allow the applicable accommodation recess portion 26 of the tray 24 to be located at the position of the dispensing port 21 of the tablet supplying device 19. Then, the control device 200 executes control of allowing tablets to be charged into the accommodation recess portion 26 from the tablet supplying device 19. When the charging has been terminated, the control device 200 controls the operation of the conveyance stage 48 of the tray driving unit 4 so as to allow the next accommodation recess portion 26 to move to the position of the dispensing port 21 of the tablet supplying device 19.

The control device 200 repeatedly performs the operation described above until the conveyance stage 48 reaches the waiting position "c", thereby allowing tablets to be received in all of the accommodation recess portions 26 of the tray 24. After that, the control device 200 controls the tray driving unit 4 to move the adapter 10, on which the tray 24 is placed, to the tray detaching unit 6.

After that, an operator confirms that the unloading drawer 23*b* of the tray unloading unit 2 can be drawn out and draws out the unloading drawer 23*b* from the tray unloading unit 2. In such a manner, the packaging operation of tablets is performed.

The tablet packaging device 11 according to this embodiment has the configuration described above. Next, a series of tablet packaging operations using this device is described.

An operator who performs the packaging operation first allows the tray 24 to be placed in the adapter 10 corresponding to a type of the tray. The operator draws out the loading drawer 23*a* of the tray loading unit 1 and places the adapter 10, which has received the tray 24, on the first placement table 30*a* located at the tray handling position "a". Then, the operator pushes in the loading drawer 23*a* to allow the adapter 10 to come to rest at the waiting position "b". At this point in time, the adapter placement table 41 of the first raising/lowering device 40 remains stopped at the lowest position. Thus, a sufficient gap is defined between the adapter 10 placed on the first placement table 30*a* and the first raising/lowering device 40 located below, and hence the operation of the loading drawer 23*a* of the tray loading unit 1 is not interrupted.

At this time, the control device 200 may read identification information provided to the tray 24 or the adapter 10 to confirm whether or not the conveyance stage 48 is adaptable to the tray 24 or the adapter 10.

Moreover, the conveyance stage 48 of the tray driving unit 4 is arranged at the original position. That is, the control device 200 controls the operation of the conveyance stage 48 so as to allow the conveyance stage 48 to be located above the waiting position "b" of the loading drawer 23*a* of the tray loading unit 1. Before the conveyance stage 48 moves to the original position, the collection tray 60 may be moved to the position corresponding to the dispensing port 21 to collect tablets and dust such as broken pieces of tablets which erroneously remain in the tablet feeder 17.

When the control device 200 recognizes that the adapter 10 has come to rest at the waiting position "b", the control device 200 executes control of raising the adapter placement table 41 of the first raising/lowering device 40. Then, the adapter 10 is received from the first placement table 30*a* and attached to the conveyance stage 48 located above. The conveyance stage 48 and the adapter 10 are coupled to each other through the engagement between the tray fixing members 54, which extend downward from the conveyance stage 48, and the ratchet members 56 as described above. At this time, the raising/lowering height of the first raising/lowering device 40 is controlled to be a height corresponding to the adapter 10 to be used. For example, when the control device 200 confirms the coupling between the conveyance stage 48 and the adapter 10 through use of a coupling position sensor provided to the conveyance stage 48, the control device 200 executes control of stopping the rise of the adapter placement table 41.

After raising the first raising/lowering device 40 by a height corresponding to the adapter 10, when the control device 200 determines that the coupling between the conveyance stage 48 and the adapter 10 cannot be confirmed based on the output from the coupling position sensor, the control device 200 recognizes the result as a coupling error and retries the raising/lowering operation of the first raising/lowering device 40 to perform the coupling operation again.

At the time of retrying, the control device 200 controls the raising/lowering height of the first raising/lowering device 40 to be higher than a predetermined height. Through the retrying operation, the control device 200 determines whether or not the coupling between the conveyance stage 48 and the adapter 10 has been completed based on the output from the coupling position sensor.

The control device 200 repeats the retrying operation until the coupling between the conveyance stage 48 and the adapter 10 is completed. However, in a case in which the ratchet member 56 or the like of the adapter 10 is worn or broken, even when the retrying operation is repeated, the coupling between the conveyance stage 48 and the adapter 10 cannot be completed, and the operation may be left undone. In such a case, it is conceivable that there is a defect in the adapter 10.

Therefore, in this embodiment, in the case in which the coupling between the conveyance stage 48 and the adapter 10 is not completed even when the retrying operation is repeated for a plurality of times, the control device 200 notifies occurrence of an error so that an operator can recognize replacement of the adapter 10.

The notification regarding the occurrence of an error is performed by turning on a light (LED) or displaying the error on a monitor 101 of the input device 100 in such a manner that a type of an error and a location of the error can be recognized.

As described above, the control device 200 gives a notification to a user to urge replacement of the adapter 10, thereby being capable of allowing a response to be made faster at the time of occurrence of an irregular event.

Incidentally, the coupling between the conveyance stage 48 and the adapter 10 is completed by performing the retrying operation. In this case, a normal operation is performed later. However, in the case in which the retrying operation is performed, it is conceivable that the adapter 10 has some abnormality.

Therefore, it is preferred that, in the case in which the retrying operation is performed, the control device 200 turn on a light (LED) or display a position to be checked on the monitor 101 of the input device 100 so as to urge an operator to confirm abnormality in the adapter 10 and the conveyance stage 48 after the prescription operation has been completed.

As described above, with the configuration of giving a notification in advance, the risk of failure of the tablet packaging device 11 can be notified promptly, thereby enabling a quick response to the failure.

When the coupling between the adapter 10 and the conveyance stage 48 is confirmed, the conveying process is started. Moreover, after the coupling between the adapter 10 and the conveyance stage 48 is confirmed, an operator can draw out the loading drawer 23*a* of the tray loading unit 1 and mount the adapter 10, which has received the tray 24 to be used for the next prescription, to the tray loading unit 1. The tablet packaging device 11 may include means for notifying (for example, turning on the light (LED)) an operator that the coupling between the adapter 10 and the conveyance stage 48 has been confirmed.

In the conveying process, the control device 200 controls the operation of the XY robot 49 of the tray driving unit 4. Through the operation of the XY robot 49, the conveyance stage 48 moves from the discharging position A to the receiving start position B. After the movement is confirmed by the control device 200, the tablets 29 are dispensed from the tablet feeder 17 for target drug tablets based on prescription information for a target patient on the tray. That is, tablets dispensed through the dispensing port 21 are discharged from above the division chambers 52 of the conveyance stage 48 into the accommodation recess portions of the tray 24 attached to the lower side of the conveyance stage 48, and hence the depth of the divisions in which the tablets 29 are accommodated becomes larger, thereby preventing the tablets 29 from bouncing at the bottom of the accommodation recess portion 26 and moving to adjacent accommodation recess portions 26. The control device 200 controls the operation of the XY robot 49. During the movement from the receiving start position B to the waiting position "c", the XY robot 49 performs the receiving process of moving the conveyance stage 48 in synchronization with every timing of intermittently dispensing the tablets 29 through the dispensing port 21 and receiving the tablets 29 at each of the division chambers 52.

The division chambers 52 of the conveyance stage 48 correspond to the accommodation recess portions 26 of the tray 24, respectively. Therefore, the tablets 29 intermittently dispensed through the dispensing port 21 are distributed to the accommodation recess portions 26 of the tray 24 every time.

During a period from after pushing in the loading drawer 23*a* of the tray loading unit 1 to before completing the dispensing of the tablets 29, an operator can receive tablets in the corresponding division chambers 77 of the manual-distribution container 38 of the manual-distribution unit 3 as needed. When the manual distribution of tablets to the manual-distribution container 38 is terminated, the operator pushes in the manual distribution drawer 23*c* of the manual-distribution unit 3 to arrange the manual-distribution container 38 above the waiting position "c" of the unloading drawer 23*b* of the tray unloading unit 2.

When the conveyance stage 48 of the XY robot 49 reaches the waiting position "c", the dispensing of the tablets 29 to each of the division chambers 52 is terminated. When no manual distribution drug is present, it may be checked at this timing whether the tablets 29 are accurately distributed to the division chambers 52. This check can be performed by photographing the tray 24 from above and automatically comparing an image of drug tablets in each of the accommodation recess portions 26 and an image of the tablets 29 that are to be received at each of the accommodation recess portions 26 based on prescription information.

As a result of the check, when it is determined that proper tablets 29 are received in each of the division chambers 52, the control device 200 controls the conveyance stage 48 to move to the tray handling position "d" of the unloading drawer 23*b* of the tray unloading unit 2. At this time, the control device 200 controls the operation of the XY robot 49 so that the XY robot 49 performs the positioning in the Y direction and thereafter performs the positioning in the X direction as described above. It is preferred that control be executed in such a manner that the positioning in the X direction is suspended while the manual distribution drawer 23*c* of the manual-distribution unit 3 is drawn out.

Through the positioning of the conveyance stage 48 in the X direction, the first shutter 73 and the second shutter 74 of the manual-distribution container 38 are opened. As a result, the division chambers 77 of the manual-distribution container 38 are opened, and the tablets received inside the division chambers 77 fall into the division chambers 52 of the conveyance stage 48 to be discharged into the accommodation recess portions 26 of the tray 24. With the first shutter 73 and the second shutter 74 brought into the fully opened state, all of the division chambers 77 are opened at the same time, and the tablets are accommodated in the accommodation recess portions 26 of the tray 24.

When the control device 200 confirms the positioning of the conveyance stage 48 in the X direction, the control device 200 controls the second raising/lowering device 79 to raise the adapter placement table 79*a*. Then, an operator detaches the adapter 10 from the conveyance stage 48 and places the adapter 10 on the adapter placement table 79*a*.

When the control device 200 confirms that the adapter 10 has been detached from the conveyance stage 48, the control device 200 controls the XY robot 49 to move the conveyance stage 48 to the original position for the next prescription. The first shutter 73 and the second shutter 74 of the manual-distribution container 38 are closed by an action of the spring 72*c* through the movement of the conveyance stage 48 for the next prescription. When the control device 200 confirms that the conveyance stage 48 has moved to the original position, the control device 200 controls the first raising/lowering device 40 to be raised for the next prescription. Accordingly, the operation of attaching the adapter 10, which has received the tray 24 for the next prescription, to the conveyance stage 48 can be performed.

When it is confirmed that the adapter 10 has been received, the control device 200 controls the operation of the tray detaching unit 6. The tray detaching unit 6 uses the control device 200 to lower the adapter placement table 79*a* of the second raising/lowering device 79, and the adapter 10 is mounted to the second placement table 30*b* of the tray unloading unit 2.

When it is confirmed that the second raising/lowering device 79 has been lowered to such an extent that a gap is formed between the adapter 10 and the adapter placement table 79*a*, an operator draws out the unloading drawer 23*b* of the tray unloading unit 2. The tablet packaging device 11 may include means for notifying (for example, turning on the light) an operator that the operation of drawing out the tray unloading unit 2 is allowed.

The notification means described above may be operated when comparison of the identification information provided to the adapter 10 and the prescription information based on the prescription ID is correctly performed. Moreover, the association between the adapter 10 and the prescription ID may be cleared at the point in time of removing the adapter 10 from the unloading drawer 23*b* or at the point in time of confirming the comparison of the adapter 10, and preparation for use for the next prescription may be performed.

The tray 24 is detached together with the adapter 10 from the second placement table 30*b* having been drawn out to the tray handling position "a", and the tray 24 is delivered for the next packing process. In the packing process, the lid sheet 25 is affixed to an open surface of the tray 24, and the packaging operation for the tablets 29 is terminated. In order to confirm matching of kinds of the lid sheet 25 and the tray 24, the matching may be confirmed in the packing process through use of identification information such as the barcodes provided to the tray 24 and the lid sheet 25.

As described above, in the tablet packaging device 11 according to this embodiment, the tray 24 mounted to the tray loading unit 1 is attached to the tray driving unit 4, and the tray 24 is then driven, thereby being capable of directly packaging tablets into the tray 24. Thus, the tray 24 is not placed on the tray loading unit 1 during the packaging operation. Moreover, the tray 24 having tablets 29 discharged thereto and accommodated therein is mounted to the tray unloading unit 2. Thus, after the tray is delivered from the tray loading unit 1 to the tray driving unit 4, a state in which the tray 24 is not mounted to the tray loading unit 1 is brought about. Accordingly, during the operation with the tray 24, a tray for the next prescription can be mounted to the tray loading unit 1. Therefore, the operation efficiency of the packaging operation for the tray can be improved.

Moreover, during the operation of removing the tray 24, which has been packaged, from the tray unloading unit 2, the conveying process for the tray used for the next prescription can be started. Thus, the operation of the device can be efficiently performed in accordance with the operation of the operator, thereby being capable of improving the operation efficiency.

The present invention is not limited to the embodiment described above and is applicable in other various modes. For example, the tray loading unit 1 and the tray unloading unit 2 have the configuration including the loading drawer 23*a* and the unloading drawer 23*b*, respectively. However, the present invention is not limited to this configuration, and any other configuration may be adopted as long as attaching the adapter 10 to the conveyance stage and receiving the adapter from the conveyance stage can be performed.

Moreover, the conveyance stage 48 and the adapter 10 are attached through use of the ratchet members 56, but any other mechanism may be used. Moreover, the tray 24 and the conveyance stage 48 may have a configuration in which the tray 24 and the conveyance stage 48 can be directly attached to each other. For example, when the depth of the accommodation recess portions 26 of the tray 24 is large, the tablets 29 do not bounce at the time of charging tablets into the tray 24, thereby being capable of reducing the problems such as erroneous distribution of tablets without use of the adapter 10.

Moreover, the two shutters provided to the manual-distribution container 38 are configured to open through the movement of the conveyance stage 48 in the X direction. However, the number of shutters is not limited, and the shutters may be opened through the movement in the Y direction with the opening direction of the shutter set to the Y direction. Moreover, any other shutter opening/closing mechanism configured directly drive the shutters may be used.

Figure 27:
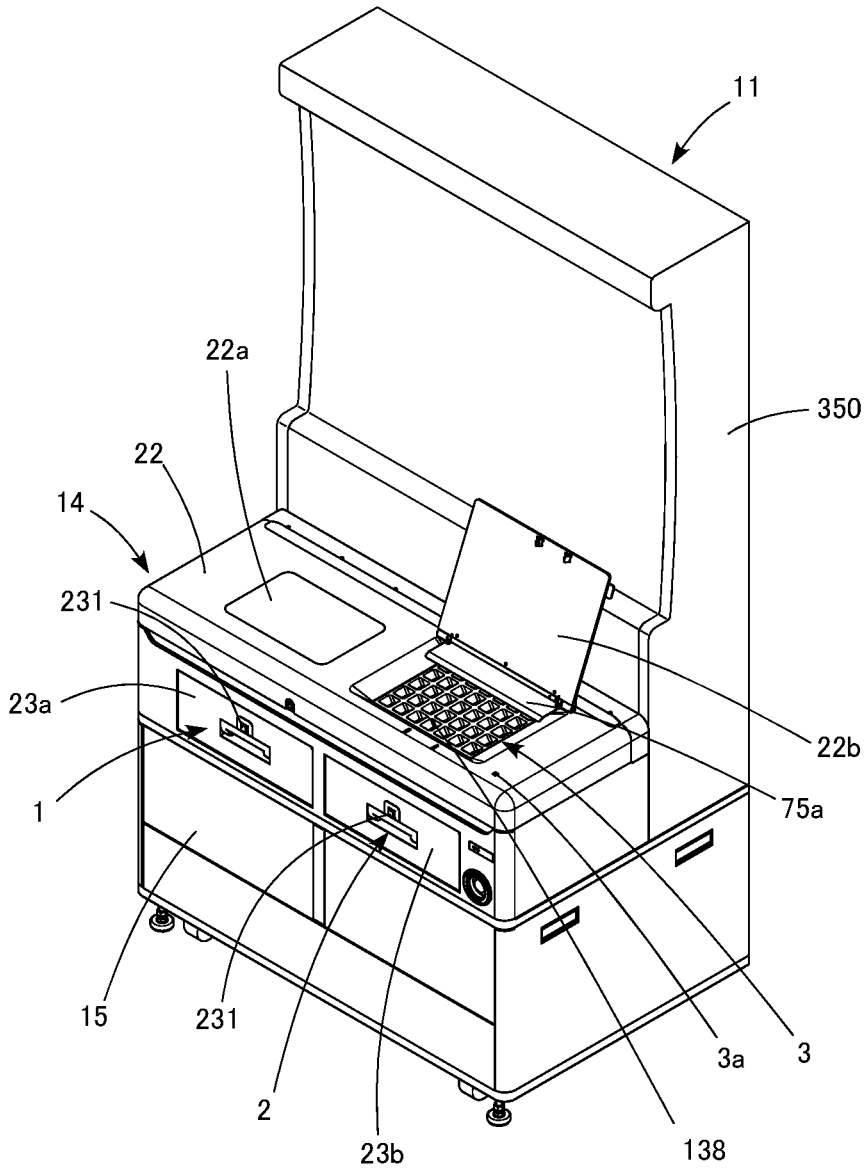
FIG. 27 is a view for illustrating an exterior configuration of a tablet packaging device of a modification example including a manual-distribution unit of another embodiment.
Figure 28:
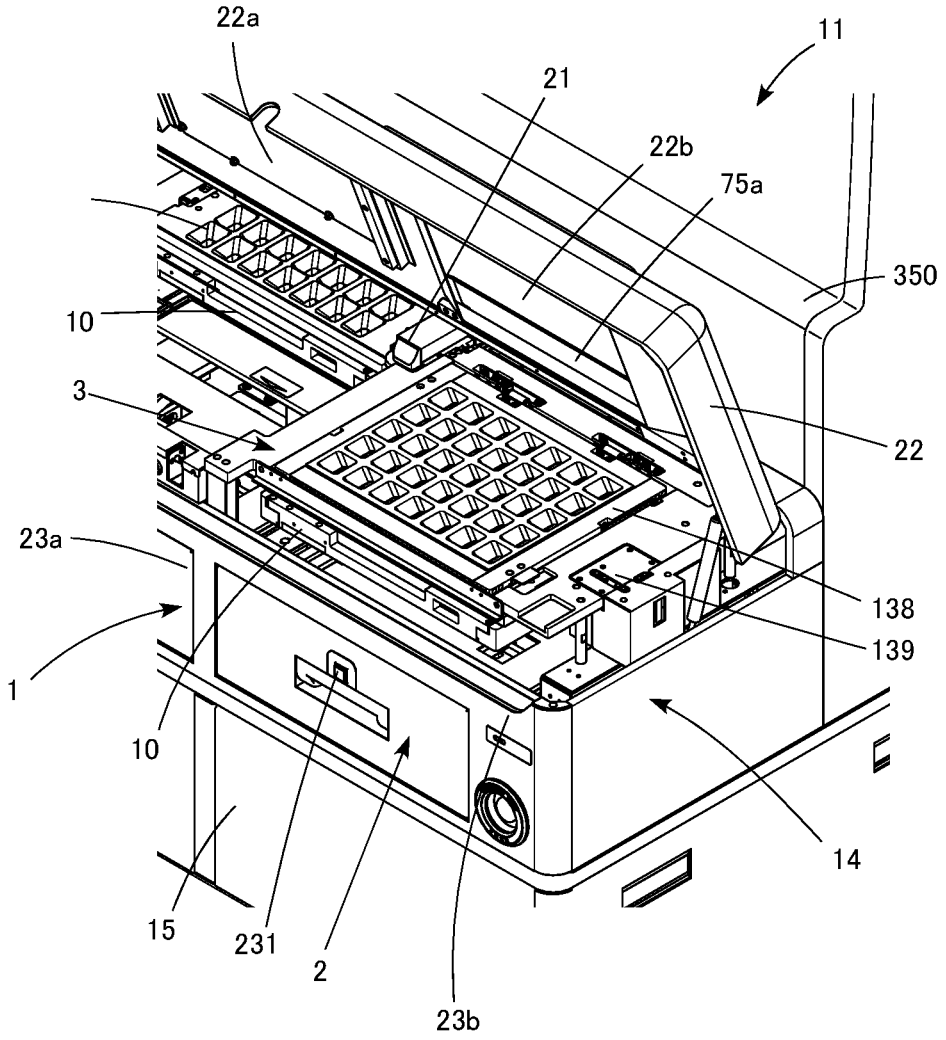
FIG. 28 is a partial enlarged perspective view for illustrating a configuration of the manual-distribution unit in a state in which a lid cover of the tablet packaging device of FIG. 27 is opened so that the manual-distribution unit is exposed to an outside.

The manual-distribution unit 3 has the configuration including the manual distribution drawer 23*c*, but any other configuration may be adopted. For example, as illustrated in FIG. 27 and FIG. 28, a manual-distribution container 138 may be built in the packaging portion 14 in a fixed state. In this configuration, as illustrated in FIG. 27, the manual-distribution container 138 is exposed to the outside by pulling up a manual distribution lid 22*b* provided to the cover lid 22 of the packaging portion 14, and manual distribution tablets can be charged into the manual-distribution container. In this case, a dedicated shutter opening/closing motor 139 configured to directly drive the shutters without the operation of opening and closing the shutters with the conveyance stage 48 may be used. The shutter opening/closing motor 139 configured to drive the shutters is operated by operating a manual-distribution completion instructing button 3*a* provided to the cover lid 22 of the packaging portion 14.

Further, the tray driving unit 4 is attached below the conveyance stage 48 having a plate shape with division chambers corresponding to the accommodation recess portions 26, but any other configuration may be adopted as long as the tray 24 can be moved to positions of the dispensing port 21 for tablets, the tray loading unit 1, and the tray unloading unit 2. For example, there may be adopted a configuration in which the adapter 10 is directly gripped and moved. In this case, in order to prevent movement of tablets due to the bouncing in the accommodation recess portions 26 of the tray 24, for example, a lid member configured to cover an upper side of the tray 24 having the division chambers corresponding to the accommodation recess portions 26 of the tray 24 may be provided to the adapter 10.

Figure 26:
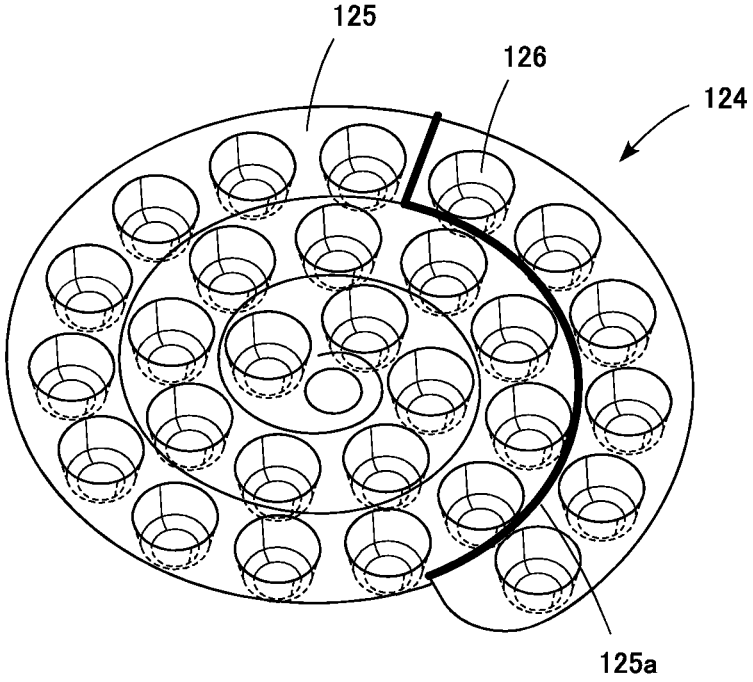
FIG. 26 is a perspective view for schematically illustrating a configuration a tray of another modification example.

Moreover, the tray driving unit 4 includes the conveyance stage 48 that is movable to any position on the XY plane, and is capable of packaging tablets also into, for example, a tray 124 in which the accommodation recess portions 26 are not arranged in the grid pattern. As one example of the tray 124, for example, as illustrated in FIG. 26, there may be provided the tray 124 having a configuration in which accommodation recess portions 126 are arranged in a spiral pattern along division walls 125 having a division line 125*a* in a spiral shape. With use of such tray 124, the winding start of a prescription is not restricted. Therefore, for example, even when there is given a prescription starting from administration at daytime or night, the problem of causing an empty accommodation recess portion 26 can be eliminated. Moreover, the accommodation recess portions are arranged in the order of administration. Therefore, a patient is less liable to erroneously administer tablets accommodated in an incorrect accommodation recess portion. Further, even when the accommodation recess portion corresponding to tablets having been administered is separated from the tray and divided, the overall shape of the tray is prevented from becoming irregular.

As described above, the control device 200 controls the tablet feeder 17, to which the tablet cassette 16 has been set, based on input prescription information, thereby controlling the operation of dispensing tablets from the tablet cassette 16. In order to improve the dispensing speed, the control device 200 starts control of driving of the conveyance stage 48 and the tablet supplying device 19 with a trigger for starting dispensing tablets to one accommodation recess portion 26 of the tray 24.

However, it is required that tablets be caused to fall from the tablet supplying device 19 after the accommodation recess portion 26 has moved to the position of the dispensing port 21 of the tablet supplying device 19. Therefore, in order to start the dispensing operation of the tablet supplying device 19 in accordance with a moving time of the tray 24, waiting time is given to the start of dispensing by the tablet supplying device 19 to match timings.

For example, in order to cause tablets to reliably fall into the accommodation recess portion 26, the waiting time is set based on a time corresponding to the longest moving distance of the tray 24. When the waiting time is set in such a manner, tablets can be caused to fall into any of the accommodation recess portions 26 of the tray 24 at the time of dispensing tablets into the accommodation recess portions 26.

However, when the operation of dispensing tablets is performed based on the time corresponding to the longest moving distance also in the case in which the moving time of the tray 24 is short, wasteful waiting time is given at each time of dispensing tablets into one accommodation recess portion 26, with the result that the packaging time becomes longer.

Therefore, at each time of dispensing tablets into one accommodation recess portion 26, the control device 200 calculates a moving distance to the next accommodation recess portion 26 and calculates time required for the movement. Then, the control device 200 sets a waiting time based on the calculated moving time and control the tablet supplying device 19 to start dispensing tablets.

Through the control described above, the wasteful time for dispensing tablets to one accommodation recess portion 26 can be reduced, thereby being capable of shortening the packaging time.

Moreover, in the packaging operation, tablets are dispensed after moving to the adjacent accommodation recess portion 26 in most cases. Therefore, the control device 200 stores two waiting times including the shortest moving time for moving to the adjacent accommodation recess portion 26 and the time corresponding to the longest moving distance and controls the tablet supplying device 19 to start dispensing based on the following conditions. In the case in which the next accommodation recess portion 26 to which tablets are dispensed is the adjacent accommodation recess portion 26, the waiting time is set to the time corresponding to the shortest moving time. In the case in which the next accommodation recess portion 26 is other than the adjacent accommodation recess portion 26, the waiting time is set to the time corresponding to the time required for the longest moving distance.

Through the control described above, the arithmetic processing executed by the control device 200 is simplified. The packaging time can also be sufficiently shortened as compared to the time obtained by setting the waiting time to the time corresponding to the time required for the longest moving distance.

The control device 200 controls the movement of the conveyance stage 48 based on positions of the accommodation recess portions 26 of the tray 24. Therefore, the control device 200 needs to grasp the positions of the accommodation recess portions 26 of the tray 24. When a different tray 24 is provided, for example, positions, the size, or the number of the accommodation recess portions 26 differ. Therefore, the control device 200 performs adjustment for grasping the positions of the accommodation recess portions 26 of the tray 24.

Figure 34:
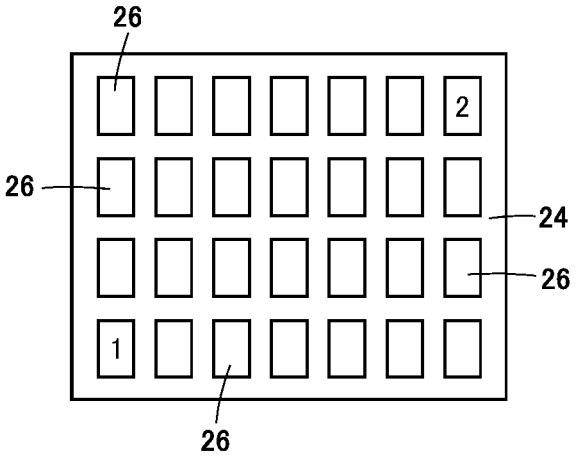
FIG. 34 is an explanatory view for illustrating a state in which accommodation recess portions are regularly arranged on the tray.

FIG. 34 is an explanatory view for illustrating a state in which the accommodation recess portions 26 are regularly arranged in the tray 24. When the accommodation recess portions 26 are regularly arranged as illustrated in FIG. 34, position information of the lower left accommodation recess portion 26 (accommodation recess portion indicated by 1 in FIG. 34), the upper right accommodation recess portion 26 (accommodation recess portion indicated by 2 in FIG. 34), and the accommodation recess portions 26 and 26 at ends on a diagonal line is given to the control device 200. The control device 200 calculates position information of the accommodation recess portions 26 based on interval information regarding the accommodation recess portions 26.

The control device 200 controls the movement of the conveyance stage 48 based on the calculated position information of the accommodation recess portions 26.

Figure 35:
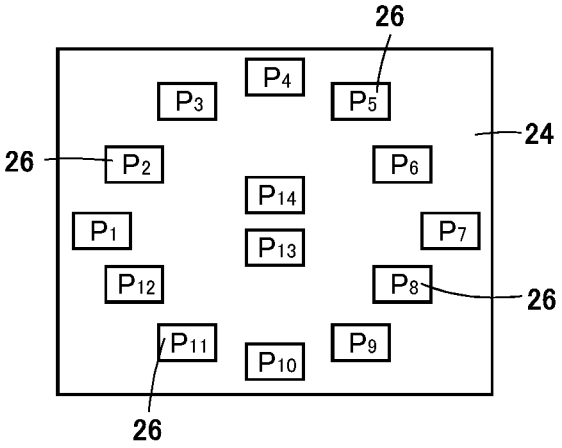
FIG. 35 is an explanatory view for illustrating a state in which the accommodation recess portions are randomly arranged on the tray.
Figure 36:
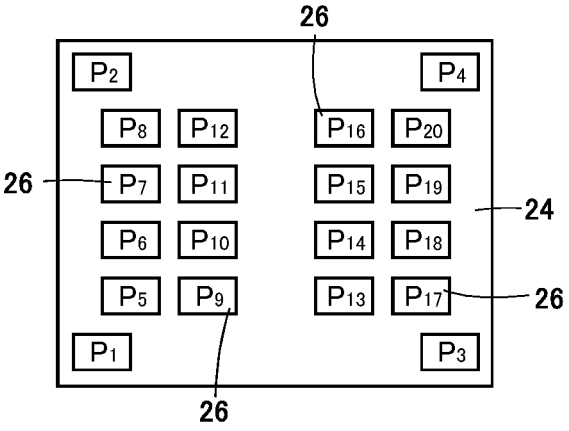
FIG. 36 is an explanatory view for illustrating a state in which the accommodation recess portions are randomly arranged on the tray.

FIG. 35 and FIG. 36 are each an explanatory view for illustrating a state in which the accommodation recess portions 26 are randomly arranged in the tray 24. When the accommodation recess portions 26 are randomly arranged in the tray 24 as described above, position information of each of the accommodation recess portions 26 is input from the input device 100 to the control device 200.

Position information P1=(X1, Y1) to Pmax=(Xmax, Ymax) of the accommodation recess portion (P1 to Pmax) is input from the input device 100 to the control device 200.

The control device 200 controls the movement of the conveyance stage 48 based on the input position information of the accommodation recess portions 26.

Through the input of the position information of the accommodation recess portions (P1 to Pmax) with the use of the input device 100 as described above, the tray 24 of various types can be handled. Regarding the tray for which the position information is once input, the position information input for each tray is stored as master information, for example, in the data storage 204. When the same tray is replaced with another tray in the next time or later, position information is called out as master information from the data storage 204, thereby being capable of reducing input time.

As illustrated in FIG. 1 and FIG. 3, LEDs 231 are provided on the front surfaces of the loading drawer 23*a* and the unloading drawer 23*b*. When the LED 231 is turned on, it can be distinguished whether or not the loading drawer 23*a* and the unloading drawer 23*b* can be drawn out.

For example, when the loading drawer 23*a* or the unloading drawer 23*b* can be drawn out, the control device 200 controls the LED 231 to turn on with green light. An operator can understand whether or not the loading drawer 23*a* or the unloading drawer 23*b* can be drawn out in accordance with a lighting state of the LED 231.

Further, it may be configured so that the control device 200 can distinguish whether or not the adapter 10 or the tray 24 is set to the loading drawer 23*a* or the unloading drawer 23*b* based on the lighting state of the LED 231.

For example, in the state in which the loading drawer 23*a* or the unloading drawer 23*b* is drawn out, when the adapter 10 or the tray 24 is set, the LED 231 is turned on. The lighting of the LED 231 is performed in a blinking manner, or when the lighting of the LED 231 can be performed with red, green, and blue, the color is changed to the color corresponding to the case in which the loading drawer 23*a* or the unloading drawer 23*b* can be drawn out. The control device 200 turns on the LED 231 in a mode other than that corresponds to the lighting of the LED 231 indicating that the loading drawer 23*a* or the unloading drawer 23*b* can be drawn out.

As described above, in the state in which the loading drawer 23*a* or the unloading drawer 23*b* is drawn out, the state of setting the adapter 10 or the tray 24 can be determined based on the lighting of the LED 231.

Therefore, the state of setting the adapter 10 or the tray 24 can be distinguished in the state in which the loading drawer 23*a* or the unloading drawer 23*b* is drawn out. Then, when the LED 231 does not turn on in the state in which the adapter 10 or the tray 24 is set, it can be quickly determined that, for example, abnormality has occurred in the sensor.

Figure 37:
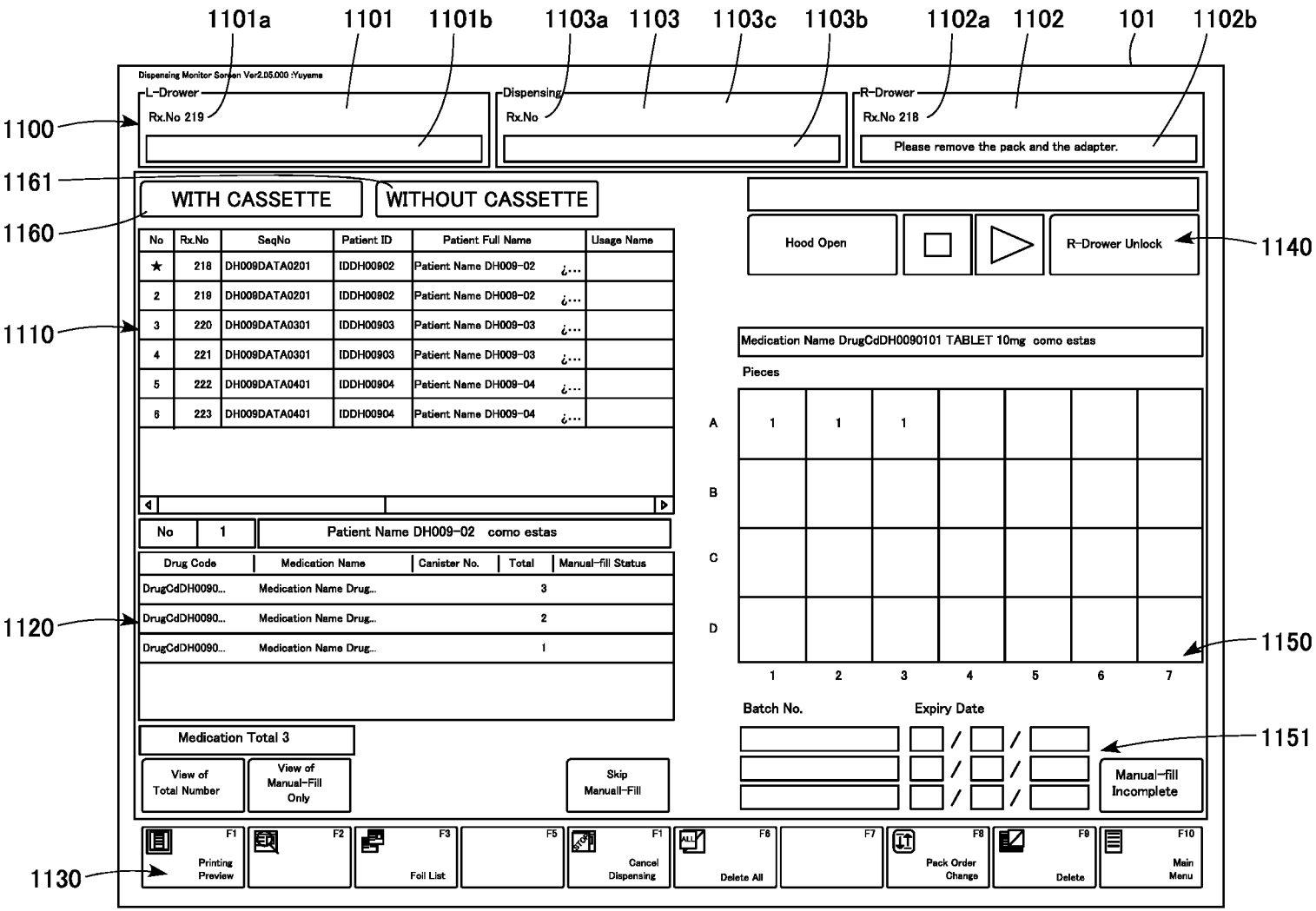
FIG. 37 is an explanatory view for illustrating the progress of the tablet packaging device displayed on a monitor.

Moreover, the control device 200 of this embodiment controls the monitor 101 of the input device 100 to display the progress of the tablet packaging device 11. FIG. 37 is an explanatory view for illustrating the progress of the tablet packaging device to be displayed on the monitor.

A packaging progress display area 1100, a packaging list display area 1110, a medicine list display area 1120, a function key display area 1130, a packaging device operating area 1140, and a distribution position/amount guide display area 1150 for a manual distribution drug are displayed on the monitor 101.

The packaging progress display area 1100 is an area for displaying the progress and state of packaging. The packaging list display area 1110 is an area for displaying a list of prescription information. The packaging device operating area 1140 is an area for operating the packaging device. The distribution position/amount guide display area 1150 for a manual distribution drug is to be used at the time of manual distribution prescription and is an area for displaying positions to which the manual distribution drug is distributed and the amount of the drug. The function key display area 1130 is an area for performing various kinds of processing.

Regarding the packaging device operating area 1140 and the function key display area 1130, when an applicable area is clicked through use of a mouse or the like, a processing operation displayed in the corresponding area is performed.

The packaging progress display area 1100 displays an L-Drawer region 1101, an R-Drawer region 1102, and a Dispensing region 1103. The L-Drawer region 1101 shows a state of the loading drawer 23*a* or operation instruction information for an operator. The R-Drawer region 1102 shows a state of the unloading drawer 23*b* or operation instruction information for an operator. The Dispensing region 1103 displays a dispensing state.

When the control device 200 analyzes the operation of packaging, and there is any change in an item relating to the progress of packaging, the packaging progress display area 1100 updates the progress.

The L-Drawer region 1101 includes a prescription ID display region 1101*a* and a notification region 1101*b*. The prescription ID display region 1101*a* displays a prescription ID subjected to packaging into the tray 24 set on the loading drawer 23*a*. The notification region 1101*b* notifies an operator of a state of the loading drawer 23*a*. An operator can confirm the progress of the loading drawer 23*a* by checking the display of the L-Drawer region 1101. In FIG. 37, nothing is displayed in the notification region 1011*b* because the tray 24 is set on the loading drawer 23*a*. However, when the tray 24 is not set on the loading drawer 23*a*, a notification for requesting an operator to set the tray 24 is displayed.

When there is a prescription subjected to the next packaging, the prescription ID display region 1101*a* of the L-Drawer region 1101 displays a prescription ID number. When there is no prescription subjected to the next packaging, the display is cleared.

When there is a prescription subjected to the next packaging, the notification region 1101*b* of the L-Drawer region 1101 displays operation instruction contents to which the following display conditions are applicable. When the tray 24 and the adapter 10 are not set, a message "Please set a tray and an adapter." is displayed. When the tray 24 is not set, a message "Please set a tray." is displayed. When the loading drawer 23*a* is not closed, a message "Please close a drawer." is displayed.

The R-Drawer region 1102 includes a prescription ID display region 1102*a* and a notification region 1102*b*. The prescription ID display region 1102*a* displays prescription information subjected to packaging into the tray 24 set on the unloading drawer 23*b*. The notification region 1102*b* notifies an operator of a state of the unloading drawer 23*b*. An operator can confirm the progress of the unloading drawer 23*b* by checking the display of the R-Drawer region 1102. In FIG. 37, packaging of tablets into the tray 24 set on the unloading drawer 23*b* has been terminated, and a notification for requesting an operator to remove the tray 24 is displayed on the notification region 1102*b*.

The notification region 1102*b* of the R-Drawer region 1102 displays operation instruction contents corresponding to the following display conditions. When a plurality of display conditions are satisfied, the latest operation instruction content is displayed.

When the tray 24 is set, a message "Please remove the tray and the adapter." is displayed. When the adapter 10 is set, a message "Please remove the adapter." is displayed. When the unloading drawer 23*b* is not closed, a message "Please close the drawer." is displayed.

The Dispensing region 1103 includes a region 1103*c*, a prescription ID display region 1103*a*, and a dispensing notification region 1103*b*. The region 1103*c* shows a state of dispensing. The prescription ID display region 1103*a* displays prescription information of a prescription being dispensed. The dispensing notification region 1103*b* displays processing which needs manual distribution.

When there is a prescription subjected to packaging, the region 1103*c* which shows a state of dispensing displays operation instruction contents corresponding to the following display conditions. When a manual distribution medicine is included in a prescription, and completion of manual distribution is not registered, a message "Please complete all of the manual distribution medicine." is displayed.

The packaging list display area 1110 displays prescription ID input to the tablet packaging device 11 in the order of input. In order that a prescription ID currently being subjected to prescription can be understood, the prescription ID may be displayed in a mode different from those of other prescription IDs.

Further, in this embodiment, a With Cassette tab 1160 and a Without Cassette tab 1161 are displayed. The With Cassette tab 1160 is a tab for showing a packaging prescription which involves use of the tablet cassette 16 in which tablets to be packaged are received from prescription information based on a prescription ID. The Without Cassette tab 1161 is a tab for showing a manual distribution prescription.

When the With Cassette tab 1160 is clicked through use of a mouse or the like, a list of prescriptions including a packaging prescription which involves use of only the tablet cassette 16 in which tablets to be packaged are received from prescription information based on a prescription ID and a prescription which involves both of a prescription using the tablet cassette 16 and a prescription of manual distribution is displayed in the packaging list display area 1110.

When the Without Cassette tab 1161 is clicked through use of a mouse or the like, a list of prescriptions including a prescription which involves only the manual distribution is displayed in the packaging list display area 1110.

When any one of the With Cassette tab 1160 and the Without Cassette tab 1161 is selected, information based on a prescription ID listed at the top in the packaging list display area 1110, that is, a prescription ID relating to a prescription currently being subjected to the packaging operation is displayed. Accordingly, when a manual distribution operation is required, information required for the manual distribution is displayed for an operator in the distribution position/amount guide display area 1150 for a manual distribution drug, thereby enabling the operator to easily perform the manual distribution operation. In particular, in the case of "Without Cassette", an operator performs the manual distribution operation for tablets with respect to the tray 24. At this time, positions for the manual distribution and the number of tablets are displayed in the distribution position/amount guide display area 1150 for a manual distribution drug. As a result, an operator can perform the operation easily and safely. That is, an operator can correctly distribute subject drug tablets with a correct number of tablets at correct locations, thereby improving the safety. For example, when tablets are to be administered three times a day, that is, in the morning, the daytime, and the night, the operation is performed in such a manner that drug tablets to be administered in the morning, drug tablets to be administered in the daytime, and drug tablets to be administered in the night are distributed in the stated order from the upper right part of the matrix.

Moreover, the monitor 101 may display the tabs in such a manner as to allow the currently selected tab is distinguished between the "With Cassette" and the "Without Cassette".

A start button for the packaging device, a stop button for the packaging device, a temporary stop button for the packaging device, an unlocking button for the unloading drawer 23*b*, and the like are displayed in the packaging device operating area 1140. When any button is clicked, a corresponding operation is performed.

The medicine list display area 1120 includes a selected row label for displaying a selected row of a packaging list, a patient name label for displaying a patient name of the selected row of the packaging list, an in-prescription medicine list for displaying a list of in-prescription medicines, and a medicine number label for displaying a medicine displayed on the in-prescription medicine list.

Further, the medicine list display area 1120 displays information relating to the manual distribution operation. In each box of the distribution position/amount guide display area 1150 for a manual distribution drug relating to the manual distribution operation, a drug dispensed from the tablet cassette 16 and a total number of a drug having been manually distributed are displayed. When the all medicine display button is clicked, in the distribution position/amount guide display area 1150 for a manual distribution drug, both of a prescribed medicine corresponding to the manual distribution drug and tablets dispensed from the tablet cassette 16 in the prescription are displayed. Then, in each box, information relating to the total amount of all of drug tablets to be received is displayed. As a result, when dispensing and manual distribution of all of drug tablets are completed, and the unloading drawer 23*b* is drawn out, the displayed amount and the actual amount given in each box of the tray 24 can be visually inspected.

Moreover, in the distribution position/amount guide display area 1150 for manual distribution drug tablets relating to the manual distribution operation, a total number of drug tablets in the box having been manually distributed is displayed in each box. A manual-distribution-medicine-only display button for displaying information received in the boxes for manual distribution tablets is displayed. When the manual-distribution-medicine-only display button is clicked, information of the total number of a prescription drug distributed through manual distribution is displayed in the boxes.

Moreover, a manual distribution skip button is displayed, and when the manual distribution skip button is clicked, confirmation of completion of the manual distribution tablets is skipped.

The distribution position/amount guide display area 1150 for a manual distribution drug includes a distribution position/amount guide information title label for a manual distribution drug for displaying display contents of guides for distribution positions and distribution amounts of a manual distribution drug, a unit label for displaying "the number of pieces", a box image for displaying a box image, a lot-number label for displaying "lot number", an expiry date label for displaying an expiry date of a medicine, and a distribution completion button for updating a state of distribution of a manual distribution medicine.

Further, the monitor 101 displays a lot-number text box for inputting a lot number of a medicine and an expiry-date text box 1151 for inputting an expiry date of a medicine.

The control device 200 executes control in such a manner that a button for completion of distribution is not activated unless the turn of a subject prescription comes. Therefore, the lot number cannot be input.

On a screen of the monitor 101, a list of prescriptions is displayed in the packaging list display area, in which a prescription being subjected to packaging, a prescription whose turn has come, and a prescription waiting for its turn are displayed.

When all of the manual distribution operation has been completed, and the distribution completion button is pressed to settle the completion, a completion command is transmitted to the control device 200. When the manual-distribution completion instructing button 3*a* (see FIG. 27) is pressed, and the lid 22*b* is closed, tablets fall into the tray 24.

When the dispensing of tablets from the tablet cassette 16 or manual distribution of tablets is completed, the control device 200 allows the tray 24 to arrive at the unloading drawer 23*b*. A comparison dialog for a sheet to be affixed to the tray 24 is displayed, and a barcode of the sheet is read. When the comparison is correctly completed, the unloading drawer 23*b* on the right is unlocked. Then, the packaging operation is terminated.

In such a manner, the control device 200 of this embodiment is capable of controlling the monitor 101 of the input device 100 to display the progress of the tablet packaging device 11, thereby being capable of successively notifying an operator of progress information of packaging.

It is to be understood that the embodiments disclosed herein are merely examples in all aspects and in no way intended to limit this disclosure. The scope of this disclosure is defined by the appended claims and not by the above description of the embodiments, and it is intended that this disclosure encompasses all modifications made within the scope and spirit equivalent to those of the appended claims.

REFERENCE SIGNS LIST a tray handling position
b waiting position
A discharging position
B receiving start position
C waiting position
1 tray loading unit
2 tray unloading unit
3 manual-distribution unit
4 tray driving unit
5 tray attaching unit
6 tray detaching unit
10 adapter
11 tablet packaging device
12 frame
13 tablet accommodating portion
14 packaging portion
15 accommodating portion
16 tablet cassette
17 tablet feeder
18 louver shutter
19 tablet supplying device
20 tablet push-out passage
21 dispensing port
22 cover lid
23*a* loading drawer
23*b* unloading drawer
23*c* manual distribution drawer
24 tray
25 lid sheet
26 accommodation recess portion
29 tablet
30*a* first placement table
30*b* second placement table

The invention claimed is:

1. A tablet packaging device, comprising:

a tablet accommodating portion configured to store a plurality of kinds of tablets and dispense a tablet based on prescription information; and a packaging portion configured to dispense the tablets, which are dispensed from the tablet accommodating portion, through a dispensing port and distribute and accommodate the tablets to a tray having a plurality of accommodation recess portions that are arranged in a plurality of rows and columns, wherein the packaging portion includes:

a tray loading unit to which the tray is mountable;

a tray unloading unit, which is arranged adjacent to the tray loading unit, and to which the tray accommodating the tablets is mountable;

a tray driving unit configured to removably support the tray and move the supported tray in a width direction and a front-and-rear direction of the tablet packaging device between positions of the tray loading unit and the tray unloading unit, the tray driving unit being further configured to move the desired accommodation recess portion of the tray to the dispensing port for tablets so that the tablets, which are dispensed from the tablet accommodating portion, fall into the accommodation recess portions of the tray directly from the dispensing port;

a tray attaching unit configured to attach the tray from the tray loading unit to the tray driving unit; and a tray detaching unit configured to detach the tray accommodating the tablets from the tray driving unit and place the tray on the tray unloading unit, the tablet packaging device further comprising:

a manual-distribution unit configured to add tablets to the accommodation recess portions of the tray, wherein the manual-distribution unit includes:

a manual-distribution container including:

a manual-distribution member having division chambers, which are opened on upper and lower sides and are arranged at positions matching with the accommodation recess portions of the tray; and a shutter, which is slidably provided to a bottom surface of the manual-distribution member and is configured to open and close the division chambers; and a drawer portion, which is provided so as to allow the manual-distribution container to be pushed in and drawn out, and is set so as to allow the manual-distribution container to be located at a tablet distribution position outside the packaging portion when the drawer portion is drawn out and allow the manual-distribution container to be located at a discharging position at which the accommodation recess portions of the tray having the tablets discharged thereto and accommodated therein and the division chambers correspond to each other when the drawer portion is pushed in.

2. The tablet packaging device according to claim 1, wherein the tray driving unit is configured to support the tray at positions above the tray loading unit and the tray unloading unit, wherein the tray driving unit is configured to move the tray in a horizontal plane, wherein the tray attaching unit is configured to lift up the tray from the tray loading unit and attach the tray to the tray driving unit, wherein the tray detaching unit is configured to detach the tray accommodating the tablets from the tray driving unit, lower the tray, and place the tray on the tray unloading unit.

3. The tablet packaging device according to claim 1, wherein the tray driving unit includes an XY robot configured to move the supported tray in the width direction and the front-and-rear direction of the device in a horizontal plane.

4. The tablet packaging device according to claim 1, wherein the tray driving unit includes:

a conveyance stage, which is capable of being positioned above the tray loading unit and the tray unloading unit, and includes division chambers, which are arranged at positions matching the accommodation recess portions of the tray and are opened in the up-and-down direction; and a tray fixing member configured to attach the tray to a lower side of the conveyance stage under a state in which positions of the division chambers and positions of the accommodation recess portions of the tray match each other.

5. The tablet packaging device according to claim 4, wherein, the tray is mounted to the tray loading unit under a state in which the tray is placed on an adapter, which is opened on an upper side and is capable of accommodating the tray from the upper side, wherein the adapter includes stage engagement ratchets which are attachable to and detachable from tray fixing members of the conveyance stage, wherein the tray fixing members extend downward from side edges of the conveyance stage and have engagement holes which are engageable with the stage engagement ratchets, wherein the tray is attached to the tray driving unit in a state of being sandwiched between a lower surface of the conveyance stage and an upper surface of the adapter, and the conveyance stage is driven so that one of the division chambers is located at a position corresponding to the dispensing port to receive the tablets dispensed from the dispensing port, and wherein the tray having the tablets discharged thereto and accommodated therein is mounted to the tray unloading unit in a state of being placed on the adapter.

6. The tablet packaging device according to claim 4, wherein the tray loading unit is formed of a drawer provided so as to be freely placed in and out with respect to the packaging portion and includes a first placement table configured to place the tray inside the drawer, wherein the first placement table is set so as to be located at a tray handling position outside the packaging portion when the drawer is drawn out, and the first placement table is set so as to be located at a waiting position inside the packaging portion when the drawer is pushed in, and wherein the tray attaching unit includes a first raising/lowering device, which is provided below the waiting position of the tray loading unit and is configured to attach the tray to a lower surface of the conveyance stage located above the waiting position by lifting up the tray located at the waiting position from the lower side.

7. The tablet packaging device according to claim 6, wherein the first placement table of the tray loading unit includes a set of first support members configured to support both ends of the adapter in the width direction, and a region between the first support members is a first raising/lowering device passage region for allowing the first raising/lowering device to pass therethrough.

8. The tablet packaging device according to claim 4, wherein the tray unloading unit is formed of a drawer provided so as to be freely placed in and out with respect to the packaging portion and includes a second placement table configured to place the tray inside the drawer, wherein the second placement table is set so as to be located at a tray handling position outside the packaging portion when the drawer is drawn out, and the second placement table is set so as to be located at a waiting position inside the packaging portion when the drawer is pushed in, and wherein the tray detaching unit includes a second raising/lowering device, which is provided below the waiting position of the tray unloading unit and is configured to support, from below, the tray detached from the lower surface of the conveyance stage located above the waiting position and mount the tray to the second placement table of the tray unloading unit.

9. The tablet packaging device according to claim 8, wherein the second placement table of the tray unloading unit includes a set of second support members configured to support both ends of the adapter in the width direction, and a region between the second support members is a second raising/lowering device passage region for allowing the second raising/lowering device to pass therethrough.

10. The tablet packaging device according to claim 8, wherein the second raising/lowering device includes a releasing member configured to disengage the tray fixing members at the time of supporting, from below, the tray attached to the lower surface of the conveyance stage.

11. The tablet packaging device according to claim 1, wherein the drawer portion of the manual-distribution unit is provided at a position above the tray unloading unit, and wherein the discharging position of the drawer portion of the manual-distribution unit matches the waiting position of the tray unloading unit as seen from above.

12. The tablet packaging device according to claim 1, wherein the manual-distribution container is located above the conveyance stage, wherein the shutter includes engagement pieces extending downward to an end portion of the conveyance stage on a downstream side in the moving direction of the conveyance stage, and is attached while being urged under a state in which the division chambers of the manual-distribution container are closed, and wherein the engagement pieces engage with the conveyance stage along with movement of the conveyance stage to slide the shutter toward the downstream side in the moving direction of the conveyance stage, thereby opening the division chambers.

13. The tablet packaging device according to claim 1, wherein the tablet accommodating portion includes:

a tablet cassette shelf configured to hold a plurality of tablet cassettes; and a tablet conveying device configured to convey tablets, which are supplied from a corresponding tablet cassette shelf in accordance with a prescription, to a predetermined position, wherein the tablet conveying device includes:

a primary conveyance portion configured to convey tablets in a direction intersecting a direction from the tablet cassette shelf side toward the packaging portion side; and a secondary conveyance portion configured to convey the tablets in the direction from the tablet cassette shelf side toward the packaging portion, and wherein the tablet conveying device is configured to perform:

a first operation of conveying the tablets with the primary conveyance portion and thereafter conveying the tablets with the secondary conveyance portion; and a second operation of receiving the tablets from the tablet cassette shelf without passage through the primary conveyance portion and conveying the tablets with the secondary conveyance portion.

14. The tablet packaging device according to claim 13, wherein the primary conveyance portion includes:

a catching portion configured to catch supplied tablets; and a tablet push-out piece portion, which is movable in a conveyance direction of tablets in the primary conveyance portion, and is configured to push and move the tablets located at the catching portion.

15. The tablet packaging device according to claim 13, wherein the tablet conveying device further includes a leading portion configured to temporarily accommodate tablets supplied and led from the tablet cassette.

16. The tablet packaging device according to claim 13, wherein the leading portion includes:

an accommodation space including a discharging port portion configured to primarily accommodate the tablets having been led thereinto and discharge the tablets to the primary conveyance portion side or the secondary conveyance portion; and a movable catching member which is switchable between a tablet discharging posture of closing the discharging port portion and a tablet catching posture of allowing the discharging port portion to communicate with an outside.

17. The tablet packaging device according to claim 16, wherein, in the tablet catching posture, the movable catching member is inclined with respect to a horizontal direction to catch tablets having been led and accommodate the tablets in the leading portion.

18. A tablet packaging device, comprising:

a tablet accommodating portion configured to store a plurality of kinds of tablets and dispense a tablet based on prescription information; and a packaging portion configured to dispense the tablets, which are dispensed from the tablet accommodating portion, through a dispensing port and distribute and accommodate the tablets to a tray having a plurality of accommodation recess portions that are arranged in a plurality of rows and columns, wherein the packaging portion includes:

a tray loading unit to which the tray is mountable;

a tray unloading unit, which is arranged adjacent to the tray loading unit, and to which the tray accommodating the tablets is mountable;

a tray driving unit configured to removably support the tray and move the supported tray in a width direction and a front-and-rear direction of the tablet packaging device between positions of the tray loading unit and the tray unloading unit, the tray driving unit being further configured to move the desired accommodation recess portion of the tray to the dispensing port for tablets so that the tablets, which are dispensed from the tablet accommodating portion, fall into the accommodation recess portions of the tray directly from the dispensing port, wherein the tray driving unit includes:

a conveyance stage, which is capable of being positioned above the tray loading unit and the tray unloading unit, and includes division chambers, which are arranged at positions matching the accommodation recess portions of the tray and are opened in the up-and-down direction; and a tray fixing member configured to attach the tray to a lower side of the conveyance stage under a state in which positions of the division chambers and positions of the accommodation recess portions of the tray match each other;

a tray attaching unit configured to attach the tray from the tray loading unit to the tray driving unit; and a tray detaching unit configured to detach the tray accommodating the tablets from the tray driving unit and place the tray on the tray unloading unit;

wherein, the tray is mounted to the tray loading unit under a state in which the tray is placed on an adapter, which is opened on an upper side and is capable of accommodating the tray from the upper side, wherein the adapter includes stage engagement ratchets which are attachable to and detachable from tray fixing members of the conveyance stage, wherein the tray fixing members extend downward from side edges of the conveyance stage and have engagement holes which are engageable with the stage engagement ratchets, wherein the tray is attached to the tray driving unit in a state of being sandwiched between a lower surface of the conveyance stage and an upper surface of the adapter, and the conveyance stage is driven so that one of the division chambers is located at a position corresponding to the dispensing port to receive the tablets dispensed from the dispensing port, and wherein the tray having the tablets discharged thereto and accommodated therein is mounted to the tray unloading unit in a state of being placed on the adapter.

19. A tablet packaging device, comprising:

a tablet accommodating portion configured to store a plurality of kinds of tablets and dispense a tablet based on prescription information; and a packaging portion configured to dispense the tablets, which are dispensed from the tablet accommodating portion, through a dispensing port and distribute and accommodate the tablets to a tray having a plurality of accommodation recess portions that are arranged in a plurality of rows and columns, wherein the packaging portion includes:

a tray loading unit to which the tray is mountable;

a tray unloading unit, which is arranged adjacent to the tray loading unit, and to which the tray accommodating the tablets is mountable;

a tray driving unit configured to removably support the tray and move the supported tray in a width direction and a front-and-rear direction of the tablet packaging device between positions of the tray loading unit and the tray unloading unit, the tray driving unit being further configured to move the desired accommodation recess portion of the tray to the dispensing port for tablets so that the tablets, which are dispensed from the tablet accommodating portion, fall into the accommodation recess portions of the tray directly from the dispensing port;

a tray attaching unit configured to attach the tray from the tray loading unit to the tray driving unit; and a tray detaching unit configured to detach the tray accommodating the tablets from the tray driving unit and place the tray on the tray unloading unit, wherein the tablet accommodating portion includes:

a tablet cassette shelf configured to hold a plurality of tablet cassettes; and a tablet conveying device configured to convey tablets, which are supplied from a corresponding tablet cassette shelf in accordance with a prescription, to a predetermined position, wherein the tablet conveying device includes:

a primary conveyance portion configured to convey tablets in a direction intersecting a direction from the tablet cassette shelf side toward the packaging portion side; and a secondary conveyance portion configured to convey the tablets in the direction from the tablet cassette shelf side toward the packaging portion, and wherein the tablet conveying device is configured to perform:

a first operation of conveying the tablets with the primary conveyance portion and thereafter conveying the tablets with the secondary conveyance portion; and a second operation of receiving the tablets from the tablet cassette shelf without passage through the primary conveyance portion and conveying the tablets with the secondary conveyance portion.

* * * * *